US005652201A

United States Patent [19]

Papay et al.

[11] Patent Number: 5,652,201

[45] Date of Patent: Jul. 29, 1997

[54] LUBRICATING OIL COMPOSITIONS AND CONCENTRATES AND THE USE THEREOF

[75] Inventors: Andrew G. Papay, Manchester; Rolfe J. Hartley, St. Louis, both of Mo.

[73] Assignee: Ethyl Petroleum Additives Inc., Richmond, Va.

[21] Appl. No.: 500,560

[22] Filed: Jul. 11, 1995

Related U.S. Application Data

[63] Continuation of Ser. No. 109,013, Aug. 17, 1993, abandoned, which is a continuation of Ser. No. 706,773, May 29, 1991, abandoned.

[51] Int. Cl.[6] ..... C10M 141/06; C10M 141/08; C10M 141/10

[52] U.S. Cl. ..... 508/228; 508/348; 508/351

[58] Field of Search ..... 252/32.5, 32.7, 252/46.7, 49.6, 49.9, 51.5 A; 508/228, 348, 351

[56] References Cited

U.S. PATENT DOCUMENTS

| | | | |
|---|---|---|---|
| 2,346,155 | 4/1944 | Denison, Jr. et al. | 252/32 |
| 2,789,071 | 4/1957 | Freeman | 148/6.17 |
| 3,087,936 | 4/1963 | LeSuer | 260/326.3 |
| 3,108,959 | 10/1963 | Klass et al. | 252/32.7 |
| 3,184,411 | 5/1965 | Lowe | 252/46.7 |
| 3,185,645 | 5/1965 | Clayton | 252/46.7 |
| 3,235,497 | 2/1966 | Lee | 252/46.7 |
| 3,254,025 | 5/1966 | LeSuer | 252/32.7 |
| 3,259,579 | 7/1966 | Rogers et al. | 252/42.7 |
| 3,265,618 | 8/1966 | Henderson et al. | 252/32.5 |
| 3,281,428 | 10/1966 | LeSuer | 260/326.3 |
| 3,282,955 | 11/1966 | LeSuer | 260/326.3 |
| 3,284,409 | 11/1966 | Doner | 252/49.9 |
| 3,284,410 | 11/1966 | Meinhardt | 252/49.6 |
| 3,290,347 | 12/1966 | Miller | 260/429.9 |
| 3,306,908 | 2/1967 | LeSuer | 260/326.3 |
| 3,324,032 | 6/1967 | O'Halloran | 252/46.6 |
| 3,325,567 | 6/1967 | LeSuer | 260/928 |
| 3,328,296 | 6/1967 | Saraceno | 252/32.5 |
| 3,338,832 | 8/1967 | LeSuer | 252/47.5 |
| 3,342,735 | 9/1967 | Reed et al. | 252/46.7 |
| 3,344,069 | 9/1967 | Stuebe | 252/49.6 |
| 3,346,492 | 10/1967 | Hess | 252/32.5 |
| 3,350,316 | 10/1967 | Berger et al. | 252/75 |
| 3,396,183 | 8/1968 | Brasch | 260/429 |
| 3,403,102 | 9/1968 | LeSuer | 252/49.8 |
| 3,423,316 | 1/1969 | Dickert, Jr. et al. | 252/32.7 |
| 3,442,808 | 5/1969 | Traise et al. | 252/49.6 |
| 3,451,931 | 6/1969 | Kahn et al. | 252/32.7 |
| 3,502,677 | 3/1970 | LeSuer | 260/268 |
| 3,511,780 | 5/1970 | Neblett et al. | 252/32.7 |
| 3,513,093 | 5/1970 | LeSuer | 252/32.5 |
| 3,533,945 | 10/1970 | Vogel | 252/49.6 |
| 3,623,985 | 11/1971 | Hendrickson | 252/51.5 A |
| 3,646,134 | 2/1972 | Hunger | 260/551 P |
| 3,718,663 | 2/1973 | Piasek et al. | 260/326.3 |
| 3,723,460 | 3/1973 | Brannen et al. | 260/326.5 F |
| 3,865,740 | 2/1975 | Goldschmidt | 252/46.7 |
| 3,912,643 | 10/1975 | Adams | 252/49.6 |
| 3,912,644 | 10/1975 | Adams | 252/49.6 |
| 3,945,933 | 3/1976 | Chibnik et al. | 252/33.3 |
| 3,950,341 | 4/1976 | Okamoto et al. | 260/268 |
| 3,991,056 | 11/1976 | Okamoto et al. | 260/268 |
| 4,093,614 | 6/1978 | Chibnik et al. | 260/299 |
| 4,097,389 | 6/1978 | Andress, Jr. | 252/51.5 |
| 4,234,435 | 11/1980 | Meinhardt et al. | 252/51.5 |
| 4,295,983 | 10/1981 | Papay et al. | 252/49.6 |
| 4,328,113 | 5/1982 | Horodysky et al. | 252/49.6 |
| 4,338,205 | 7/1982 | Wisotsky | 252/32.5 |
| 4,426,305 | 1/1984 | Malec | 252/49.6 |
| 4,428,849 | 1/1984 | Wisotsky | 252/33.4 |
| 4,431,552 | 2/1984 | Salentine | 252/32.7 |
| 4,472,288 | 9/1984 | Frost, Jr. | 252/32.7 |
| 4,474,674 | 10/1984 | Gutierrez et al. | 252/47.5 |
| 4,529,528 | 7/1985 | Horodysky | 252/49.6 |
| 4,536,306 | 8/1985 | Horodysky et al. | 252/32.7 E |
| 4,554,086 | 11/1985 | Karol et al. | 252/49.6 |
| 4,557,844 | 12/1985 | Horodysky | 252/49.9 |
| 4,582,617 | 4/1986 | Doner et al. | 252/32.7 |
| 4,587,026 | 5/1986 | Horodysky | 252/47.5 |
| 4,600,517 | 7/1986 | Doner et al. | 252/32.7 |
| 4,615,826 | 10/1986 | Erdman | 252/32.5 |
| 4,618,436 | 10/1986 | Horodysky | 252/325 |
| 4,618,437 | 10/1986 | Horodysky | 252/32.5 |
| 4,634,543 | 1/1987 | Okada et al. | 252/78.5 |
| 4,637,885 | 1/1987 | Kuwamoto et al. | 252/32.5 |
| 4,642,330 | 2/1987 | Quinn | 528/335 |
| 4,648,980 | 3/1987 | Erdman | 252/32.5 |
| 4,650,595 | 3/1987 | Nagamori et al. | 252/32.5 |
| 4,659,488 | 4/1987 | Vinci | 252/33 |
| 4,680,129 | 7/1987 | Plavac | 252/51.5 A |
| 4,695,391 | 9/1987 | Buckley | 252/51.5 A |
| 4,698,169 | 10/1987 | Andress, Jr. et al. | 252/49.6 |
| 4,704,215 | 11/1987 | Hata et al. | 252/32.7 |
| 4,713,190 | 12/1987 | Erdman | 252/51.5 A |
| 4,721,802 | 1/1988 | Forsberg | 558/207 |
| 4,743,386 | 5/1988 | Doner et al. | 252/49.6 |
| 4,744,912 | 5/1988 | Cardis | 252/46.7 |
| 4,747,965 | 5/1988 | Wollenberg et al. | 252/51.5 A |
| 4,747,971 | 5/1988 | Erdman | 252/32.5 |
| 4,755,311 | 7/1988 | Burjes | 252/49.9 |
| 4,770,800 | 9/1988 | Cardis | 252/46.7 |
| 4,780,227 | 10/1988 | Doner et al. | 252/32.7 |
| 4,828,732 | 5/1989 | Doner et al. | 252/32.7 |
| 4,857,214 | 8/1989 | Papay et al. | 252/32.5 |
| 4,873,004 | 10/1989 | Beverwijk et al. | 252/32.5 |
| 4,960,528 | 10/1990 | Everett et al. | 252/47 |

FOREIGN PATENT DOCUMENTS

| | | |
|---|---|---|
| 0277729 | 10/1988 | European Pat. Off. . |
| 0384639 | 8/1990 | European Pat. Off. . |
| 1906038 | 8/1970 | Germany . |
| 130420 | 3/1978 | Germany . |
| 1054093 | 1/1967 | United Kingdom . |
| 1153161 | 5/1969 | United Kingdom . |

*Primary Examiner*—Margaret Medley
*Attorney, Agent, or Firm*—Dennis H. Rainear; Thomas Hamilton

[57] ABSTRACT

Oleaginous compositions and additive concentrates therefor having enhanced performance characteristics comprise a) at least one oil-soluble overbased alkali or alkaline earth metal-containing detergent having a TBN of at least 200; and b) one or more oil-soluble boron-free additive compositions formed by heating (i) at least one boron-free oil-soluble ashless dispersant containing basic nitrogen and/or at least one hydroxyl group, with (ii) at least one inorganic phosphorus acid such that a liquid boron-free phosphorus-containing composition is formed.

22 Claims, No Drawings

LUBRICATING OIL COMPOSITIONS AND CONCENTRATES AND THE USE THEREOF

This is a continuation of U.S. patent application Ser. No. 08/109,013, filed Aug. 17, 1993, now abandoned, and which was a continuation of application Ser. No. 07/706,773, filed May 29, 1991, now abandoned.

TECHNICAL FIELD

This invention relates to oleaginous compositions of enhanced performance characteristics, to additive concentrates for enhancing the performance characteristics of oleaginous base fluids (e.g., lubricants and functional fluids), and to methods of achieving such enhanced performance characteristics.

BACKGROUND

Over the years the demand for performance improvements in lubricating oils and functional fluids has persisted and, if anything, progressively increased. For example, lubricating oils for use in internal combustion engines, and in particular, in spark-ignition and diesel engines, are constantly being modified and improved to provide improved performance. Various organizations including the SAE (Society of Automotive Engineers), the ASTM (formerly the American Society for Testing Materials) and the API (American Petroleum Institute) as well as the automotive manufacturers continually seek to improve the performance of lubricating oils. Various standards have been established and modified over the years through the efforts of these organizations. As engines have increased in power output and complexity, and in many cases decreased in size, the performance requirements have been increased to provide lubricating oils that will exhibit a reduced tendency to deteriorate under conditions of use and thereby to reduce wear and the formation of such undesirable deposits as varnish, sludge, carbonaceous materials and resinous materials which tend to adhere to various engine parts and reduce the operational efficiency of the engine.

Current objectives include the development of additive formulations and lubricant compositions, especially crankcase lubricants and crankcase lubricant additive packages, capable of achieving these stringent performance requirements without requiring use of heavy metal-containing components, such as zinc dihydrocarbyl dithiophosphates. Because of environmental and conservational concerns, much emphasis of late has been devoted toward finding ways of eliminating heavy metal-containing components from lubricants and functional fluids. Not only do heavy metals pose environmental and toxicological problems (e.g., problems arising in the event of spillage, leaks, etc.), but their presence in used oils complicates used oil reclamation procedures.

Still another desirable objective is to provide additive formulations and lubricant compositions which exhibit good compatability with elastomeric substances utilized in the manufacture of seals, gaskets, clutch plate facings, diaphragms, and like parts. Unfortunately, commonly used additives containing basic nitrogen constituents tend to cause excessive degradation of such elastomers when oils containing such additives come in contact with such elastomers during actual service conditions.

A need thus exists for novel oleaginous compositions (i.e., lubricants and functional fluids) and additive formulations therefor which are capable of meeting stringent performance criteria including adequate compatibility with elastomeric substances, and which nonetheless are devoid of heavy metal-containing components.

There are literally hundreds, if not thousands, of patent disclosures describing attempts (some more successful than others) to improve the performance characteristics of oils of lubricating viscosity. The following is but a small selection from this vast body of literature.

U.S. Pat. Nos. 3,087,936 and 3,254,025 disclose forming oil-soluble nitrogen- and boron-containing compositions by treating an acylated nitrogen composition with a boron compound selected from boron oxide, boron halides, boron acids, and esters of boron acids.

U.S. Pat. No. 3,184,411 refers to producing lubricant additives by reacting a succinimide formed from an alkenyl succinic anhydride and a polyalkylene polyamine with phosphorus pentasulfide.

U.S. Pat. No. 3,185,645 teaches preparation of lubricant additives by reacting an alkenyl succinic anhydride, a dihydrocarbyl dithiophosphate and a polyalkylene polyamine.

U.S. Pat. No. 3,235,497 discloses formation of a lubricant additive by reacting a phosphorus sulfide such as phosphorus pentasulfide with a high boiling hydrocarbon, reacting the resulting phosphosulfurized hydrocarbon product with an alcohol to form an O-ester of a hydrocarbon thioacid of phosphorus, reacting this latter product with an olefinically unsaturated dicarboxylic acid or anhydride, and then reacting this resulting product with an amine containing one or more primary amino groups.

U.S. Pat. No. 3,265,618 describes formation of acid aryl phosphate salts of polybutenyl succinimides and their use with detergent polymers in lubricating oils.

U.S. Pat. Nos. 3,281,428 and 3,338,832 describe use as lubricating oil additives of products made by reacting a hydrocarbon-substituted succinic acid producing compound with an amido compound (RR'NH; R is H or a hydrocarbyl group and R' is amino, cyano, carbamyl or guanyl), and reacting this product with a boron compound (boron oxide, boron halide, boron acid, ammonium salt of boron acid or ester of boron acid).

U.S. Pat. No. 3,282,955 discloses preparation of lubricant additives by reacting a hydrocarbon-substituted succinic acid-producing compound with a hydroxyhydrocarbon amine and then reacting this product with a boron compound, namely a boron oxide, boron halide, boron acid, ammonium salt of boron acid or ester of boron acid.

U.S. Pat. No. 3,284,410 refers to forming a boron-containing product by reacting a hydrocarbon-substituted succinic acid compound with an alkylene amine, and a both a boron reactant and a cyanamido amido compound (RR'N—CN; R is hydrogen or alkyl, and R' is hydrogen, alkyl, or guanyl). The boron reactants are selected from boron acids, boron oxide, boron halides, ammonium salts of boron acids, and esters of boron acids with monohydric alcohols.

U.S. Pat. No. 3,324,032 teaches forming an additive for lubricating oil by forming a reaction product of dithiophosphoric acid and dibasic acid anhydride and then reacting this product with an amine or ammonia.

U.S. Pat. Nos. 3,325,567 and 3,403,102 disclose preparation of phosphorus-containing esters by reacting a polyhydric alcohol with (A) a hydrocarbon-substituted succinic acid or halide, ester or anhydride thereof, and (B) a phosphorus acid producing compound selected from phosphoric acids, phosphorus acids, and the halides, the esters, and the anhydrides thereof.

U.S. Pat. No. 3,344,069 refers to forming a boron-containing product by reacting a hydrocarbon-substituted succinic acid compound with an alkylene amine, and both a boron reactant and a polyhydric alcohol or a bisphenol or an aminoalkylphenol. The boron reactants are selected from boron acids, boron oxide, boron halides, ammonium salts of boron acids, and esters of boron acids with monohydric alcohols.

U.S. Pat. Nos. 3,502,677 and 3,513,093 describe preparation of substituted polyamines by the reaction of 1 mole of an alkylene amine with at least about 0.25 mole of a substantially hydrocarbon-substituted succinic acid-producing compound having at least about 50 aliphatic carbon atoms in the substantially hydrocarbon substituent and at least about 0.001 mole of a phosphorus acid-producing compound selected from the class consisting of phosphoric acids, phosphorous acids, phosphonyl acids, phosphinyl acids, and the esters, the halides, and the anhydrides thereof.

U.S. Pat. No. 3,511,780 refers to mineral oil-soluble detergent-dispersants prepared by reacting the condensation product of an alkenyl succinic anhydride and a polyamine (with or without a carboxylic acid) with an acidic reaction product of a phosphorus sulfide and a hydrocarbon and, in a modification, by treatment also with a dialkyldithiophosphorus acid. It is indicated that the additive can be used with conventional additives such as zinc dialkyldithiophosphate.

U.S. Pat. No. 3,533,945 describes use as a lubricating oil additive of a combined boron ester-alkenyl succinic acid ester of a polyhydric alcohol.

U.S. Pat. No. 3,623,985 teaches reacting an alkenyl succinimide with a compound such as cyanuric chloride, phosphoryl isocyanate, phosphorus oxytrichloride or phosphorothionic trichloride to form a product having three alkenyl succinimides bonded through an amine nitrogen to a central nucleus such as a triazine or phosphorus acid derivative. The products are indicated to find use as detergents and dispersants in lubricating oils.

U.S. Pat. No. 3,718,663 deals with preparation of oil-soluble boron derivatives of an alkylene polyamine-urea or thioureasuccinic anhydride addition product.

U.S. Pat. No. 3,865,740 is concerned with multifunctional lubricant additives which are N-substituted, S-aminomethyldithiophosphates, wherein the substituent is, among other things, a hydrocarbyl-substituted succinimide.

U.S. Pat. Nos. 3,950,341 and 3,991,056 refer to oil-soluble ashless detergent dispersants consisting of a reaction product obtained by reacting (a) an alkenyl dibasic acid or its anhydride with (b) an alcohol of the hindered type, and then reacting the so obtaining intermediate with (c) an amine or its derivative or analog, or with boric acid (or its anhydride) or phosphorus pentasulfide.

U.S. Pat. No. 4,097,389 discloses the formation of reaction products useful as detergents in lubricants, fuels or other industrial fluids. The products are made by reacting alkenyl succinic anhydride with an amino alcohol such as tris (hydroxymethyl)aminomethane, and then reacting this product with boric acid or an organoborate, organophosphonate or aldehyde.

U.S. Pat. No. 4,234,435 relates to carboxylic acid acylating agents derived from polyalkenes such as polybutenes, and a dibasic, carboxylic reactant such as maleic or fumaric acid or certain derivatives thereof. These acylating agents are characterized in that the polyalkenes from which they are derived have a $\overline{M}n$ value of about 1300 to about 5000 and a $\overline{M}w/\overline{M}n$ value of about 1.5 to about 4. The acylating agents are further characterized by the presence within their structure of at least 1.3 groups derived from the dibasic, carboxylic reactant for each equivalent weight of the groups derived from the polyalkene. The acylating agents can be reacted with a further reactant subject to being acylated such as polyethylene polyamines and polyols (e.g., pentaerythritol) to produce derivatives useful per se as lubricant additives or as intermediates to be subjected to post-treatment with various other chemical compounds and compositions to produce still other derivatives useful as lubricant additives. An extensive listing of post-treating reagents is set forth. Reference is made to addition to a lubricating oil containing a zinc dialkyldithiophosphate, a basic calcium sulfonate, a basic calcium sulfur-bridged alkylphenol and a sulfurized Diels-Alder adduct, in one case of a polybutenyl succinic ester-amide, and in another case of a polybutenyl succinimide of a polyamine.

U.S. Pat. Nos. 4,338,205 and 4,428,849 refer to treating alkenyl succinimides or borated alkenyl succinimides at elevated temperatures with an oil-soluble strong acid, such as an alkaryl sulfonic acid or a phosphoric acid, such as a dialkyl monoacid phosphate.

U.S. Pat. No. 4,554,086 describes as lubricant additives borate esters of hydrocarbyl-substituted mono- and bis-succinimides containing polyamine chain linked hydroxyacyl groups.

U.S. Pat. Nos. 4,615,826, 4,648,980 and 4,747,971 describe oil-soluble nitrogen-containing dispersant adducts with fluorophosphoric acid.

U.S. Pat. No. 4,634,543 pertains to shock absorber fluids which contain a boronated compound such as a boronated polyisobutenyl succinimide of an alkylene polyamine and also a phosphorous acid ester or a phosphoric acid ester or an amine salt of either such ester.

U.S. Pat. No. 4,857,214 describes oil-soluble reaction products of inorganic phosphorus containing acids or anhydrides with a boron compound and ashless dispersants such as alkenyl succinimides useful as antiwear/EP additives in lubricants.

U.S. Pat. No. 4,873,004 describes use in lubricants of alkyl or alkenyl-substituted succinimides in which the alkyl or alkenyl moiety has a number average molecular weight from 600 to 1300 and in which the average number of succinic groups per alkyl or alkenyl group is between 1.4 and 4.0. Use in a commercial package of a zinc dialkyldithiophosphate, an overbased calcium salicylate and a VI improver is disclosed. It is suggested that the succinimide may be post-treated with any of an array of post-treating agents.

THE INVENTION

This invention provides additive systems capable of imparting enhanced performance characteristics to natural and synthetic oils of lubricating viscosity. In addition, this invention makes it possible to achieve such enhanced performance with additive systems devoid of metal-containing performance enhancers such as metal-containing dithiophosphates, xanthates and/or dithiocarbamates. In short, this invention makes it possible to achieve a high level of performance without use of conventional heavy-metal containing performance enhancer additives such as zinc dialkyldithiophosphates.

In accordance with this invention there is provided in one of its embodiments a composition comprising a major proportion of at least one oil of lubricating viscosity and a minor proportion of at least the following components: a)

one or more oil-soluble overbased alkali or alkaline earth metal-containing detergents having a total base number (TBN) of at least 200, preferably at least 250, more preferably at least 300, and most preferably 400 or more; and b) one or more oil-soluble boron-free additive compositions formed by heating (i) at least one boron-free oil-soluble ashless dispersant containing basic nitrogen and/or* at least one hydroxyl group, with (ii) at least one inorganic phosphorus acid such that a liquid boron-free phosphorus-containing composition is formed. The cooperation between components a) and b) of such compositions makes it possible to achieve performance levels (reduction in sludge formation and/or deposition and reduction in wear in gears and/or other relatively moveable metal surfaces in contact with each other) normally achieved, if at all, by use of heavy metal-containing additive components such as zinc dialkyldithiophosphates.

*Note: For simplicity and convenience, the term "and/or" is used in this description. Whenever such term appears herein, it is used as a function word to indicate that two words or expressions are to be taken together or individually. Thus in the instance specified above, the ashless dispersant contains basic nitrogen or at least one hydroxyl group (but not both); or the ashless dispersant contains a combination of basic nitrogen and at least one hydroxyl group. In other words, there are three different situations: (1) the dispersant contains basic nitrogen but no hydroxyl group; (2) the dispersant contains at least one hydroxyl group but no basic nitrogen; (3) the dispersant contains basic nitrogen and it also contains at least one hydroxyl group.

Another advantageous feature of this invention is that combinations of components a) and b) can exhibit good compatibility toward elastomers commonly employed in the manufacture of seals or gaskets, clutch plate facings, diaphragms, etc., such as nitrile rubbers, fluoroelastomers, and silicon-containing (e.g., silicone-type) elastomers. In other words, such elastomers are not subjected to excessive degradation when in contact under actual service conditions with a preferred lubricant or functional fluid composition of this invention.

Still another advantageous feature of this invention is that the combinations of components a) and b) are relatively non-corrosive toward "yellow metals" such as copper, brass, bronze, and the like. In such combinations, component a) is composed of one or more overbased alkali metal-containing and/or overbased alkaline earth metal-containing detergents of the types generally known to be useful in oleaginous fluids (e.g., overbased sulfonates, overbased phenates, over-based sulfurized phenates, over-based salicylates, overbased sulfurized salicylates, etc.). Besides contributing detergency to the compositions, such metal compounds can serve to reduce corrosive attack on so-called "yellow metals" such as copper, bronze, and the like. Detergents of the foregoing types having a total base number (TBN) of at least about 200 are utilized in the practice of this invention. In this connection, TBN is determined in accordance with ASTM D-2896–88.

Additive concentrates comprising at least components a) and b) above constitute additional embodiments of this invention. Such concentrates usually contain a minor proportion of at least one diluent oil of lubricating viscosity (usually a process oil) and a major proportion of the active ingredients or components utilized in forming the additive concentrate.

Still another embodiment of this invention is a composition comprising a major proportion of at least one oil of lubricating viscosity and a minor proportion of at least the following components:

a) one or more oil-soluble alkali or alkaline earth metal-containing detergents having a TBN of at least about 200; preferably about 250 or more, more preferably about 300 or more, and most preferably about 400 or more;

b) one or more oil-soluble boron-free additive compositions formed by heating (i) at least one boron-free oil-soluble ashless dispersant containing basic nitrogen and/or at least one hydroxyl group, with (ii) at least one inorganic phosphorus acid such that a liquid boron-free phosphorus-containing composition is formed; and c) one or more oil-soluble or oil-dispersible boron-containing additive components. Such compositions are of particular effectiveness under conditions where scuffing wear is likely to be encountered.

Likewise, additive concentrates which comprise the above components a), b) and c) form still additional embodiments of this invention.

In order to satisfy the stringent specification requirements to qualify for top-grade crankcase lubricating oils, a combination of antioxidant and corrosion inhibitor is preferably included in the compositions of this invention. In this way, the enhanced performance (e.g., effective control of sludge, deposit and varnish formation and of wear of contacting metal parts) made possible by this invention can be maintained while at the same time satisfying specification requirements associated with oxidation and corrosion inhibition. Thus in another preferred embodiment of this invention, there is provided a crankcase lubricant composition which comprises a major proportion of at least one oil of lubricating viscosity and a minor proportion of at least the following components:

a) one or more oil-soluble alkali or alkaline earth metal-containing detergents having a TBN of at least about 200; preferably about 250 or more, more preferably about 300 or more, and most preferably about 400 or more;

b) one or more oil-soluble boron-free additive compositions formed by heating (i) at least one boron-free oil-soluble ashless dispersant containing basic nitrogen and/or at least one hydroxyl group, with (ii) at least one inorganic phosphorus acid—preferably one or more sulfur-free inorganic phosphorus acids, most preferably phosphorous acid ($H_3PO_3$)—such that a liquid boron-free phosphorus-containing composition is formed;

c) optionally but preferably, one or more oil-soluble or oil-dispersible boron-containing additive components;

d) one or more oil-soluble antioxidants; and e) one or more oil-soluble corrosion inhibitors;

such that said lubricant composition satisfies (1) the requirements of the Sequence IID, Sequence IIIE, and Sequence VE procedures of the American Petroleum Institute; and/or (2) the requirements of the L-38 Test Procedure of the American Petroleum Institute; and/or (3) the requirements of the Caterpillar® 1G(2) and/or the 1H(2) Test Procedure. The Sequence IID procedure is as set forth in ASTM STP 315H Part 1, including any and all amendments detailed by the Information Letter System (up to Nov. 1, 1990). The Sequence IIIE procedure is as set forth in ASTM Research Report: D-2:1225 of Apr. 1, 1988 including any and all amendments detailed by the Information Letter System (up to Nov. 1, 1990). The Sequence VE procedure is as set forth in ASTM Sequence VE Test Procedure, Seventh Draft, May 19, 1988, including any and all amendments detailed by the Information Letter System (up to Nov. 1, 1990). The L-38 procedure is as set forth in ASTM D-5119, including any and all amendments detailed by the Information Letter System (up to Nov. 1, 1990). The Caterpillar® 1G(2) procedure is as set forth in ASTM STP 509A, Part 1, including any and all amendments detailed by the Information Letter System (up to Nov. 1, 1990). The Caterpillar® 1H(2) procedure is as set forth in ASTM STP 509A, Part 2, including any and all amendments detailed by the Information Letter System (up to Nov. 1, 1990). Additive concentrates which comprise at least components a), b), c), d) and e) as set forth above, and which when blended with a base oil of lubricating viscosity provide a lubricant satisfying the foregoing Sequence IID, IIIE, and VE procedures; and/or the L-38 procedure; and/or at least one of the Caterpillar® 1G(2) and Caterpillar® 1H(2) procedures constitute still additional especially preferred embodiments of this invention. The most preferred embodiments are lubricant compositions and additive concentrates which satisfy the requirements of all of the Sequence IID, Sequence IIIE, Sequence VE, L-38, Caterpillar® 1G(2) and Caterpillar® 1H(2) procedures.

Among the preferred embodiments of this invention are oleaginous compositions and additive concentrates in which the relative proportions of components a) and b) are such that the atom ratio of total alkali and/or alkaline earth metal in the form of component a) to phosphorus in the form of component b), respectively, falls in the range of about 0.02:1 to about 1,000:1 (and more preferably in the range of about 0.05:1 to about 150:1 and most preferably in the range of about 0:1 to about 15:1). Particularly preferred are compositions of these types which contain components a), b) and c) in relative proportions such that per atom of phosphorus in the form of component b), the composition contains from about 0.02 to about 1,000 atoms (and more preferably from about 0.05 to about 150 atoms, and most preferably from about 0.1 to about 15 atoms) of metal as component a), and from about 0 to about 600 atoms (and more preferably from about 0.15 to about 200 atoms, and most preferably from about 0.2 to about 15 atoms) of boron as component c). Particularly preferred are lubricants and functional fluids containing components a) and b) proportioned as specified in this paragraph wherein the total content of metals in the form of component a) is in the range of about 0.001 to about 1, preferably in the range of about 0.01 to about 0.5, and most preferably in the range of about 0.02 to about 0.3 weight percent of metal(s) based on the total weight of the lubricant composition or functional fluid composition. Despite the absence of any added quantity of heavy metal-containing components, such lubricant and functional fluid compositions can provide a high level of performance.

Other preferred embodiments of this invention are oleaginous compositions and additive concentrates in which one or more sulfur-free phosphorus acids are used in forming component b). This reduces the possibility of hydrogen sulfide evolution from component b) during long periods of storage under elevated temperatures.

Still further preferred embodiments of this invention comprise lubricant compositions formulated for use as crankcase lubricants for gasoline engines containing at least components a) and b) in proportions such that the overall composition has a TBN based on the alkali and/or alkaline earth metal-containing components only of at least about 0.6, preferably at least about 0.8, and most preferably at least about 2. Additional further preferred embodiments of this invention comprise lubricant compositions formulated for use as crankcase lubricants for diesel engines containing at least components a) and b) in proportions such that the overall composition has a TBN based on the alkali and/or alkaline earth metal-containing components only of at least about 1.5, preferably at least about 1.9, and most preferably at least about 4.

Other embodiments of this invention include the provision of methods for inhibiting sludge formation and/or deposition in oils normally tending to occur during actual service conditions, and methods for imparting antiwear and/or extreme pressure properties to oils of lubricating viscosity. Also provided are methods of inhibiting elastomer degradation, particularly fluoroelastomer and silicone elastomer degradation, in systems wherein an elastomer is maintained in contact with an oleaginous composition containing one or more basic nitrogen-containing components.

Yet another embodiment of this invention is the provision of ways of reducing scuffing wear, especially scuffing wear of the type experienced when operating an internal combustion engine on a periodical basis so that it must be started from time to time by cranking the engine after it has been standing idle and is not warmed up through prior operation. Use as crankcase lubricants of preferred oleaginous compositions of this invention comprising components a), b) and c) can reduce such scuffing wear. Thus, for example, this invention provides a method of reducing scuffing wear in an internal combustion engine which comprises providing as the crankcase lubricant for the engine, a lubricant composition of this invention containing a minor proportion of components a), b) and c), and operating the engine on a discontinuous basis such that the engine is started by cranking from time to time.

The above and other embodiments and features of this invention will become further apparent from the ensuing description and appended claims.

Component a)

The metal-containing detergents of the compositions of this invention are exemplified by oil-soluble overbased salts of alkali or alkaline earth metals with one or more of the following acidic substances (or mixtures thereof): (1) sulfonic acids, (2) carboxylic acids, (3) salicylic acids, (4) alkylphenols, (5) sulfurized alkylphenols, (6) organic phosphorus acids characterized by at least one direct carbon-to-phosphorus linkage. Such organic phosphorus acids include those prepared by the treatment of an olefin polymer (e.g., polyisobutene having a molecular weight of 1,000) with a phosphorizing agent such as phosphorus trichloride, phosphorus heptasulfide, phosphorus pentasulfide, phosphorus trichloride and sulfur, white phosphorus and a sulfur halide, or phosphorothioic chloride. The preferred salts of such acids from the cost-effectiveness, toxicological, and environmental standpoints are the salts of sodium, potassium, lithium, calcium, and magnesium. And as noted above, the salts for use as component a) are overbased salts having a TBN of at least 200, more preferably at least 250, still more preferably at least 300, and most preferably at least 400.

The term "overbased" in connection with composition a) is used to designate metal salts wherein the metal is present in stoichiometrically larger amounts than the organic acid radical. The commonly employed methods for preparing the overbased salts involve heating a mineral oil solution of an acid with a stoichiometric excess of a metal neutralizing agent such as the metal oxide, hydroxide, carbonate, bicarbonate, or sulfide at a temperature of about 50° C., and filtering the resulting mass. The use of a "promoter" in the neutralization step to aid the incorporation of a large excess of metal likewise is known. Examples of compounds useful as the promoter include phenolic substances such as phenol, naphthol, alkylphenol, thiophenol, sulfurized alkylphenol, and condensation products of formaldehyde with a phenolic substance; alcohols such as methanol, 2-propanol, octyl alcohol, Cellosolve alcohol, Carbitol alcohol, ethylene glycol, stearyl alcohol, and cyclohexyl alcohol; and amines such as aniline, phenylenediamine, phenothiazine, phenyl-beta-naphthylamine, and dodecylamine. A particularly effective method for preparing the basic salts comprises mixing an acid with an excess of a basic alkaline earth metal neutralizing agent and at least one alcohol promoter, and carbonating the mixture at an elevated temperature such as 60°–200° C.

Examples of suitable metal-containing detergents include, but are not limited to, overbased salts of such substances as lithium phenates, sodium phenates, potassium phenates, calcium phenates, magnesium phenates, sulfurized lithium phenates, sulfurized sodium phenates, sulfurized potassium phenates, sulfurized calcium phenates, and sulfurized magnesium phenates wherein each aromatic group has one or more aliphatic groups to impart hydrocarbon solubility; lithium sulfonates, sodium sulfonates, potassium sulfonates, calcium sulfonates, and magnesium sulfonates wherein each sulfonic acid moiety is attached to an aromatic nucleus which in turn usually contains one or more aliphatic substituents to impart hydrocarbon solubility; lithium salicylates, sodium salicylates, potassium salicylates, calcium salicyclates, and magnesium salicylates wherein the aromatic moiety is usually substituted by one or more aliphatic substituents to impart hydrocarbon solubility; the lithium, sodium, potassium, calcium and magnesium salts of hydrolysed phosphosulfurized olefins having 10 to 2,000 carbon atoms or of hydrolyzed phosphosulfurized alcohols and/or aliphatic-substituted phenolic compounds having 10 to 2,000 carbon atoms; lithium, sodium, potassium, calcium and magnesium salts of aliphatic carboxylic acids and aliphatic-substituted cycloaliphatic carboxylic acids; and many other similar alkali and alkaline earth metal salts of oil-soluble organic acids. Mixtures of overbased salts of two or more different alkali and/or alkaline earth metals can be used. Likewise, overbased salts of mixtures of two or more different acids or two or more different types of acids (e.g., one or more overbased calcium phenates with one or more overbased calcium sulfonates) can also be used.

As is well known, overbased metal detergents are generally regarded as containing overbasing quantities of inorganic bases, probably in the form of micro dispersions or colloidal suspensions. Thus the term "oil-soluble" as applied to component a) materials is intended to include metal detergents wherein inorganic bases are present that are not necessarily completely or truly oil-soluble in the strict sense of the term, inasmuch as such detergents when mixed into base oils behave in much the same way as if they were fully and totally dissolved in the oil.

Collectively, the various overbased detergents referred to hereinabove, have sometimes been called, quite simply, basic or overbased alkali metal or alkaline earth metal-containing organic acid salts.

Methods for the production of oil-soluble overbased alkali and alkaline earth metal-containing detergents are well known to those skilled in the art and are extensively reported in the patent literature. See for example, the disclosures of U.S. Pat. Nos. 2,451,345; 2,451,346; 2,485,861; 2,501,731; 2,501,732; 2,585,520; 2,671,758; 2,616,904; 2,616,905; 2,616,906; 2,616,911; 2,616,924; 2,616,925; 2,617,049; 2,695,910; 3,178,368; 3,367,867; 3,496,105; 3,629,109; 3,865,737; 3,907,691; 4,100,085; 4,129,589; 4,137,184; 4,148,740; 4,212,752; 4,617,135; 4,647,387; 4,880,550; GB Published Patent Application 2,082,619 A, and European Patent Application Publication Nos. 121,024 B1 and 259,974 A2, the disclosures of which are incorporated herein by reference.

The following examples illustrate methods by which overbased metal detergents can be prepared.

EXAMPLE A-1

(a) Into a reaction vessel is charged 646 g of solvent refined 500N lubricating oil (a mixture of alkyl aromatics, naphthenes, and paraffins). At 75° F., 150.8 g of oleum (~27.6% $SO_3$) is charged to the reaction vessel over a 10-minute period. The reaction temperature is allowed to rise, generally to about 100° F. Afterwards, 12.3 mL of water and 540 mL of Chevron 265 thinner (a mixture of aromatics, naphthenes, and paraffins) is added to the system. The system is maintained at 150° F. for one hour. At this time, 125 mL of a 25 weight percent aqueous solution of sodium hydroxide is added to the system. The reaction mixture is maintained at 150° F. for one hour. After settling, the aqueous layer is removed and the organic solution is then maintained at temperature for at least one additional hour. After this period, any additional aqueous layer which settles out is also removed. The system is stripped at 350° F. and atmospheric pressure with an air sweep to yield sodium hydrocarbyl sulfonate. This product is purified by dissolving the sodium hydrocarbyl sulfonate in 330 mL of aqueous secondary butanol. An aqueous solution (160 mL) containing 4% by weight of sodium chloride is added to the system. The resultant mixture is heated to 150° F. and maintained at this temperature for two hours. After settling, brine is removed. An additional 80 mL of an aqueous solution containing 4% by weight of sodium chloride is added to the system. The system is heated to 150° F. and maintained at this temperature for one hour. After settling, brine is removed. Water (220 mL) is then added to the system and the mixture heated to 150° F. and maintained at this temperature for another one hour period. Thereafter, water and unsulfonated oil layer are removed leaving an aqueous secondary butanol solution containing sodium hydrocarbyl sulfonate.

(b) To an aqueous secondary butanol solution containing sodium hydrocarbyl sulfonate produced as in (a) is added 500 mL of a solution containing water, secondary butanol and approximately 10% of calcium chloride. The system is heated to 150° F. and maintained at this temperature for one hour. After settling, brine is removed. Water (240 mL) and 170 mL of an aqueous solution containing 40% by weight of calcium chloride is added to the system, the system is heated to 150° F., and the system is maintained at this temperature for at least one additional hour. After settling, brine is removed. Water (340 mL) and 170 mL of an aqueous solution containing 40% by weight of calcium chloride is added to the system. The system is heated to 150° F. and maintained at this temperature for at least one hour. After settling, brine is removed. Water (340 mL) is then added to the system and the system is heated to 150° F. where it is maintained for one additional hour. After settling, the aqueous layer is removed. Next, an additional 340 mL of water is added to the system and the system is heated to 150° F. and maintained at this temperature for one hour. After settling, the aqueous layer is removed. The aqueous secondary butanol solution is then stripped at elevated temperatures and reduced pressures to yield overbased calcium hydrocarbyl sulfonate.

EXAMPLE A-2

(a) To a 2-liter flask equipped with stirrer, Dean Stark trap, condenser and nitrogen inlet and outlet are added 567 g of tetrapropylene, 540 g of phenol, 72 g of a sulfonic acid cation exchange resin (polystyrene crosslinked with divinylbenzene) catalyst (Amberlyst 15®; Rohm & Haas). The reaction mixture is heated to about 110° C. for about 3 hours with stirring under a nitrogen atmosphere. The reaction mixture is stripped by heating under vacuum and the resulting product is filtered while hot over a diatomaceous earth to yield tetrapropenylphenol containing a high proportion of para-alkylphenol content.

(b) To a 2-liter flask equipped as in (a) are added 854 g of a predominantly $C_{18}$ to $C_{30}$ olefin mixture (olefin content: $C_{16}$ 0.5%; $C_{18}$ 6.6%; $C_{20}$ 26.2%; $C_{22}$ 27.7%; $C_{24}$ 18.2%; $C_{26}$ 9.0%; $C_{28}$ 4.5%; $C_{30}$ 28%; greater than $C_{30}$4.5%) wherein in the entire olefin fraction at least 30 mole % of the olefins contain trisubstituted vinyl groups (available from Ethyl Corporation), 720 g of phenol, 55 g of a sulfonic acid cation exchange resin (polystyrene cross-linked with divinylbenzene) catalyst (Amberlyst 15®; Rohm & Haas). The reaction mixture is heated under a nitrogen atmosphere sphere to about 145° C. for about 6 hours with stirring. The reaction mixture is stripped by heating under vacuum and the resulting product is filtered while hot over diatomaceous earth to yield a $C_{18}$–$C_{30}$ alkylphenol.

(c) A 2-liter, 4-neck flask is charged with 354 g of $C_{18}$–$C_{30}$ alkylphenol prepared as in (a) above, 196 g of tetrapropenylphenol prepared as in (b) above, 410 g of decanol, 20 g of 2-mercaptobenzothiazole, 40 g of calcium overbased hydrocarbyl sulfonate, prepared as in Example A-1 above, and 200 g of Cit-Con 100N oil. The system is heated with agitation to 90° C. and 296 g of calcium hydroxide and 108 g of sulfur are charged to the reaction system. The resultant mixture is then held at 90° C. for 45 minutes. Then the temperature is raised over a 15-minute period to 150° C. whereupon 206 g of ethylene glycol is added portionwise over a 60-minute period. The temperature of the reaction mixture is then increased to 160° C. and held at this temperature for one hour. While stirring the mixture at a moderately fast rate, the temperature of the mixture is increased at the rate of 5° C. per 20 minutes until the reaction temperature reaches 175° C. whereupon 144 g of carbon dioxide is charged through a flow meter to the reaction mixture over a three hour period. The reaction temperature is then increased to 195° C. and the system stripped under vacuum (~10 mm of Hg) for a period of 30 minutes to yield the desired high TBN calcium overbased sulfurized alkylphenol. This product is purified by addition to the system of 3 weight percent diatomaceous earth consisting of 50% Hi-Flo, and 50% of 512 Celite, (commercial diatomaceous earth products available from Manville, Filtration and Minerals Division), followed by filtration through a ¼ inch Celite pad on a Buchner funnel. The resulting product should have a TBN (total base number) of approximately 340.

EXAMPLE A-3

A reaction vessel is charged with 78.4 g of 5W oil, 305 mL of technical grade hexane and 58.6 g of a sulfonic acid derived from poly-1-butene alkyl benzene showing on analysis 79.9% sulfonic acid, 18.0% oil, and 2.1% calcium sulfate (sediment) and an equivalent weight for the sulfonic acid of 560. The sulfonic acid solution is stirred and neutralized with gaseous ammonia. This is followed by the addition of 53 mL of methanol and 69.5 g of commercial grade calcium hydroxide with continuous mixing. The mixture is heated to reflux and carbon dioxide is added at a rate of about 0.29 g/min below the surface of the stirred mixture for about 89 minutes. During the carbonation, overheads are removed and fresh dry hexane and methanol are added back to the reaction mass. The details of this addition scheme, conducted at a constant temperature of 125° F., are as follows:

| | Overhead Removed | | Process Aids Added | |
|---|---|---|---|---|
| Time, min. | Hydrocarbon Layer, mL | $MeOH/H_2O$ Layer, mL | Hexane mL | Methanol mL |
| 0 | — | — | — | — |
| 10 | 17.0 | 7.0 | — | — |
| 24 | 32.0 | 12.0 | — | — |
| 49 | 16.0 | 5.0 | 30.6 | 15.8 |
| 58 | 16.5 | 4.5 | — | — |
| 65 | — | — | 27.0 | 13.0 |
| 72 | 18.0 | 5.0 | — | — |
| 81 | 14.0 | 3.5 | 26.5 | 13.0 |
| 89 | 18.6 | 6.5 | — | — |

Most of the hexane, methanol, and water are then removed by heating the mixture to 280° F. The crude product is diluted to 600 mL with fresh hexane and then clarified by centrifugation and polish filtration. The solvents are then removed yielding a clear, oily liquid, namely, calcium sulfonate, which should have a TBN of approximately 350.

EXAMPLE A-4

Into a 1-liter flask fitted with mechanical stirrer, thermometer, condensor and course cylindrical dispersion tube are charged 75 g of mineral oil diluent, 146 g of VM and P naphtha, and 268 g of dilute sulfonic acid comprising 47 g of an essentially linear alkyl benzene sulfonic acid of approximately 500 molecular weight. To this acid solution is added 32 g of magnesium oxide, followed by reaction promoters composed of 8.3 g of water, 8.3 g of methanol, 2.1 g of a distilled naphthenic acid (0.09 moles per mole of sulfonic acid), and 0.4 g of salicylic acid (0.03 moles per mole of sulfonic acid). This mixture is stirred vigorously and heated to 135° F, whereupon carbon dioxide is bubbled slowly into the reaction mass via the dispersion tube. Carbonation is continued for about two hours until the uptake of carbon dioxide is essentially completed. During this time, a further 8.3 g of water is added after 15 minutes of carbonation and an additional 8.3 g of water and 8.3 g of methanol are added after 40 minutes of carbonation. At the end of this time, the crude reaction mass is pressure filtered and the filtrate is heated to 400° F. to remove water, methanol, and naphtha, leaving a clear overbased magnesium sulfonate product which should have a TBN of about 433.

EXAMPLE A-5

The procedure of Example A-4 is repeated except that 0.053 mole of neodecanoic acid per mole of sulfonic acid is used as a promoter in combination with 0.023 mole of salicylic acid per mole of sulfonic acid. The final overbased magnesium sulfonate should have a TBN of approximately 418.

EXAMPLE A-6

(a) Anhydrous benzene (218 parts) is subjected to alkylation with a 25:75 mixture of $C_{16}$ and $C_{18}$ 1-olefins (482 parts) in the presence of dry HCl and anhydrous $AlCl_3$ as catalyst. In this operation the olefin is charged to the benzene-catalyst system dropwise over a 5-hour period while maintaining the temperature at 50° C. The reaction mixture is stirred for 30 minutes and then allowed to settle for 30 minutes. Agitation is resumed and 20 parts of water is added. After standing overnight, the water layer is drawn off and benzene is distilled off with vacuum stripping to 50 mmHg at 150° C. The alkylbenzene product is then filtered.

(b) 450 Parts of oleum is added dropwise to 400 parts of alkylbenzene prepared as in (a). The addition is conducted over a 3-hour period while stirring the reaction mixture and maintaining the temperature at 50°–55° C. The mixture is then stirred for 30 minutes at 50°–55° C. Water (116 parts) is then added over a 2 to 3 hour period while allowing the temperature to rise to 70° C. maximum. Then 254 parts of process oil is rapidly added to the product mixture and the resultant mixture is heated to 70° C., and allowed to settle overnight at room temperature. The Spent acid is drawn off and the alkylbenzene sulfonic acid product mixture is blown with dry air for one hour. A drop or two of silicone oil (Dow-Corning fluid 200) is added, and portionwise addition of 22 parts of calcium carbonate is commenced at a rate insufficient to cause excessive foaming. The mixture is then stirred and blown with air for one hour. The alkylbenzene sulfonic acid product mixture is filtered using filter aid.

(c) To a reaction vessel containing 27.6 parts of process oil, 61.3 parts of calcium oxide (325 mesh), 170 parts of naphtha and 75 parts of methanol are added 6 parts of 28% ammonium hydroxide and 163.3 parts of alkylbenzene sulfonic acid prepared as in (b). The temperature is adjusted to 48°–50° C. and while holding the temperature at 48°–52° C. a flow of carbon dioxide is introduced into the reaction mixture below the surface through a sparger. The rate of agitation is increased to faciltate carbon dioxide uptake in the reaction mixture. The carbonation is continued for approximately 85–90 minutes. The solvents are removed by atmospheric distillation and the product is steamed with dry steam at 150° C. for 15 minutes. A vacuum is applied to 30 mm Hg at 150° C. and held there for 30 minutes. The vacuum is released and the product is filtered while hot. The calcium alkylbenzene sulfonate product should have a TBN of approximately 335 and a calcium content of approximately 13.4%.

The overbased metal detergents utilized as component a) can, if desired, be oil-soluble boronated overbased alkali or alkaline earth metal-containing detergents. Methods for preparing boronated, overbased metal detergents are described, for example, in U.S. Pat. Nos. 3,480,548; 3,679,584; 3,829,381; 3,909,691; 4,965,003; and 4,965,004, all disclosures of which are incorporated herein by reference.

Particularly preferred metal detergents for use as component a) are one or more overbased calcium sulfonates, one or more overbased magnesium sulfonates, and combinations of one or more overbased calcium sulfonates and one or more overbased magnesium sulfonates, in all cases satisfying the TBN requirements set forth hereinabove.

Component b)

The other indispensable additive ingredient of the compositions of this invention is comprised of one or more oil-soluble additive compositions formed by heating (i) at least one boron-free oil-soluble ashless dispersant containing basic nitrogen and/or at least one hydroxyl group, with (ii) at least one inorganic phosphorus acid such that a liquid boron-free phosphorus-containing composition is formed.

The ashless dispersant which is used in the process is preferably a preformed ashless dispersant containing basic nitrogen and/or at least one hydroxyl group. Thus, for example, any suitable boron-free ashless dispersant formed in the customary manner can be heated with one or more inorganic phosphorus acids to cause phosphorylation to occur. The resulting liquid product composition when subjected to chemical analysis reveals the presence of phosphorus.

Rather than utilizing a preformed ashless dispersant containing basic nitrogen and/or at least one hydroxyl group, it is possible to produce component b) by:

1) forming the ashless dispersant in the presence of one or more suitable inorganic phosphorus acids; or
2) heating one or more inorganic phosphorus acids with a basic nitrogen-containing and/or hydroxyl group-containing reactant used in forming the ashless dispersant, and using the resultant phosphorylated reactant to form the ashless dispersant.

In all such cases, the final product composition [component b)] should be a liquid that on analysis reveals the presence of phosphorus. Such product composition should also exhibit dispersant properties. In any case wherein an ashless dispersant used in forming component b) is not a liquid but rather is in whole or in part in the solid state of aggregation at room temperature (e.g., 25° C.), it is preferable to dissolve such dispersant in a suitable solvent or diluent (polar or non-polar, as may be required to dissolve the dispersant) before the dispersant is subjected to phosphorylation in forming component b). In this connection, the phrase "such that a liquid boron-free phosphorus-containing composition is formed" as used herein in connection with such solid state dispersants means that component b), including such solvent or diluent, is in the liquid state of aggregation at room temperature (e.g., 25° C.), even though at a lower temperature the dispersant may revert in whole or in part to the solid state. Of course in any case, component b) must be oil-soluble within the meaning of such term as set forth hereinafter.

Irrespective of the method used in forming component b), in any instance wherein macro (i.e., non-dispersible) solids are formed or remain in the liquid composition after it has been formed, such solids should be removed, and can be readily removed, by any of a variety of conventional separation techniques such as filtration, centrifugation, decantation, or the like.

The actual chemical structures of the final product compositions used as component b) in the practice of this invention, however prepared, are not known with absolute certainty. While it is believed that phosphorus-containing moieties are chemically bonded to the ashless dispersant, it is possible that component b) is in whole or in part a micellar structure containing phosphorus-containing species or moieties. Thus, this invention is not limited to, and should not be construed as being limited to, any specific structural configurations with respect to component b). As noted above, all that is required is that component b) is a liquid that is oil soluble and that if subjected ed to analysis reveals the presence of phosphorus. In addition, component b) should possess dispersant properties.

Although any of a variety of standard methods can be used to analyze the phosphorylated dispersant for the presence of phosphorus therein, it is desirable to use the analytical procedure set forth in ASTM D-4951. In this procedure it is convenient to use a Perkin-Elmer Plasma 40 Emission Spectrometer. The analyzing wavelength for acceptable measurements for phosphorus is 213.618 nm.

It is to be understood and appreciated that component b) may contain chemical species and/or moieties besides the phosphorus-containing species or moieties such as, for example, nitrogen- and/or oxygen- and/or sulfur-containing species or moieties over and above the basic nitrogen and/or hydroxyl group(s) forming an essential part of the initial ashless dispersant itself. The only qualification to the foregoing is that component b) is itself boron-free. It is also to be understood and appreciated that organic phosphorus-containing compounds may be used along with inorganic phosphorus acids in making component b). Further, the inorganic phosphorus acid or acids can be formed in situ, as, for example, by heating a mixture of an inorganic phosphorus oxide and water to form a phosphorus acid.

As used herein, the term "phosphorylated" means that the ashless dispersant has been heated with one or more inorganic phosphorus acids such that the resultant product, on analysis, reveals the presence of phosphorus. As noted hereinabove, the precise chemical makeup of the phosphorylated dispersant compositions is not known with absolute certainty. Thus the term "phosphorylated" is not to be construed as requiring that the resultant composition contain chemically bound phosphorus. While it is believed that chemical reactions do occur to produce a composition containing at least some chemically bound phosphorus moieties, moieties or species of phosphorus conceivably could be present, at least in part, in the form of micellar structures.

Any of a variety of ashless dispersants can be utilized in forming component b) of the compositions of this invention. These include the following types:

Type A—Carboxylic Ashless Dispersants.

These are reaction products of an acylating agent such as a monocarboxylic acid, dicarboxylic acid, polycarboxylic acid, or derivatives thereof which contain amine groups and/or hydroxyl groups (and optionally, other groups). These products, herein referred to as carboxylic ashless dispersants, are described in many patents, including British patent specification No. 1,306,529 and the following U.S. Patents which are incorporated herein by reference: U.S. Pat. Nos. 3,163,603; 3,184,474; 3,215,707; 3,219,666; 3,271,310; 3,272,746; 3,281,357; 3,306,908; 3,311,558; 3,316,177; 3,340,281; 3,341,542; 3,346,493; 3,381,022; 3,399,141; 3,415,750; 3,433,744; 3,444,170; 3,448,048; 3,448,049; 3,451,933; 3,454,607; 3,467,668; 3,522,179; 3,541,012; 3,542,678; 3,574,101; 3,576,743; 3,630,904; 3,632,510; 3,632,511; 3,697,428; 3,725,441; 3,868,330; 3,948,800; 4,234,435; and U.S. Pat. No. Re. 26,433.

There are a number of sub-categories of carboxylic ashless dispersants. One such sub-category which constitutes a preferred type for use in the formation of component b) is composed of the polyamine succinamides and more preferably the polyamine succinimides in which the succinic group contains a hydrocarbyl substituent containing at least 30 carbon atoms. The polyamine used in forming such compounds contains at least one primary amino group capable of forming an imide group on reaction with a hydrocarbon-substituted succinic acid or acid derivative thereof such an anhydride, lower alkyl ester, acid halide, or acid-ester. Representative examples of such dispersants are given in U.S. Pat. Nos. 3,172,892; 3,202,678; 3,216,936; 3,219,666; 3,254,025; 3,272,746; and 4,234,435, the disclosures of which are incorporated herein by reference. The alkenyl succinimides may be formed by conventional methods such as by heating an alkenyl succinic anhydride, acid, acid-ester, acid halide, or lower alkyl ester with a polyamine containing at least one primary amino group. The alkenyl succinic anhydride may be made readily by heating a mixture of olefin and maleic anhydride to about 180°–220° C. The olefin is preferably a polymer or copolymer polymer of a lower monoolefin such as ethylene, propylene, 1-butene, isobutene and the like. The more preferred source of alkenyl group is from polyisobutene having a number average molecular weight of up to 100,000 or higher. In a still more preferred embodiment the alkenyl group is a polyisobutenyl group having a number average molecular weight (determined using the method described in detail hereinafter) of about 500–5,000, and preferably about 700–2,500, more preferably about 700–1,400, and especially 800–1,200. The isobutene used in making the polyisobutene butene is usually (but not necessarily) a mixture of isobutene and other $C_4$ isomers such as 1-butene. Thus, strictly speaking, the acylating agent formed from maleic anhydride and "polyisobutene" made from such mixtures of isobutene and other $C_4$ isomers such as 1-butene, can be termed a "polybutenyl succinic anhydride" and a succinimide made therewith can be termed a "polybutenyl succinimide". However, it is common to refer to such substances as "polyisobutenyl succinic anhydride" and "polyisobutenyl succinimide", respectively. As used herein "polyisobutenyl" is used to denote the alkenyl moiety whether made from a highly pure isobutene or a more impure mixture of isobutene and other $C_4$ isomers such as 1-butene.

Polyamines which may be employed in forming the ashless dispersant include any that have at least one primary amino group which can react to form an imide group. A few representative examples include branched-chain alkanes containing two or more primary amino groups such as tetraamino-neopentane, etc.; polyaminoalkanols such as 2-(2-aminoethylamino)-ethanol and 2-[2-(2-aminoethylamino)-ethylamino]-ethanol; heterocyclic compounds containing two or more amino groups at least one of which is a primary amino group such as 1-(β-aminoethyl)-2-imidazolidone, 2-(2-aminoethylamino)-5-nitropyridine, 3-amino-N-ethylpiperidine, 2-(2-aminoethyl)-pyridine, 5-aminoindole, 3-amino-5-mercapto-1,2,4-triazole, and 4-(aminomethyl)-piperidine; and the alkylene polyamines such as propylene diamine, dipropylene triamine, di-(1,2-butylene)triamine, N-(2-aminoethyl)-1,3-propanediamine, hexamethylenediamine and tetra-(1,2-propylene)pentamine.

The most preferred amines are the ethylene polyamines which can be depicted by the formula $$H_2N(CH_2CH_2NH)_nH$$

wherein n is an integer from one to about ten. These include: ethylene diamine, diethylene triamine, triethylene tetramine, tetraethylene pentamine, pentaethylene hexamine, and the like, including mixtures thereof in which case n is the average value of the mixture. These ethylene polyamines have a primary amine group at each end and thus can form mono-alkenylsuccinimides and bis-alkenylsuccinimides. Commercially available ethylene polyamine mixtures usually contain minor amounts of branched species and cyclic species such as N-aminoethyl piperazine, N,N'-bis(aminoethyl)piperazine, N,N'-bis(piperazinyl)ethane, and like compounds. The preferred commercial mixtures have approximate overall compositions falling in the range corresponding to diethylene triamine to pentaethylene hexamine, mixtures generally corresponding in overall makeup to tetraethylene pentamine being most preferred. Methods for the production of polyalkylene polyamines are known and reported in the literature. See for example U.S. Pat. No. 4,827,037 and references cited therein, all disclosures of such patent and cited references being incorporated herein by reference.

Thus especially preferred ashless dispersants for use in the present invention are the products of reaction of a polyethylene polyamine, e.g. triethylene tetramine or tetraethylene pentamine, with a hydrocarbon-substituted carboxylic acid or anhydride (or other suitable acid derivative) made by reaction of a polyolefin, preferably polyisobutene, having a number average molecular weight of 500 to 5,000, preferably 700 to 2,500, more preferably 700 to 1,400 and especially 800 to 1,200, with an unsaturated polycarboxylic acid or anhydride, e.g., maleic anhydride, maleic acid, fumaric acid, or the like, including mixtures of two or more such substances.

As used herein the term "succinimide" is meant to encompass the completed reaction product from reaction between the amine reactant(s) and the hydrocarbon-substituted carboxylic acid or anhydride (or like acid derivative) reactant (s), and is intended to encompass compounds wherein the product may have amide, amidine, and/or salt linkages in addition to the imide linkage of the type that results from the reaction of a primary amino group and an anhydride moiety.

Residual unsaturation in the alkenyl group of the alkenyl succinimide may be used as a reaction site, if desired. For example the alkenyl substituent may be hydrogenated to form an alkyl substituent. Similarly the olefinic bond(s) in the alkenyl substituent may be sulfurized, halogenated, hydrohalogenated or the like. Ordinarily, there is little to be gained by use of such techniques, and thus the use of alkenyl succinimides as the precursor of component b) is preferred.

Another sub-category of carboxylic ashless dispersants which can be used in forming component b) includes alkenyl succinic acid esters and diesters of alcohols containing 1–20 carbon atoms and 1–6 hydroxyl groups. Representative examples are described in U.S. Pat. Nos. 3,331,776; 3,381,022; and 3,522,179, the disclosures of which are incorporated herein by reference. The alkenyl succinic portion of these esters corresponds to the alkenyl succinic portion of the succinimides described above including the same preferred and most preferred subgenus, e.g., alkenyl succinic acids and anhydrides, etc., where the alkenyl group contains at least 30 carbon atoms and notably, polyisobutenyl succinic acids and anhydrides wherein the polyisobutenyl group has a number average molecular weight of 500 to 5,000, preferably 700 to 2,500, more preferably 700 to 1,400, and especially 800 to 1,200. As in the case of the succinimides, the alkenyl group can be hydrogenated or subjected to other reactions involving olefinic double bonds.

Alcohols useful in preparing the esters include methanol, ethanol, 2-methylpropanol, octadecanol, eicosanol, ethylene glycol, diethylene glycol, tetraethylene glycol, diethylene glycol monoethylether, propylene glycol, tripropylene glycol, glycerol, sorbitol, 1,1,1-trimethylol ethane, 1,1,1-trimethylol propane, 1,1,1-trimethylol butane, pentaerythritol, dipentaerythritol, and the like.

The succinic esters are readily made by merely heating a mixture of alkenyl succinic acid, anhydride or lower alkyl (e.g., $C_1$–$C_4$) ester with the alcohol while distilling out water or lower alkanol. In the case of acid-esters less alcohol is used. In fact, acid-esters made from alkenyl succinic anhydrides do not evolve water. In another method the alkenyl succinic acid or anhydrides can be merely reacted with an appropriate alkylene oxide such as ethylene oxide, propylene oxide, and the like, including mixtures thereof.

Still another sub-category of carboxylic ashless dispersants useful in forming component b) comprises an alkenyl succinic ester-amide mixture. These may be made by heating the above-described alkenyl succinic acids, anhydrides or lower alkyl esters or etc. with an alcohol and an amine either sequentially or in a mixture. The alcohols and amines described above are also useful in this embodiment. Alternatively, amino alcohols can be used alone or with the alcohol and/or amine to form the ester-amide mixtures. The amino alcohol can contain 1–20 carbon atoms, 1–6 hydroxy groups and 1–4 amine nitrogen atoms. Examples are ethanolamine, diethanolamine, N-ethanol-diethylene triamine, and trimethylol aminomethane.

Here again, the alkenyl group of the succinic ester-amide can be hydrogenated or subjected to other reactions involving olefinic double bonds.

Representative examples of suitable ester-amide mixtures are described in U.S. Pat. Nos. 3,184,474; 3,576,743; 3,632,511; 3,804,763; 3,836,471; 3,862,981; 3,936,480; 3,948,800; 3,950,341; 3,957,854; 3,957,855; 3,991,098; 4,071,548; and 4,173,540, the disclosures of which are incorporated herein by reference.

Yet another sub-category of carboxylic ashless dispersants useful in forming component b) comprises the Mannich-based derivatives of hydroxyaryl succinimides. Such compounds can be made by reacting a polyalkenyl succinic anhydride with an aminophenol phenol to produce an N-(hydroxyaryl) hydrocarbyl succinimide which is then reacted with an alkylene diamine or polyalkylene polyamine and an aldehyde (e.g., formaldehyde), in a Mannich-based reaction. Details of such synthesis are set forth in U.S. Pat. No. 4,354,950, the disclosure of which is incorporated herein by reference. As in the case of the other carboxylic ashless dispersants discussed above, the alkenyl succinic anhydride or like acylating agent is derived from a polyolefin, preferably a polyisobutene, having a number average molecular weight of 500 to 5,000, preferably 700 to 2,500, more preferably 700 to 1,400, and especially 800 to 1,200. Likewise, residual unsaturation in the polyalkenyl substituent group can be used as a reaction site as for example, by hydrogenation, sulfurization, or the like.

Type B—Hydrocarbyl Polyamine Dispersants.

This category of ashless dispersants which can be used in forming component b) is likewise well known to those skilled in the art and fully described in the literature. The hydrocarbyl polyamine dispersants are generally produced by reacting an aliphatic or alicyclic halide (or mixture thereof) containing an average of at least about 40 carbon atoms with one or more amines, preferably polyalkylene polyamines. Examples of such hydrocarbyl polyamine ashless dispersants are described in U.S. Pat. Nos. 3,275,554; 3,438,757; 3,454,555; 3,565,804; 3,671,511; 3,821,302; 3,394,576; and in European Patent Publication No. 382,405, all disclosures of which are incorporated herein by reference.

In general, the hydrocarbyl-substituted polyamines are high molecular weight hydrocarbyl-N-substituted polyamines containing basic nitrogen in the molecule. The hydrocarbyl group typically has a number average molecular weight in the range of about 750–10,000, more usually in the range of about 1,000–5,000.

The hydrocarbyl radical may be aliphatic or alicyclic and, except for adventitious amounts of aromatic components in petroleum mineral oils, will be free of aromatic unsaturation. The hydrocarbyl groups will normally be branched-chain aliphatic, having 0–2 sites of unsaturation, and preferably from 0–1 site of ethylene unsaturation. The hydrocarbyl groups are preferably derived from petroleum mineral oil, or polyolefins, either homopolymers or higher-order polymers, or 1-olefins of from 2–6 carbon atoms. Ethylene is preferably copolymerized with a higher olefin to insure oil solubility.

Illustrative polymers include polypropylene, polyisobutylene, poly-1-butene, etc. The polyolefin group will normally have at least one branch per six carbon atoms along the chain, preferably at least one branch per four carbon atoms along the chain. These branched-chain hydrocarbons are readily prepared by the polymerization of olefins of from 3–6 carbon atoms and preferably from olefins of from 3–4 carbon atoms.

In preparing the hydrocarbyl polyamine dispersants, rarely will a single compound having a defined structure be employed. With both polymers and petroleum-derived hydrocarbon groups, the composition is a mixture of materials having various structures and molecular weights.

Therefore, in referring to molecular weight, number average molecular weights are intended. Furthermore, when speaking of a particular hydrocarbon group, it is intended that the group include the mixture that is normally contained within materials which are commercially available. For example, polyisobutylene is known to have a range of molecular weights and may include small amounts of very high molecular weight materials.

Particularly preferred hydrocarbyl-substituted amines or polyamines are prepared from polyisobutenyl chloride.

The polyamine employed to prepare the hydrocarbyl-substituted polyamine is preferably a polyamine having from 2 to about 12 amine nitrogen atoms and from 2 to about 40 carbon atoms. The polyamine is reacted with a hydrocarbyl halide (e.g., chloride) to produce the hydrocarbyl-substituted polyamine. The polyamine preferably has a carbon-to-nitrogen ratio of from about 1:1 to about 10:1.

The amine portion of the hydrocarbyl-substituted amine may be substituted with substituents selected from (A) hydrogen, and (B) hydrocarbyl groups of from about 1 to about 10 carbon atoms.

The polyamine portion of the hydrocarbyl-substituted polyamine may be substituted with substituents selected from (A) hydrogen, (B) hydrocarbyl groups of from 1 to about 10 carbon atoms, (C) acyl groups of from 2 to about 10 carbon atoms, and (D) monoketo, monohydroxy, mononitro, monocyano, lower alkyl and lower alkoxy derivatives of (B) and (C). "Lower" as used in terms like lower alkyl or lower alkoxy, means a group containing from 1 to about 6 carbon atoms.

At least one of the nitrogens in the hydrocarbyl-substituted amine or polyamine is a basic nitrogen atom, i.e., one titratable by a strong acid.

Hydrocarbyl, as used in describing the substituents in the amine or polyamine used in forming the dispersants, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The hydrocarbyl substituted polyamines used in forming the dispersants are generally, but not necessarily, N-substituted polyamines. Exemplary hydrocarbyl groups and substituted hydrocarbyl groups which may be present in the amine portion of the dispersant include alkyls such as methyl, ethyl, propyl, butyl, isobutyl, pentyl, hexyl, octyl, etc., alkenyls such as propenyl, isobutenyl, hexenyl, octenyl, etc., hydroxyalkyls, such as 2-hydroxyethyl, 3-hydroxypropyl, hydroxyisopropyl, 4-hydroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, 2-(2-ethoxyethoxy)ethyl, 2-(2-(2-ethoxyethoxy)ethoxy)ethyl, 3,6,9,12-tetraoxytetradecyl, 2-(2-ethoxyethoxy)hexyl, etc.

Typical amines useful in preparing the hydrocarbyl-substituted amines include methylamine, dimethylamine, ethylamine, diethylamine, n-propylamine, di-n-propylamine, etc. Such amines are either commercially available or are prepared by art recognized procedures.

The polyamine component may also contain heterocyclic polyamines, heterocyclic substituted amines and substituted heterocyclic compounds, wherein the heterocyclic comprises one more 5–6 membered rings containing oxygen and/or nitrogen. Such heterocyclics may be saturated or unsaturated and substituted with groups selected from the aforementioned (A), (B), (C), and (D). The heterocyclics are exemplified by piperazines, such as 2-methylpiperazine, 1,2-bis(N-piperazinyl-ethane), and N,N'-bis(N-piperazinyl) piperazine, 2-methylimidazoline, 3-aminopiperidine, 2-aminopyridine, 2-(β-aminoethyl)-3-pyrroline, 3-aminopyrrolidine, N-(3-aminopropyl)morpholine, etc. Among the heterocyclic compounds, the piperazines are preferred.

Typical polyamines that can be used to form the hydrocarbyl polyamine dispersants include the following: ethylene diamine, 1,2-propylene diamine, 1,3-propylene diamine, diethylene triamine, triethylene tetramine, hexamethylene diamine, tetraethylene pentamine, methylaminopropylene diamine, N-(β-aminoethyl)piperazine, N,N'-di(β-aminoethyl)piperazine, N,N'-di(β-aminoethyl) imidazolidone-2, N-(β-cyanoethyl)ethane-1,2-diamine, 1,3,6,9-tetraaminooctadecane, 1,3,6-triamino-9-oxadecane, N-methyl-1,2-propanediamine, 2-(2-aminoethylamino) ethanol, and the like.

Another group of suitable polyamines are the polyalkylene amines in which the alkylene groups differ in carbon content, such as for example bis(aminopropyl) ethylenediamine. Such compounds are prepared by the reaction of acrylonitrile with an ethyleneamine, for example, an ethyleneamine having the formula $H_2H(CH_2CH_2NH)_nH$ wherein n is an integer from 1 to 5, followed by hydrogenation of the resultant intermediate. Thus, the product prepared from ethylene diamine and acrylonitrile has the formula $H_2N(CH_2)_3NH(CH_2)_2NH(CH_2)_3NH_2$.

In many instances the polyamine used as a reactant in the production of the hydrocarbyl-substituted polyamine is not a single compound but a mixture in which one or several compounds predominate with the average composition indicated. For example, tetraethylene pentamine prepared by the polymerization of aziridine or the reaction of 1,2-dichloroethane and ammonia will have both lower and higher amine members, e.g., triethylene tetramine, substituted piperazines and pentaethylene hexamine, but the composition will be largely tetraethylene pentamine and the empirical formula of the total amine composition will closely approximate that of tetraethylene pentamine. Finally, in preparing the hydrocarbyl-substituted polyamines for use in this invention, where the various nitrogen atoms of the polyamine are not geometrically equivalent, several substitutional isomers are possible and are encompassed with the final product. Methods of preparation of polyamines and their reactions are detailed in Sidgewick, *The Organic Chemistry of Nitrogen*, Clarendon Press, Oxford, 1966; Noller, *Chemistry of Organic Compounds*, Saunders Philadelphia, 2nd Ed., 1957; and Kirk-Othmer, *Encyclopedia of Chemical Technology*, 2nd Edition, especially volume 2, pp. 99–116.

The preferred hydrocarbyl-substituted polyalkylene polyamines for use in forming component b) may be represented by the formula $$R_1NH—(—R_2—NH—)_e—H$$

wherein $R_1$ is hydrocarbyl having an average molecular weight of from about 750 to about 10,000; $R_2$ is alkylene of from 2 to 6 carbon atoms; and e is an integer of from 0 to about 10.

Preferably, $R_1$ is hydrocarbyl having an average molecular weight of from about 1,000 to about 10,000. Preferably, $R_2$ is alkylene of from 2 to 3 carbon atoms and e is preferably an integer of from 1 to 6.

Type C—Mannich polyamine dispersants.

This category of ashless dispersant which can be utilized in the formation of component b) is comprised of reaction products of an alkyl phenol, with one or more aliphatic aldehydes containing from 1 to about 7 carbon atoms (especially formaldehyde and derivatives thereof), and polyamines (especially polyalkylene polyamines of the type described hereinabove). Examples of these Mannich polyamine dispersants are described in the following U.S. Patents, the disclosures of which are incorporated herein by reference: U.S. Pat. Nos. 2,459,112; 2,962,442; 2,984,550; 3,036,003; 3,166,516; 3,236,770; 3,368,972; 3,413,347; 3,442,808; 3,448,047; 3,454,497; 3,459,661; 3,493,520; 3,539,633; 3,558,743; 3,586,629; 3,591,598; 3,600,372; 3,634,515; 3,649,229; 3,697,574; 3,703,536; 3,704,308; 3,725,277; 3,725,480; 3,726,882; 3,736,357; 3,751,365; 3,756,953; 3,793,202; 3,798,165; 3,798,247; 3,803,039; 3,872,019; 3,980,569; and 4,011,380.

The polyamine group of the Mannich polyamine dispersants is derived from polyamine compounds characterized by containing a group of the structure —NH— wherein the two remaining valances of the nitrogen are satisfied by hydrogen, amino, or organic radicals bonded to said nitrogen atom. These compounds include aliphatic, aromatic, heterocyclic and carbocyclic polyamines. The source of the oil-soluble hydrocarbyl group in the Mannich polyamine dispersant is a hydrocarbyl-substituted hydroxy aromatic compound comprising the reaction product of a hydroxy aromatic compound, according to well known procedures, with a hydrocarbyl donating agent or hydrocarbon source. The hydrocarbyl substituent provides substantial oil solubility to the hydroxy aromatic compound and, preferably, is substantially aliphatic in character. Commonly, the hydrocarbyl substituent is derived from a polyolefin having at least about 40 carbon atoms. The hydrocarbon carbon source should be substantially free from pendant groups which render the hydrocarbyl group oil insoluble. Examples of acceptable substituent groups are halide, hydroxy, ether, carboxy, ester, amide, nitro and cyano. However, these substituent groups preferably comprise no more than about 10 weight percent of the hydrocarbon source.

The preferred hydrocarbon sources for preparation of the Mannich polyamine dispersants are those derived from substantially saturated petroleum fractions and olefin polymers, preferably polymers of mono-olefins having from 2 to about 30 carbon atoms. The hydrocarbon course can be derived, for example, from polymers of olefins such as ethylene, propene, 1-butene, isobutene, 1-octene, 1-methylcyclohexene, 2-butene and 3-pentene. Also useful are copolymers of such olefins with other polymerizable olefinic substances such as styrene. In general, these copolymers should contain at least 80 percent and preferably about 95 percent, on a weight basis, of units derived from the aliphatic mono-olefins to preserve oil solubility. The hydrocarbon source generally contains at least about 40 and preferably at least about 50 carbon atoms to provide substantial oil solubility to the dispersant. The olefin polymers having a number average molecular weight between about 600 and 5,000 are preferred for reasons of easy reactivity and low cost. However, polymers of higher molecular weight can also be used. Especially suitable hydrocarbon sources are isobutylene polymers.

The Mannich polyamine dispersants are generally prepared by reacting a hydrocarbyl-substituted hydroxy aromatic compound with an aldehyde and a polyamine. Typically, the substituted hydroxy aromatic compound is contacted with from about 0.1 to about 10 moles of polyamine and about 0.1 to about 10 moles of aldehyde per mole of substituted hydroxy aromatic compound. The reactants are mixed and heated to a temperature above about 80° C. to initiate the reaction. Preferably, the reaction is carried out at a temperature from about 100° to about 250° C. The resulting Mannich product has a predominantly benzylamine linkage between the aromatic compound and the polyamine. The reaction can be carried out in an inert diluent such as mineral oil, benzene, toluene, naphtha, ligroin, or other inert solvents to facilitate control of viscosity, temperature and reaction rate.

Polyamines are preferred for use in preparing the Mannich polyamine dispersants, and suitable polyamines include, but are not limited to, alkylene diamines and polyalkylene polyamines (and mixtures thereof) of the formula:

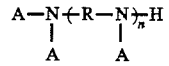

wherein n is an integer from 1 to about 10, R is a divalent hydrocarbyl group of from 1 to about 18 carbon atoms, and each A is independently selected from the group consisting of hydrogen and monovalent aliphatic groups containing up to 10 carbon atoms which can be substituted with one or two hydroxyl groups. Most preferably, R is a lower alkylene group of from 2 to 6 carbon atoms and A is hydrogen.

Suitable polyamines for use in preparation of the Mannich polyamine dispersants include, but are not limited to, methylene polyamines, ethylene polyamines, butylene polyamines, propylene polyamines, pentylene polyamines, hexylene polyamines and heptylene polyamines. The higher homologs of such amines and related aminoalkyl-substituted piperazines are also included. Specific examples of such polyamines include ethylene diamine, triethylene tetramine, tris(2-aminoethyl)amine, propylene diamine, pentamethylene diamine, hexamethylene diamine, heptamethylene diamine, octamethylene diamine, decamethylene diamine, di(heptamethylene) triamine, pentaethylene hexamine, di(trimethylene) triamine, 2-heptyl-3-(2-aminopropyl) imidazoline, 1,3-bis(2-aminoethyl)imidazoline, 1-(2-aminopropyl)piperazine, 1,4-bis(2-aminoethyl)piperazine and 2-methyl-1-(2-aminobutyl)piperazine. Higher homologs, obtained by condensing two or more of the above mentioned amines, are also useful, as are the polyoxyalkylene polyamines.

The polyalkylene polyamines, examples of which are set forth above, are especially useful in preparing the Mannich polyamine dispersants for reasons of cost and effectiveness. Such polyamines are described in detail under the heading "Diamines and Higher Amines" in Kirk-Othmer, *Encyclopedia of Chemical Technology*, Second Edition, Vol. 7, pp. 22–39. They are prepared most conveniently by the reaction of an ethylene imine with a ring-opening reagent such as ammonia. These reactions result in the production of somewhat complex mixtures of polyalkylene polyamines which include cyclic condensation products such as piperazines. Because of their availability, these mixtures are particularly useful in preparing the Mannich polyamine dispersants. However, it will be appreciated that satisfactory dispersants can also be obtained by use of pure polyalkylene polyamines.

Alkylene diamines and polyalkylene polyamines having one or more hydroxyalkyl substituents on the nitrogen atom are also useful in preparing the Mannich polyamine dispersants. These materials are typically obtained by reaction of the corresponding polyamine with an epoxide such as ethylene oxide or propylene oxide. Preferred hydroxyalkyl-substituted diamines and polyamines are those in which the hydroxyalkyl groups have less than about 10 carbon atoms. Examples of suitable hydroxyalkyl-substituted diamines and polyamines include, but are not limited to, N-(2-hydroxyethyl)ethylenediamine, N,N'-bis(2-hydroxyethyl) ethylenediamine, mono(hydroxypropyl)diethlenetriamine, (di(hydroxypropyl)tetraethylenepentamine and N-(3-hydroxybutyl)tetramethylenediamine. Higher homologs obtained by condensation of the above mentioned hydroxyalkyl-substituted diamines and polyamines through amine groups or through ether groups are also useful.

Any conventional formaldehyde yielding reagent is useful for the preparation of the Mannich polyamine dispersants. Examples of such formaldehyde yielding reagents are trioxane, paraformaldehyde, trioxymethylene, aqueous formalin and gaseous formaldehyde.

Type D—polymeric polyamine dispersants.

Also suitable for preparing component b) of the compositions of this invention are polymers containing basic amine groups and oil solubilizing groups (for example, pendant alkyl groups having at least about carbon atoms). Such polymeric dispersants are herein referred to as polymeric polyamine dispersants. Such materials include, but are not limited to, interpolymers of decyl methacrylate, vinyl decyl ether or a relatively high molecular weight olefin with aminoalkyl acrylates and aminoalkyl acrylamides. Examples of polymeric polyamine dispersants are set forth in the following patents, the disclosures of which are incorporated herein by reference: U.S. Pat. Nos. 3,316,177; 3,326,804; 3,329,658; 3,449,250; 3,493,520; 3,519,565; 3,666,730; 3,687,849; 3,702,300; 4,089,794; 4,632,769.

Type E—Post-treated basic nitrogen-containing and/or hydroxyl-containing ashless dispersants.

As is well known in the art, any of the ashless dispersants referred to above as types A=14 D can be subjected to post-treatment with one or more suitable reagents such as urea, thiourea, carbon disulfide, aldehydes, ketones, carboxylic acids, anhydrides of low molecular weight dibasic acids, nitriles, epoxides, and the like. Such post-treated treated ashless dispersants can be used in forming component b) of the compositions of this invention provided that the post-treated dispersant is boron-free and contains residual basic nitrogen and/or one or more residual hydroxyl groups. Alternatively, the phosphorylated dispersant can be subjected to post-treatment with such reagents. Examples of post-treatment proceduress and post-treated ashless dispersants are set forth in the following U.S. Patents, the disclosures of which are incorporated herein by reference: U.S. Pat. Nos. 3,036,003; 3,200,107; 3,216,936; 3,256,185; 3,278,550; 3,312,619; 3,366,569; 3,367,943; 3,373,111; 3,403,102; 3,442,808; 3,455,831; 3,455,832; 3,493,520; 3,502,677; 3,513,093; 3,573,010; 3,579,450; 3,591,598; 3,600,372; 3,639,242; 3,649,229; 3,649,659; 3,702,757; and 3,708,522; and 4,971,598.

Mannich-based derivatives of hydroxyaryl succinimides that have been post-treated with $C_5$–$C_9$ lactones such as ε-caprolactone and optionally with other post-treating agents (except boronating agents) as described for example in U.S. Pat. No. 4,971,711 can also be utilized in forming component b) for use in the practice of this invention, provided that such post-treated Mannich-based derivatives of hydroxyaryl succinimides contain basic nitrogen, and/or at least one hydroxyl group. The disclosures of U.S. Pat. No. 4,971,711, as well as related U.S. Pat. Nos. 4,820,432; 4,828,742; 4,866,135; 4,866,139; 4,866,140; 4,866,141; 4,866,142; 4,906,394; and 4,913,830 are incorporated herein by reference as regards additional suitable boron-free basic nitrogen-containing and/or hydroxyl group-containing ashless dispersants which may be utilized in forming component b).

One preferred category of post-treated ashless dispersants is comprised of basic nitrogen-containing and/or hydroxyl group-containing ashless dispersants which have been heated with a phosphorus compound such that they contain phosphorus with the proviso that such post-treated products contain residual basic nitrogen and/or one or more residual hydroxyl groups. Numerous examples of such dispersants and methods for their production are described in U.S. Pat. Nos. 3,184,411; 3,185,645; 3,235,497; 3,265,618; 3,324,032; 3,325,567; 3,403,102; 3,502,677; 3,513,093; 3,511,780; 3,623,985; 3,865,740; 3,950,341; 3,991,056; 4,097,389.; 4,234,435; 4,338,205; 4,428,849; 4,615,826; 4,648,980; 4,747,971; and 4,873,004. The foregoing patents are incorporated herein by reference. The phosphorus-containing post-treated ashless dispersants of the prior art type can be converted into a material suitable for use as component b) simply by conducting a phosphorylation in the manner described herein, whereby additional phosphorus from the inorganic phosphorylating agent of the type used herein is incorporated into a prior art type post-treated phosphorus-containing ashless dispersant.

It is also possible after using the phosphorylation procedures described herein to post-treat the phosphorylated ashless dispersant using any prior art-type post-treating procedure (except boronation), again provided that the resultant post-treated ashless dispersant is boron-free and contains at least some residual dual basic nitrogen and/or at least some residual hydroxyl substitution.

The ashless dispersant(s) used in forming component b) can be any mixture containing any two or more ashless dispersants containing basic nitrogen and/or at least one hydroxyl group. Thus, for example, with reference to dispersants of the above types A, B, C, D and E, use can be made of such mixtures as:

(1) Two or more different type A dispersants;

(2) Two or more different type B dispersants;

(3) Two or more different type C dispersants;

(4) Two or more different type D dispersants;

(5) Two or more different type E dispersants;

(6) One or more type A dispersants with one or more type B dispersants;

(7) One or more type A dispersants with one or more type C dispersants;

(8) One or more type A dispersants with one or more type D dispersants;

(9) One or more type A dispersants with one or more type E dispersants;

(10) One or more type B dispersants with one or more type C dispersants;

(11) One or more type B dispersants with one or more type D dispersants;

(12) One or more type B dispersants with one or more type E dispersants;

(13) One or more type C dispersants with one or more type D dispersants;

(14) One or more type C dispersants with one or more type E dispersants;

(15) One or more type D dispersants with one or more type E dispersants;

(16) One or more type A dispersants with one or more type B dispersants and with one or more type C dispersants;

(17) One or more type A dispersants with one or more type B dispersants and with one or more type D dispersants;

(18) One or more type A dispersants with one or more type B dispersants and with one or more type E dispersants;

(19) One or more type A dispersants with one or more type C dispersants and with one or more type D dispersants;

(20) One or more type A dispersants with one or more type C dispersants and with one or more type E dispersants;

(21) One or more type A dispersants with one or more type D dispersants and with one or more type E dispersants;

(22) One or more type B dispersants with one or more type C dispersants and with one or more type D dispersants;

(23) One or more type B dispersants with one or more type C dispersants and with one or more type E dispersants;

(24) One or more type B dispersants with one or more type D dispersants and with one or more type E dispersants;

(25) One or more type C dispersants with one or more type D dispersants and with one or more type E dispersants;

(26) One or more type A dispersants with one or more type B dispersants, with one or more type C dispersants, and with one or more type D dispersants;

(27) One or more type A dispersants with one or more type B dispersants, with one or more type C dispersants, and with one or more type E dispersants;

(28) One or more type A dispersants with one or more type C dispersants, with one or more type D dispersants, and with one or more type E dispersants;

(29) One or more type B dispersants with one or more type C dispersants, with one or more type D dispersants, and with one or more type E dispersants; and

(30) One or more type A dispersants with one or more type B dispersants, with one or more type C dispersants, with one or more type D dispersants, and with one or more type E dispersants.

It will also be understood that any given type of dispersant whether used with one or more other dispersant types or without any other dispersant type can comprise:

(I) A mixture in which at least one component contains basic nitrogen but no hydroxyl group and another component of the mixture contains at least one hydroxyl group but no basic nitrogen;

(II) A mixture in which at least one component contains basic nitrogen but no hydroxyl group and another component of the mixture contains basic nitrogen and at least one hydroxyl group;

(III) A mixture in which at least one component contains at least one hydroxyl group but no basic nitrogen and another component of the mixture contains basic nitrogen and at least one hydroxyl group; and (IV) A mixture in which at least one component contains basic nitrogen but no hydroxyl group, another component of the mixture contains at least one hydroxyl group but no basic nitrogen, and still another component of the mixture contains basic nitrogen and at least one hydroxyl group.

Because of environmental and conservational concerns it is desirable to employ ashless dispersants which contain little, if any, halogen atoms such as chlorine atoms. Thus, in order to satisfy such concerns, it is desirable (although in many cases not necessary from a performance standpoint) to select ashless dispersants (as well as the other components used in the compositions of this invention) such that the total halogen content, if any, of the overall lubricant or functional fluid composition does not exceed 100 ppm. Indeed, the lower the better. Likewise, it is preferable in accordance with this invention, to provide additive concentrates which, when dissolved in a halogen-free base oil, at a concentration of 10% by weight, yield an oleaginous composition in which the total halogen content, if any, is 100 ppm or less.

Typical procedures for producing the phosphorylated ashless dispersants involve heating one or more ashless dispersants of the types described above with at least one inorganic phosphorus acid under conditions yielding a liquid phosphorus-containing composition. Examples of inorganic phosphorus acids which are useful in forming such products include phosphorous acid ($H_3PO_3$, sometimes depicted as $H_2(HPO_3)$, and sometimes called ortho-phosphorous acid), phosphoric acid ($H_3PO_4$, sometimes called orthophosphoric acid), hypophosphoric acid ($H_4P_2O_6$), metaphosphoric acid ($HPO_3$), pyrophosphoric acid ($H_4P_2O_7$), hypophosphorous acid ($H_3PO_2$, sometimes called phosphinic acid), pyrophosphorous acid ($H_4P_2O_5$, sometimes called pyrophosphonic acid), phosphinous acid ($H_3PO$), tripolyphosphoric acid ($H_5P_3O_{10}$), tetrapolyphosphoric acid ($H_6P_4O_{13}$), trimetaphosphoric acid ($H_3P_3O_9$), phosphoramidic acid ($H_2O_3PNH_2$), phosphoramidous acid ($H_4NO_2P$), and the like. Partial or total sulfur analogs such as phosphorotetrathioic acid ($H_3PS_4$), phosphoromonothioic acid ($H_3PO_3S$), phosphorodithioic acid ($H_3PO_2S_2$), phosphorotrithioic acid ($H_3POS_3$), can also be used in forming products suitable for use as component b) in the practice of this invention. The preferred phosphorus reagent is phosphorous acid, ($H_3PO_9$).

It will be understood and appreciated by those skilled in the art that the form or composition of the inorganic acid(s) as charged into the mixture to be heated or being heated may be altered in situ. For example, the action of heat and/or water can transform certain inorganic phosphorus compounds into other inorganic phosphorus compounds or species. Any such in situ transformations that may occur are within the purview of this invention provided that the liquid phosphorylated ashless dispersant reveals on analysis the presence therein of phosphorus.

Optionally, additional sources of basic nitrogen can be included in the inorganic phosphorus compound-ashless dispersant mixture so as to provide a molar amount (atomic proportion) of basic nitrogen up to that equal to the molar amount of basic nitrogen contributed by the ashless dispersant. Preferred auxiliary nitrogen compounds are long chain primary, secondary and tertiary alkyl amines containing from about 12 to 24 carbon atoms, including their hydroxyalkyl and aminoalkyl derivatives. The long chain alkyl group may optionally contain one or more ether groups. Examples of suitable compounds are oleyl amine, N-oleyltrimethylene diamine, N-tallow diethanolamine, N,N-dimethyl oleylamine, and myristyloxapropyl amine.

Other materials normally used in lubricant additives which do not interfere with the process may also be added, for example, a benzotriazole, including lower ($C_1$–$C_4$) alkyl-substituted benzotriazoles, which function to protect copper surfaces.

The heating step is conducted at temperatures sufficient to produce a liquid composition which contains phosphorus. The heating can be carried out in the absence of a solvent by heating a mixture of the ashless dispersant and one or more suitable inorganic phosphorus compounds. The temperatures used will vary somewhat depending upon the nature of the ashless dispersant and the inorganic phosphorus reagent being utilized. Generally speaking however, the temperature will usually fall within the range of about 40° to about 200° C. The duration of the heating is likewise susceptible to variation, but ordinarily will fall in the range of about 1 to about 3 hours. When conducting the heating in bulk, it is important to thoroughly agitate the components to insure intimate contact therebetween. When utilizing the preferred phosphorus reagent (solid phosphorous acid), it is convenient to apply heat to the mixture until a clear liquid composition is formed. Alternatively, the phosphorous acid may be utilized in the form of an aqueous solution. Water formed in the process and any added water is preferably removed from the heated mixture by vacuum distillation at temperatures of from about 100° to about 140° C. The heating may be conducted in more than one stage if desired. Preferably the heating step or steps will be conducted in a diluent oil or other inert liquid medium such as light mineral oils, and the like.

The amount of inorganic phosphorus acid employed in the heating process preferably ranges from about 0.001 mole to 0.999 mole per mole of basic nitrogen and free hydroxyl in the mixture being heated, up to one half of which may be contributed by an auxiliary nitrogen compound. It is possible however to use the inorganic phosphorus acid(s) in excess of the amount of basic nitrogen and/or hydroxyl groups in the dispersant being heated.

When used, the amount of diluent usually ranges from about 10 to about 50% by weight of the mixture being subjected to heating. Water can be added to the mixture, before and/or during the heating, if desired.

Usually the phosphorylated dispersants utilized as component b) in the compositions of this invention when in their undiluted state will have on a weight basis a phosphorus content of at least 5,000 parts per million (ppm) (preferably at least 6,000 ppm and more preferably at least 7,000 ppm). When forming component b) in part by use of one or more organic phosphorus compounds such as one or more organic phosphates (e.g., trihydrocarbyl phosphates, dihydrocarbyl monoacid phosphates, monohydrocarbyl diacid phosphates, or mixtures thereof), phosphites (e.g., trihydrocarbyl phosphites, dihydrocarbyl hydrogen phosphites, hydrocarbyl diacid phosphites, or mixtures thereof), phosphonates (e.g., hydrocarbyl phosphonic acids, mono- and/or dihydrocarbyl esters of phosphonic acids, or mixtures thereof), phosphonites (e.g., hydrocarbyl phosphinic acids, mono- and/or dihydrocarbyl esters of phosphinic acids, or mixtures thereof), etc., or the partial or total sulfur analogs thereof, and in part by use of one or more inorganic phosphorus acids, the latter should be used in an amount sufficient to provide at least 25% (preferably at least 50% and more preferably at least 75%) of the total content of phosphorus in the phosphorylated dispersant.

The preparation of phosphorylated ashless dispersants suitable for use as component b) in the compositions of this invention is illustrated by the following examples in which all parts and percentages are by weight unless otherwise clearly specified.

EXAMPLE B-1

A mixture is formed from 260 parts of a polyisobutenyl succinimide ashless dispersant (derived from polybutene having a number average molecular weight of about 950 and a mixture of a polyethylene polyamines having an average overall composition approximating that of tetraethylene pentamine), 100 parts of a 100 Solvent Neutral refined mineral oil diluent, 8 parts of solid phosphorous acid, and 3.5 parts of tolutriazole. The mixture is heated at 110° C. for two hours. A vacuum of 40 mm Hg is gradually drawn on the product to remove traces of water while the temperature is maintained at 110° C. A clear solution or composition is obtained which is soluble in oil and suitable for use as component b).

EXAMPLE B-2

The procedure of Example B-1 is repeated except that the succinimide ashless dispersant used is derived from polybutene having a number average molecular weight of 1,150. The average number of succinic groups per alkenyl group in the succinimide is approximately 1.2.

EXAMPLE B-3

The procedure of Example B-1 is repeated except that the succinimide ashless dispersant used is derived from polybutene having a number average molecular weight of 2,100.

EXAMPLE B-4

The procedure of Example B-1 is repeated except that the succinimide ashless dispersant is replaced by an equal amount of a boron-free Mannich polyamine dispersant made from tetraethylene pentamine, polyisobutenyl phenol (made from polyisobutene having a number average molecular weight of about 1710 and formalin) having a nitrogen content of 1.1%.

EXAMPLE B-5

The procedure of Example B-1 is repeated except that the succinimide ashless dispersant is replaced by an equal amount of an ashless dispersant of the pentaerythritol succinic ester type.

EXAMPLE B-6

The procedure of Example B-1 is repeated except that 9.6 parts of orthophosphoric acid is used in place of the phosphorous acid, and the mixture is heated for three hours at 110° C. to provide a clear, oil-soluble composition suitable for use as component b).

EXAMPLE B-7

The procedure of Example B-1 is repeated except that the phosphorous acid is replaced by 6.4 parts of hypophosphorous acid.

EXAMPLE B-8

The procedures of Examples B-1 through B-7 are repeated except that the tolutriazole is omitted from the initial mixtures subjected to the thermal processes.

EXAMPLE B-9

To 2,500 parts of a polyisobutenyl succinimide (derived from polyisobutene having a number average molecular weight of 950 and a mixture of polyethylene polyamines having an overall average composition approximating that of tetraethylene pentamine) warmed to 28° C. are added 54.31 parts of phosphorous acid, 20.27 parts of tolutriazole and 23.91 parts of water. This mixture is heated at 110° C. for 1.5 hours. Then the reflux condenser is replaced by a distillation column and water is removed under vacuum for 2.25 hours at 110° C. to form a homogeneous liquid composition suitable for use as component b) in the practice of this invention.

EXAMPLE B-10

A mixture of 7300 parts of a polyisobutenyl succinimide (derived from polybutene having a number average molecular weight of about 1,300 and a mixture of polyethylene polyamines having an average overall composition approximating that of tetraethylene pentamine), and 2500 parts of 100 Solvent Neutral mineral oil is heated to 90°–100° C. To this mixture is added 200 parts of phosphorous acid and the resultant mixture is heated at 90°–100° C. for 2 hours. The resultant homogeneous liquid composition is suitable for use as component b) in the practice of this invention.

EXAMPLE B-11

A mixture of 58,415.5 parts of a polyisobutenyl succinimide (derived from polyisobutene having a number average molecular weight of 1300 and a mixture of polyethylene polyamines having an overall average composition approximating that of tetraethylene pentamine), and 12,661.6 parts of 100 Solvent Neutral mineral oil is heated to 80° C. To this mixture is added 1942.28 parts of phosphorous acid and the resultant mixture is heated at 110° C. for 2 hours. The resultant homogeneous liquid composition is suitable for use as component b) in the practice of this invention.

EXAMPLE B-12

The procedure of Example B-11 is repeated using 45,600 parts of the ashless dispersant, 8983.2 parts of the mineral oil diluent, and 2416.8 parts of the phosphorous acid.

EXAMPLE B-13

A mixture of 14,400 parts of a polyisobutenyl succinimide (derived from polyisobutene having a number average molecular weight of 950 and a mixture of polyethylene polyamines having an overall average composition approximating that of tetraethylene pentamine), and 3121.2 parts of 100 Solvent Neutral mineral oil is heated to 80° C. To this mixture is added 478.8 parts of phosphorus acid and the resultant mixture is heated at 110° C. for 2 hours. The resultant homogeneous liquid composition contains about 1.04% of phosphorus and is suitable for use as component b) in the practice of this invention.

EXAMPLE B-14

A mixture of 7300 parts of ashless dispersant as used in Example B-10, 2500 parts of 100 Solvent Neutral mineral oil, and 200 parts of phosphorous acid is formed at room temperature and heated to 110° C. for two hours. The resultant homogeneous liquid composition is suitable for use as component b) in the practice of this invention.

EXAMPLE B-15

A mixture of 4680 parts of phosphorylated dispersant formed as in Example B-14 and 2340 parts of a commercial boronated succinimide ashless dispersant (HiTEC® 648 dispersant; Ethyl. Petroleum Additives, Inc.; Ethyl Petroleum Additives, Ltd.; Ethyl S.A.; Ethyl Canada Ltd.) is formed. The resultant homogeneous liquid composition is suitable for use in the practice of this invention. A portion of the resultant mixture can be heated to 110° C. for two hours, and this resultant homogeneous liquid composition is also suitable for use as component b) in the practice of this invention.

EXAMPLE B-16

(a) A mixture of 1,000 parts (0.495 mole) of polyisobutene ($\overline{M}n$=2020; $\overline{M}w$=6049, both determined using the methodology of U.S. Pat. No. 4,234,435) and 115 parts (1.17 moles) of maleic anhydride is heated to 110° C. This mixture is heated to 184° C. in 6 hours during which 85 parts (1.2 moles) of gaseous chlorine is added beneath the surface. At 184°–189° C., an additional 59 parts (0.83 mole) of chlorine is added over 4 hours. The reaction mixture is stripped by heating at 186°–190° C. with nitrogen purged for 26 hours. The residue is predominately polyisobutenyl succinic anhydride acylating agent.

(b) A mixture is prepared by the addition of 57 parts (1.38 equivalents) of a commercial mixture of ethylene polyamines having the approximate overall composition of tetraethylene pentamine to 1,067 parts of mineral oil and 893 parts (1.38 equivalents) of substituted succinic acylating agent prepared as in (a) while maintaining the temperature at 140°–145° C. The reaction mixture is then heated to 155° C. over a three hour period and stripped by blowing with nitrogen. The reaction mixture is filtered to yield the filtrate as an oil solution of the desired product composed predominately of polyisobutenyl succinimides.

(c) A mixture is formed from 250 parts of the polyisobutenyl succinimide product solution formed as in (b), 8 parts of phosphorous acid, and 3.5 parts of tolutriazole. The mixture is heated at 100° C. for two hours. A clear solution or composition is obtained which is soluble in oil and suitable for use as component b).

EXAMPLE B-17

The procedure of Example B-16 is repeated except that the tolutriazole is eliminated from the reaction mixture of (c).

EXAMPLE B-18

The procedure of Example B-17 is repeated except that the phosphorous acid is replaced by 11.1 parts of phosphoromonothioic acid ($H_3PO_3S$).

EXAMPLE B-19

(a) A mixture of 1,000 parts (0.495 mole) of polyisobutene ($\overline{M}n$=2020; $\overline{M}w$=6049, both determined using the methodology of U.S. Pat. No. 4,234,435) and 115 parts (1.17 moles) of maleic anhydride is heated to 110° C. This mixture is heated to 184° C. in 6 hours during which 85 parts (1.2 moles) of gaseous chlorine is added beneath the surface. At 184°–189° C., an additional 59 parts (0.83 mole) of chlorine is added over 4 hours. The reaction mixture is stripped by heating at 186°–190° C. with nitrogen purged for 26 hours. The residue is predominately polyisobutenyl succinic anhydride acylating agent.

(b) A mixture is prepared by the addition of 18.2 parts (0.433 equivalents) of a commercial mixture of ethylene polyamines having the approximate overall composition of tetraethylene pentamine to 392 parts of mineral oil and 348 parts (0.52 equivalent) of substituted succinic acylating agent prepared as in (a) while maintaining the temperature at 140° C. The reaction mixture is then heated to 150° C. in 1.8 hours and stripped by blowing with nitrogen. The reaction mixture is filtered to yield the filtrate as an oil solution of the desired product composed predominately of polyisobutenyl succinimides.

(c) A mixture is formed from 250 parts of the polyisobutenyl succinimide product solution formed as in (b), 8 parts of phosphorous acid, and 3.5 parts of tolutriazole. The mixture is heated at 100° C. for two hours. A clear solution or composition is obtained which is soluble in oil and suitable for use as component b).

EXAMPLE B-20

The procedure of Example B-19 is repeated except that the tolutriazole is eliminated from the reaction mixture of (c).

EXAMPLE B-21

The procedure of Example B-20 is repeated except that the phosphorous acid is replaced by 13.7 parts of phosphoramidic acid, $(HO)_2PONH_2$.

EXAMPLE B-22

(a) A mixture of 1,000 parts (0.495 mole) of polyisobutene ($\overline{M}n$=2020; $\overline{M}w$=6049, both determined using the methodology of U.S. Pat. No. 4,234,435) and 115 parts (1.17 moles) of maleic anhydride is heated to 110° C. This mixture is heated to 184° C. in 6 hours during which 85 parts (1.2 moles) of gaseous chlorine is added beneath the surface. At 184°–189° C., an additional 59 parts (0.83 mole) of chlorine is added over 4 hours. The reaction mixture is stripped by heating at 186°–190° C. with nitrogen purged for 26 hours. The residue is predominately polyisobutenyl succinic anhydride acylating agent.

(b) A mixture of 334 parts (0.52 equivalents) of the polyisobutene substituted succinic acylating agent prepared as in (a), 548 parts of mineral oil, 30 parts (0.88 equivalent) of pentaerythritol and 8.6 parts (0.0057 equivalent) of Polyglycol 112-2 demulsifier (Dow Chemical Company) is heated at 150° C. for 2.5 hours. The reaction mixture is then heated to 210° C. over a period of 5 hours and then held at 210° C. for an additional 3.2 hours. The reaction mixture is cooled to 190° C. and 8.5 parts (0.2 equivalent) of a commercial mixture of ethylene polyamines having an overall composition approximating that of tetraethylene pentamine is added. The reaction mixture is stripped by heating at 205° C. with nitrogen blowing for 3 hours, and then filtered to yield the filtrate as an oil solution of the desired ashless dispersant product.

(c) A mixture is formed from 300 parts of the ashless dispersant product solution formed as in (b), 8 parts of phosphorous acid, and 3.5 parts of tolutriazole. The mixture is heated at 100° C. for two hours. A clear solution or composition is obtained which is soluble in oil and suitable for use as component b).

EXAMPLE B-23

The procedure of Example B-22 is repeated except that the tolutriazole is eliminated from the reaction mixture of (c).

EXAMPLE B-24

The procedure of Example B-23 is repeated except that the phosphorous acid is replaced by 9.6 parts of orthophosphoric acid.

EXAMPLE B-25

(a) A mixture of 1,000 parts (0.495 mole) of polyisobutene ($\overline{M}n$=2020; $\overline{M}w$=6049, both determined using the methodology of U.S. Pat. No. 4,234,435) and 115 parts (1.17 moles) of maleic anhydride is heated to 110° C. This mixture is heated to 184° C. in 6 hours during which 85 parts (1.2 moles) of gaseous chlorine is added beneath the surface. At 184°–189° C., an additional 59 parts (0.83 mole) of chlorine is added over 4 hours. The reaction mixture is stripped by heating at 186°–190° C. with nitrogen purged for 26 hours. The residue is predominately polyisobutenyl succinic anhydride acylating agent.

(b) A mixture of 3225 parts (5.0 equivalents) of the polyisobutene-substituted succinic acylating agent prepared as in (a), 289 parts (8.5 equivalents) of pentaerythritol and 5204 parts of mineral oil is heated at 225°–235° C. for 5.5 hours. The reaction mixture is filtered at 130° C. to yield an oil solution of the desired ashless dispersant product.

(c) A mixture is formed from 300 parts of the ashless dispersant product solution formed as in (b), 8 parts of phosphorous acid, and 3.5 parts of tolutriazole. The mixture is heated at 100° C. for two hours. A clear solution or composition is obtained which is soluble in oil and suitable for use as component b).

EXAMPLE B-26

The procedure of Example B-25 is repeated except that the tolutriazole is eliminated from the reaction mixture of (c).

EXAMPLE B-27

The procedure of Example B-26 is repeated except that 11 parts of phosphoric acid is used in place of the phosphorous acid to provide a clear, oil-soluble composition suitable for use as component b).

EXAMPLE B-28

The procedure of Example B-27 is repeated except that 10 parts of an equimolar mixture of phosphoric acid and phosphorous acid is used.

EXAMPLE B-29

(a) A mixture of 1,000 parts (0.495 mole) of polyisobutene ($\overline{M}n$=2020; $\overline{M}w$=6049, both determined using the methodology of U.S. Pat. No. 4,234,435) and 115 parts (1.17 moles) of maleic anhydride is heated to 110° C. This mixture is heated to 184° C. in 6 hours during which 85 parts (1.2 moles) of gaseous chlorine is added beneath the surface. At 184°–189° C., an additional 59 parts (0.83 mole) of chlorine is added over 4 hours. The reaction mixture is stripped by heating at 186°–190° C. with nitrogen purged for 26 hours. The residue is predominately polyisobutenyl succinic anhydride acylating agent.

(b) A mixture of 322 parts (0.5 equivalent) of the polyisobutene-substituted succinic acylating agent prepared as in (a), 68 parts (2.0 equivalents) of pentaerythritol and 508 parts of mineral oil is heated at 204°–227° C. for 5 hours. The reaction mixture is cooled to 162° C. and 5.3 parts (0.13 equivalent) of a commercial ethylene polyamine mixture having an overall composition approximating that of tetraethylene pentamine is added. The reaction mixture is heated at 162°–163° C. for 1 hour, then cooled to 130° C. and filtered. The filtrate is an oil solution of the desired ashless dispersant product.

(c) A mixture is formed from 350 parts of the ashless dispersant product solution formed as in (b), 8 parts of phosphorous acid, and 3.5 parts of tolutriazole. The mixture is heated at 100° C. for two hours. A clear solution or composition is obtained which is soluble in oil and suitable for use as component b).

EXAMPLE B-30

The procedure of Example B-29 is repeated except that the tolutriazole is eliminated from the reaction mixture of (c).

EXAMPLE B-31

The procedure of Example B-30 is repeated except that 15.8 parts of phosphorotetrathioic acid ($H_3PS_4$) is used in place of the phosphorous acid.

EXAMPLE B-32

(a) A mixture of 510 parts (0.28 mole) of polyisobutene ($\overline{M}n$=1845; $\overline{M}w$=5325, both determined using the methodology of U.S. Pat. No. 4,234,435) and 59 parts (0.59 mole) of maleic anhydride is heated to 110° C. This mixture is heated to 190° C. in 7 hours during which 43 parts (0.6 mole) of gaseous chlorine is added beneath the surface. At 190°–192° C., an additional 11 parts (0.16 mole) of chlorine is added over 3.5 hours. The reaction mixture is stripped by heating at 190°–193° C. with nitrogen blowing for 10 hours. The residue is predominately polyisobutenyl succinic anhydride acylating agent.

(b) A mixture of 334 parts (0.52 equivalents) of the polyisobutene substituted succinic acylating agent prepared as in (a), 548 parts of mineral oil, 30 parts (0.88 equivalent) of pentaerythritol and 8.6 parts (0.0057 equivalent) of Polyglycol 112-2 demulsifier (Dow Chemical Company) is heated at 150° C. for 2.5 hours. The reaction mixture is then heated to 210° C. over a period of 5 hours and then held at 210° C. for an additional 3.2 hours. The reaction mixture is cooled to 190° C. and 8.5 parts (0.2 equivalent) of a commercial mixture of ethylene polyamines having an overall composition approximating that of tetraethylene pentamine is added. The reaction mixture is stripped by heating at 205° C. with nitrogen blowing for 3 hours, and then filtered to yield the filtrate as an oil solution of the desired ashless dispersant product.

(c) A mixture is formed from 260 parts of the ashless dispersant product solution formed as in (b), 8 parts of phosphorous acid, and 3.5 parts of tolutriazole. The mixture is heated at 100° C. for two hours. A clear solution or composition is obtained which is soluble in oil and suitable for use as component b).

EXAMPLE B-33

The procedure of Example B-32 is repeated except that the tolutriazole is eliminated from the reaction mixture of (c).

EXAMPLE B-34

The procedure of Example B-36 is repeated except that 6.4 parts of hypophosphorous acid ($H_3PO_2$) is used in place of the phosphorous acid.

EXAMPLE B-35

(a) A mixture of 510 parts (0.28 mole) of polyisobutene ($\overline{M}n$=1845; $\overline{M}w$=5325, both determined using the methodology of U.S. Pat. No. 4,234,435) and 59 parts (0.59 mole) of maleic anhydride is heated to 110° C. This mixture is heated to 190° C. in 7 hours during which 43 parts (0.6 mole) of gaseous chlorine is added beneath the surface. At 190°–192° C., an additional 11 parts (0.16 mole) of chlorine is added over 3.5 hours. The reaction mixture is stripped by heating at 190°–193° C. with nitrogen blowing for 10 hours. The residue is predominately polyisobutenyl succinic anhydride acylating agent.

(b) A mixture is prepared by the addition of 10.2 parts (0.25 equivalent) of a commercial mixture of ethylene polyamines having the approximate overall composition of tetraethylene pentamine to 113 parts of mineral oil and 161 parts (0.25 equivalent) of the substituted succinic acylating agent prepared as in (a) while maintaining the temperature at 138° C. The reaction mixture is heated to 150° C. over a 2 hour period and stripped by blowing with nitrogen. The reaction mixture is filtered to yield the filtrate as an oil solution of the desired ashless dispersant product.

(c) A mixture is formed from 125 parts of the polyisobutenyl succinimide product solution formed as in (b), 8 parts of phosphorous acid, and 3.5 parts of tolutriazole. The mixture is heated at 100° C. to form a composition which is soluble in oil and suitable for use as component b).

EXAMPLE B-36

The procedure of Example B-35 is repeated except that the tolutriazole is eliminated from the reaction mixture of (c).

EXAMPLE B-37

The procedure of Example B-36 is repeated except that parts of orthophosphoric acid is used instead of the phosphorous acid.

EXAMPLE B-38

To a reactor are charged under a nitrogen atmosphere 67.98 parts of a commercially-available polyisobutenyl succinimide of a mixture of polyethylene polyamines having the approximate overall composition of tetraethylene pentamine (the polyisobutenyl group derived from polyisobutene having a number average molecular weight of about 950; the succinimide product having a ratio of about 1.15 succinic groups per alkenyl group) and 26.14 parts of a 100 Solvent Neutral refined mineral oil. After raising the temperature of the resulting solution to 100°–105° C., 2.09 parts of phosphorous acid are introduced into the reactor, followed by 0.92 part of tolutriazole (Cobratec TT-100; PMC Specialties Group, Cincinnati, Ohio). The resultant mixture is heated at 100°–105° C. for two hours. Then the temperature is gradually raised to 115° C. with the application of a vacuum to 40 mm Hg. Stripping is continued for 90 minutes and until 120° C./40 mm Hg has been reached. A flow of dry nitrogen is then applied to the system and the product mixture is allowed to cool. The product mixture is suitable for use as component b) in the compositions of this invention.

EXAMPLE B-39

The procedure of Example B-38 is repeated except that the tolutriazole is omitted from the reaction mixture.

EXAMPLE B-40

The procedure of Example B-13 is repeated except that 763.2 parts of phosphorous acid ($H_3PO_3$) and 2,836.8 parts of 100 Solvent Neutral mineral oil are used. The phosphorus content of the final product is about 1.66%.

EXAMPLE B-41

(a) A mixture of 322 parts of the polyisobutene-substituted succinic acylating agent prepared as in Example B-35(a), 68 parts of pentaerythritol and 508 parts of mineral oil is heated at 204°–227° C. for 5 hours. The reaction mixture is cooled to 162° C. and 5.3 parts of a commercial ethylene polyamine mixture having the approximate overall composition corresponding to tetraethylene pentamine is added. The reaction mixture is heated at 162°–163° C. for 1 hour, then cooled to 130° C. and filtered. The filtrate is an oil solution of the desired product.

(b) A mixture is formed from 275 parts of the product solution formed as in (a), 8 parts of phosphorous acid, and 3.5 parts of tolutriazole. The mixture is heated at 100° C. for two hours. A clear solution or composition is obtained which is soluble in oil and suitable for use as component b).

EXAMPLE B-42

The procedures of Examples B-1 through B-5 and B-9 through B-14 are repeated except that in each case the phosphorylating agent consists of a chemically equivalent amount of a mixture consisting of an equimolar mixture of phosphorous acid and dibutyl hydrogen phosphite.

EXAMPLE B-43

(a) To 120 parts of chlorinated polyisobutylene having a number average molecular weight of about 1,300 and containing about 2.8 weight percent chlorine are added 21.7 parts of pentaethylene hexamine and 5.6 parts of sodium carbonate. The reaction mixture is heated to about 205° C. and maintained at this temperature for about 5 hours. A stream of nitrogen is passed through the reaction mixture to remove the water of reaction. The reaction mixture is diluted with 60 parts of light mineral oil and hexane, filtered and extracted with methanol to remove excess pentaethylene hexamine. The hexane is stripped from the product by heating the mixture to 120° C. under a suitable vacuum. The product should have a nitrogen content of approximately 1.0 to 1.5 weight percent.

(b) A mixture is formed from 80 parts of a diluted reaction product formed as in (a), 20 parts of a 100 Solvent Neutral refined mineral oil diluent, and 2.1 parts of phosphorous acid. The resultant mixture is heated at 100°–105° C. for 2 hours and then the temperature is gradually raised to 115° C. with the application of a vacuum to 40 mm Hg. Stripping is continued for 90 minutes and until 120° C./40 mm Hg has been reached. A flow of dry nitrogen is then applied to the system and the product mixture is allowed to cool. The product mixture is suitable for use as component b) in the compositions of this invention.

EXAMPLE B-44

(a) Into a reactor are placed 220 parts of p-nonylphenol and 465 parts of diethylenetriamine. The mixture is heated to 80° C. and 152 parts of 37% formalin is added dropwise over a period of about 30 minutes. The mixture is then heated to 125° C. for several hours until the evolution of water has ceased. The resultant product should contain approximately 16–20% nitrogen.

(b) Into a reactor are placed 202 parts of styrene-maleic anhydride resin (having a number average molecular weight in the range of 600–700 and a mole ratio of styrene to maleic anhydride of 1:1), 202.5 parts of octadecyl amine and 472 parts of a 95 VI lubricating oil having a viscosity at 100° F. of 150 SUS. The mixture is heated to 225° C. for several hours. To this mixture is added dropwise over a period of about 30 minutes, 85 parts of the product formed as in (a). The resulting mixture is heated for 6 hours at 210°–230° C. while collecting the water formed during reaction. The polymeric product so formed should have a nitrogen content of about 2.1 weight percent.

(c) To a reactor are charged 200 parts of the basic nitrogen polymer produced as in (b) and 50 parts of a 100 Solvent Neutral refined mineral oil. After raising the temperature of the resulting mixture to 100°–105° C., 4.0 parts of phosphorous acid is added. The resultant mixture is heated at 100°–105° C. for two hours and then the temperature is gradually raised to 115° C. with the application of a vacuum to 40 mm Hg. Stripping is continued for 90 minutes and until 120° C./40 mm Hg has been reached. A flow of dry nitrogen is then applied to the system and the product mixture is allowed to cool. The product mixture is suitable for use as component b) in the compositions of this invention.

A particularly preferred embodiment of this invention involves using as component b) a phosphorylated alkenyl succinimide of a polyethylene polyamine or mixture of polyethylene polyamines, wherein the succinimide is formed from (i) an alkenyl succinic acylating agent having a succination ratio (i.e., the ratio of the average number of chemically bound succinic groups per alkenyl group in the molecular structure of the succinic 5 acylating agent) in the range of 1 to about 1.3, the alkenyl group being derived from a polyolefin (most preferably a polyisobutene) having a number average molecular weight in the range of about 600 to about 1,300 (more preferably in the range of 700 to 1,250 and most preferably in the range of 800 to 1,200).

Unless otherwise expressly indicated, the following procedures are used to determine the succination ratio of the alkenyl succinic acylating agents utilized in forming such particularly preferred phosphorylated ashless dispersants:

A. The number average molecular weight ($\overline{M}n$) of the polyalkene from which the substituent is derived is determined by use of either of two methods, namely, vapor pressure osmometry (VPO) or gel permeation chromatography (GPC). Although more tedious to carry out, the VPO method is preferred as it tends to provide definitive values without need for calibration. For present purposes, the VPO determination should be conducted in accordance with ASTM D-2503-82 using high purity toluene as the measuring solvent.

Alternatively, a GPC procedure can be employed. As is well known, the GPC technique involves separating molecules according to their size in solution. For this purpose liquid chromatographic columns are packed with a styrene-divinyl benzene copolymer of controlled particle and pore sizes. When the polyalkene molecules from which the substituent is derived are transported through the GPC columns by a solvent (tetrahydrofuran), the polyalkene molecules small enough to penetrate into the pores of the column packing are retarded in their progress through the columns. On the other hand, the polyalkene molecules which are larger either penetrate the pores only slightly or are totally excluded from the pores. As a consequence, these larger polyalkene molecules are retarded in their progress through the columns to a lesser extent. Thus a velocity separation occurs according to the size of the respective polyalkene molecules. In order to define the relationship between polyalkene molecular weight and elution time, the GPC system to be used is calibrated using known molecular weight polyalkene standards and an internal standard method. Details concerning such GPC procedures and methods for column calibration are extensively reported in the literature. See for example, W. W. Yau, J. J. Kirkland, and D. D. Bly, *Modern Size-Exclusion Liquid Chromatography*, John Wiley & Sons, 1979, Chapter 9 (pages 285–341), and references cited therein.

For present purposes, the sample of polyalkene to be subjected to GPC analysis is injected into a high purity tetrahydrofuran mobile phase flowing at 1.00 mL/min. Such sample is separated by elution through a set of GPC columns arranged in series and containing seriatim 1,000, 500, 100, and 50 Angstrom pore sized styrene-divinyl benzene beads of 5 micron gel size. An internal standard, flowers of sulfur, is used with the sample to insure proper elution flow rate. The polyalkene eluate is detected by a differential refractive index detector. The signal from this detector as a function of time is digitized and stored by a data system. After the chromatograph is completed the stored data is processed to generate the $\overline{M}n$ of the polyalkene.

In general, the $\overline{M}n$ determined by the VPO and GPC methods should agree within the precision of the respective methods.

B. The total weight of the substituent groups present in the substituted succinic acylating agent is determined by conventional methods for determination of the number of carbonyl functions. The preferred procedure for use involves nonaqueous titration of the substituted acylating agent with standardized sodium isopropoxide. In this procedure the titration is conducted in a 1:1 mineral spirits:l-butanol solvent system. An alternative, albeit less preferred, procedure is the ASTM D-94 procedure.

The results from procedures A and B above are used in calculating the weight of substituent groups per unit weight of total sample.

C. In determining the succination ratio of the alkenyl succinic acylating agents used in forming the particularly preferred phosphorylated ashless dispersants employed as component b) pursuant to this invention, the determination is to be based on the active portion of the sample. That is to say, alkenyl succinic acylating agents are often produced as a mixture with an inactive diluent. Thus for the purpose of succination ratio determination, such diluent should not be considered a part of the succinic acylating agent, and accordingly a separation as between the diluent and the alkenyl succinic acylating agent should be accomplished. Such separation can be effected before determination of total weight of the substituent groups present in the substituted succinic acylating agent. However, it is preferable to effect such separation after such determination using a mathematical correction of the result. The separation itself can be achieved using a silica gel column separation technique. A low molecular weight non-polar hydrocarbon solvent, such as hexane and more preferably pentane, is used as the solvent whereby the unreactive diluent is readily eluted from the column. The substituted succinic acylating agent entrained in the column can then be recovered by use of a more polar elution solvent, preferably methanol/methylene dichloride.

Component c)

As noted above, in situations where scuffing wear is likely to be encountered, it is desirable to combine one or more boron-containing additive components with components a) and b) or with components a), b), and c). The boron-containing additive components are preferably oil-soluble additive components, but effective use can be made of boron-containing components which are sufficiently finely divided as to form stable dispersions in the base oil. Examples of the latter type of boron-containing components include the finely-divided inorganic orthoborate salts such as lithium borate, sodium borate, potassium borate, magnesium borate, calcium borate, ammonium borate and the like.

The oil-soluble boron-containing components include boronated ashless dispersants (often referred to as borated ashless dispersants) and esters of acids of boron. Examples of boronated ashless dispersants and descriptions of methods by which they can be prepared are well-documented in the literature. See for example the disclosures of U.S. Pat. Nos. 3,087,936; 3,254,025; 3,281,428; 3,282,955; 3,533,945; 3,539,633; 3,658,836; 3,697,574; 3,703,536; 3,704,308; 4,025,445; and 4,857,214, all disclosures of which are incorporated herein by reference. Likewise, the literature is replete with examples of oil-soluble esters of boron acids and methods for their production. See for example the disclosures of U.S. Pat. Nos. 2,866,811; 2,931,774; 3,009,797; 3,009,798; 3,009,799; 3,014,061; and 3,092,586, all disclosures of which are incorporated herein by reference.

Typical procedures for synthesis of boron-containing additives are illustrated by the following examples in which parts and percentages are by weight.

EXAMPLE C-1

Boric oxide (70 parts) and 2-methyl-2,4-pentanediol (39.5 parts) are heated together at reflux temperature in toluene in a system provided with a reflux condenser to which is attached a water trap. Heating is continued for 30 minutes during which time water evolved from the reaction is collected in the trap. The residual reaction mixture is freed of toluene by distillation at about 3 millimeters of mercury pressure. The residue is mainly tri(2-methyl-2,4-pentanediol)biborate which should contain at least about 5.7 percent of boron.

EXAMPLE C-2

(a) Two hundred parts of toluene and 61.8 parts of boric acid are added to a reaction vessel equipped with heating means, stirring means and reflux distillation means. The vessel is heated with stirring to the boiling point of the toluene-water azeotrope. Heating and agitation are continued until an amount of azeotrope corresponding to 18 parts of water is removed from the reaction mass. The vessel containing a solution of metaboric acid in toluene, is allowed to cool to room temperature.

(b) To the toluene-metaboric acid solution prepared as in (a) and containing 43.8 parts of metaboric acid, is added 118.2 parts of 2-methyl-2,4-pentanediol. The resulting mixture is heated with stirring to the boiling temperature of the toluene-water azeotrope until an amount of azeotrope corresponding to 27 parts of water is removed from the reaction mixture. The remaining toluene is removed by distillation at atmospheric pressure leaving a water-white liquid composed of bis(2-methyl-2,4-pentylene)pyroborate.

EXAMPLE C-3

To a reactor equipped with stirring means are charged 1665.8 parts of ethylene glycol monomethyl ether, 247 parts of boric acid and 800 parts of toluene. The mixture is heated at reflux with stirring while removing water in the form of a toluene-water azeotrope. After an amount of azeotrope corresponding to 144 parts of water are separated from the reaction mixture, the reaction mixture containing an intermediate boric acid ester is allowed to cool. To this cooled reaction mixture is added 776 parts of tetraethylene glycol and the stirred mixture is heated to reflux. After 72 parts of water are removed in the form of toluene-water azeotrope, the toluene is distilled from the reaction mixture and the product residue is subjected to vacuum stripping to 120°–150° C. at 2–4 mm Hg pressure. The stripped residue is the desired borate product.

EXAMPLE C-4

Charged into a reaction vessel are 43.3 parts of a commercially available mixture of polyethylene polyamines corresponding to pentaethylene hexamine and having a molecular weight of about 260, and 395 parts of diluent oil having a viscosity of 100 SUS. The vessel is blanketed with nitrogen and the mixture heated to 60° C. Then to this stirred mixture is added on a portion-wise basis 400 parts of a polyisobutenyl succinic anhydride having a saponification number of 51.9 (and formed from polyisobutene having a number average molecular weight of 1290) and containing 5.9 weight percent of 100 SUS diluent oil. The temperature of the resulting mixture is then raised to 110°–120° C. and maintained at this temperature for 1.5 hours. There are then added about 0.1 part of silicone oil antifoamant, 22 parts of boric acid, and 70 parts of a 72% solution of glycolic acid in water. The reaction mixture is heated to 160° C. and maintained at this temperature for 8 hours while removing water as formed. The product is filtered while hot and then allowed to cool, thereby yielding a 50 weight % solution of the desired product in diluent oil.

EXAMPLE C-5

A vessel is charged with 102 parts of 126 neutral petroleum oil, 36 parts of a neutral calcium sulfonate (prepared by sulfonating a 480 neutral oil and neutralizing the sulfonic acid with sodium hydroxide followed by metathesis with calcium chloride) and 12 parts of a succinimide dispersant (prepared by reacting polyisobutene succinic anhydride with tetraethylene pentamine). The contents of the vessel are mixed, and thereafter there is added a mixture of 200 parts of water containing 119 parts of potassium borate (formed by reacting 52 parts of potassium hydroxide with 145 parts of boric acid). The contents are vigorously agitated to form a stable micro-emulsion of the aqueous phase within the petroleum oil. The emulsion is dehydrated at a temperature of 132° C. to yield a stable dispersion of partculate potassium triborate in the diluent oil.

EXAMPLE C-6

A blend of 193 parts (3.13 moles) of boric acid, 1 part of tri-n-butylamine and a "heel" comprising 402 parts of the product of a previous run is heated to 188° C., with stirring, as volatiles are removed by distillation. After 8.5 hours, 1,500 parts (6.25 moles) of 1-hexadecene oxide is added over 5.5 hours; at 186°–195° C., with stirring. Heating and stirring are continued for two hours as volatiles are removed. The material is then vacuum stripped and filtered at 93°–99° C. The filtrate is the desired product. It should contain approximately 2.1% boron.

EXAMPLE C-7

A vessel is charged with 12.15 parts of process oil and 79.67 parts of an approximately 75% active polyisobutenyl succinimide (derived from polyisobutene having a number average molecular weight in the range of 1100–1300 and a mixture of polyethylene polyamines having an average overall composition approximating that of tetraethylene pentamine, the completed product being diluted with process oil such that the product contains about 75% active dispersant). To this mixture is added 7.82 parts of boric acid over a period of 2–4 hours at a temperature of 150°–165° C. under a slight vacuum. After the boric acid is added, the reaction vessel is vented to the atmosphere and the contents are held at 150°–165° C. for one hour. At the end of this cook period, vacuum is slowly applied at 150°–165° C. for a 1-hour vacuum ramp period until a reactor vacuum of –20 mm Hg gauge is obtained. The batch is maintained at –20 mm Hg gauge for one hour at 150°–165° C. During this evacuation time, a total of about 228 parts of water is removed. The product is filtered through a filter precoated with 0.81 parts of process oil and 0.60 parts of filter aid. After filtration, the product is further diluted with 2.42 parts of process oil. The overall amount of process oil added (accounting for losses in filtration, etc.), is about 15.14 parts associated with about 84.86 parts of boronated succinimide.

EXAMPLE C-8

A blend of 11,904 parts of boronated succinimide (HiTEC® 648 additive; Ethyl Petroleum Additives, Inc.; Ethyl Petroleum Additives, Ltd.; Ethyl S.A.; Ethyl Canada Ltd.), and 96 parts of phosphorous acid ($H_3PO_3$) is heated to 110° C. for 2 hours.

Other Additive Components

The lubricant and lubricant concentrates of this invention can and preferably will contain additional components in order to partake of the properties which can be conferred to the overall composition by such additional components. The nature of such components will, to a large extent, be governed by the particular use to which the ultimate oleaginous composition (lubricant or functional fluid) is to be subjected.

Antioxidants.

Most oleaginous compositions will contain a conventional quantity of one or more antioxidants in order to protect the composition from premature degradation in the presence of air, especially at elevated temperatures. Typical antioxidants include hindered phenolic antioxidants, secondary aromatic amine antioxidants, sulfurized phenolic antioxidants, oil-soluble copper compounds, phosphorus-containing antioxidants, and the like.

Illustrative sterically hindered phenolic antioxidants include ortho-alkylated phenolic compounds such as 2,6-di-tert-butylphenol, 4-methyl-2,6-di-tert-butylphenol, 2,4,6-tri-tert-butylphenol, 2-tert-butylphenol, 2,6-diisopropylphenol, 2-methyl-6-tert-butylphenol, 2,4-dimethyl-6-tert-butylphenol, 4-(N,N-di-methylaminomethyl)-2,6-di-tert-butylphenol, 4-ethyl-2,6-di-tert-butylphenol, 2-methyl-6-styrylphenol, 2,6-di-styryl-4-nonylphenol, and their analogs and homologs. Mixtures of two or more such mononuclear phenolic compounds are also suitable.

The preferred antioxidants for use in the compositions of this invention are methylene-bridged alkylphenols, and these can be used singly or in combinations with each other, or in combinations with sterically-hindered unbridged phenolic compounds. Illustrative methylene bridged compounds include 4,4'-methylenebis(6-tert-butyl-o-cresol), 4,4'-methylenebis(2-tert-amyl-o-cresol), 2,2'-methylenebis (4-methyl-6-tert-butylphenol), 4,4'-methylenebis(2,6-di-tert-butylphenol), and similar compounds. Particularly preferred are mixtures of methylene-bridged alkylphenols such as are described in U.S. Pat. No. 3,211,652, all disclosure of which is incorporated herein by reference.

Amine antioxidants, especially oil-soluble aromatic secondary amines can also be used in the compositions of this invention. Whilst aromatic secondary monoamines are preferred, aromatic secondary polyamines are also suitable. Illustrative aromatic secondary monoamines include diphenylamine, alkyl diphenylamines containing 1 or 2 alkyl substituents each having up to about 16 carbon atoms, phenyl-α-naphthylamine, phenyl-β-naphthylamine, alkyl- or aralkyl-substituted phenyl-α-naphthylamine containing one or two alkyl or aralkyl groups each having up to about 16 carbon atoms, alkyl- or aralkyl-substituted phenyl-β-naphthylamine containing one or two alkyl or aralkyl groups each having up to about 16 carbon atoms, and similar compounds.

A preferred type of aromatic amine antioxidant is an alkylated diphenylamine of the general formula

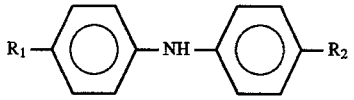

wherein $R_1$ is an alkyl group (preferably a branched alkyl group) having 8 to 12 carbon atoms, (more preferably 8 or 9 carbon atoms) and $R_2$ is a hydrogen atom or an alkyl group (preferably a branched alkyl group) having 8 to 12 carbon atoms, (more preferably 8 or 9 carbon atoms). Most preferably, $R_1$ and $R_2$ are the same. One such preferred compound is available commercially as Naugalube 438L, a material which is understood to be predominately a 4,4'-dinonyldiphenylamine (i.e., bis(4-nonylphenyl)amine) wherein the nonyl groups are branched.

Another useful type of antioxidant for inclusion in the compositions of this invention is comprised to one or more liquid, partially sulfurized phenolic compounds such as are prepared by reacting sulfur monochloride with a liquid mixture of phenols—at least about 50 weight percent of which mixture of phenols is composed of one or more reactive, hindered phenols—in proportions to provide from about 0.3 to about 0.7 gram atoms of sulfur monochloride per mole of reactive, hindered phenol so as to produce a liquid product. Typical phenol mixtures useful in making such liquid product compositions include a mixture containing by weight about 75% of 2,6-di-tert-butylphenol, about 10% of 2-tert-butylphenol, about 13% of 2,4,6-tri-tert-butylphenol, and about 2% of 2,4-di-tert-butylphenol. The reaction is exothermic and thus is preferably kept within the range of about 15° C. to about 70° C., most preferably between about 40° C. to about 60° C.

Mixtures of different antioxidants can also be used. One suitable mixture is comprised of a combination of (i) an oil-soluble mixture of at least three different sterically-hindered tertiary butylated monohydric phenols which is in the liquid state at 25° C., (ii) an oil-soluble mixture of at least three different sterically-hindered tertiary butylated methylene-bridged polyphenols, and (iii) at least one bis(4-alkylphenyl)amine wherein the alkyl group is a branched alkyl group having 8 to 12 carbon atoms, the proportions of (i), (ii) and (iii) on a weight basis falling in the range of 3.5 to 5.0 parts of component (i) and 0.9 to 1.2 parts of component (ii) per part by weight of component (iii).

The lubricating compositions of this invention preferably contain 0.01 to 1.0% by weight, more preferably 0.05 to 0.7% by weight, of one or more sterically-hindered phenolic antioxidants of the types described above. Alternatively or additionally the lubricants of this invention may contain 0.01 to 1.0% by weight, more preferably 0.05 to 0.7% by weight of one or more aromatic amine antioxidants of the types described above.

Corrosion Inhibitors.

It is also preferred pursuant to this invention to employ in the lubricant compositions and additive concentrates a suitable quantity of a corrosion inhibitor. This may be a single compound or a mixture of compounds having the property of inhibiting corrosion of metallic surfaces.

One type of such additives are inhibitors of copper corrosion. Such compounds include thiazoles, triazoles and thiadiazoles. Examples of such compounds include benzotriazole, tolyltriazole, octyltriazole, decyltriazole, dodecyltriazole, 2-mercaptobenzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio)-1,3,4-thiadiazoles, and 2,5-(bis)hydrocarbyldithio)-1,3,4-thiadiazoles. The preferred compounds are the 1,3,4-thiadiazoles, a number of which are available as articles of commerce. Such compounds are generally synthesized from hydrazine and carbon disulfide by known procedures. See for example U.S. Pat. Nos. 2,765,289; 2,749,311; 2,760,933; 2,850,453; 2,910,439; 3,663,561; 3,862,798; and 3,840,549, the disclosures of which are incorporated herein by reference.

Other types of corrosion inhibitors suitable for use in the compositions of this invention include dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable corrosion inhibitors include ether amines; acid phosphates; amines; polyethoxylated compounds such as ethoxylated amines, ethoxylated phenols, and ethoxylated alcohols; imidazolines; and the like. Materials of these types are well known to those skilled in the art and a number of such materials are available as articles of commerce.

Other useful corrosion inhibitors are aminosuccinic acids or derivatives thereof represented by the formula:

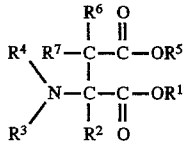

wherein each of $R^1$, $R^2$, $R^5$, $R^6$ and $R^7$ is, independently, a hydrogen atom or a hydrocarbyl group containing 1 to 30 carbon atoms, and wherein each of $R^3$ and $R^4$ is, independently, a hydrogen atom, a hydrocarbyl group containing 1 to 30 carbon atoms, or an acyl group containing from 1 to 30 carbon atoms. The groups $R^1$, $R^2$, $R^3$, $R^4$, $R^5$, $R^6$ and $R^7$, when in the form of hydrocarbyl groups, can be, for example, alkyl, cycloalkyl or aromatic containing groups. Preferably $R^1$ and $R^5$ are the same or different straight-chain or branched-chain hydrocarbon radicals containing 1–20 carbon atoms. Most preferably, $R^1$ and $R^5$ are saturated hydrocarbon radicals containing 3–6 carbon atoms. $R^2$, either $R^3$ or $R^4$, $R^6$ and $R^7$, when in the form of hydrocarbyl groups, are preferably the same or different straight-chain or branched-chain saturated hydrocarbon radicals. Preferably a dialkyl ester of an aminosuccinic acid is used in which $R^1$ and $R^5$ are the same or different alkyl groups containing 3–6 carbon atoms, $R^2$ is a hydrogen atom, and either $R^3$ or $R^4$ is an alkyl group containing 15–20 carbon atoms or an acyl group which is derived from a saturated or unsaturated carboxylic acid containing 2–10 carbon atoms.

Most preferred of the aminosuccinic acid derivatives is a dialkylester of an aminosuccinic acid of the above formula wherein $R^1$ and $R^5$ are isobutyl, $R^2$ is a hydrogen atom, $R^3$ is octadecyl and/or octadecenyl and $R^4$ is 3-carboxy-1-oxo-2-propenyl. In such ester $R^6$ and $R^7$ are most preferably hydrogen atoms.

The lubricant compositions of this invention most preferably contain from 0.005 to 0.5% by weight, and especially from 0.01 to 0.2% by weight, of one or more corrosion inhibitors and/or metal deactivators of the type described above.

Antifoam Agents.

Suitable antifoam agents include silicones and organic polymers such as acrylate polymers. Various antifoam agents are described in *Foam Control Agents* by H. T. Kerner (Noyes Data Corporation, 1976, pages 125–176), the disclosure of which is incorporated herein by reference. Mixtures of silicone-type antifoam agents such as the liquid dialkyl silicone polymers with various other substances are also effective. Typical of such mixtures are silicones mixed with an acrylate polymer, silicones mixed with one or more amines, and silicones mixed with one or more amine carboxylates.

Neutral Metal-Containing Detergents.

For some applications such as crankcase lubricants for diesel engines, it is desirable to include an oil-soluble neutral metal-containing detergent in which the metal is an alkali metal or an alkaline earth metal. Combinations of such detergents can also be employed. The neutral detergents of this type are those which contain an essentially stoichiometric equivalent quantity of metal in relation to the amount of acidic moieties present in the detergent. Thus in general, the neutral detergents will have a TBN of up to about 50.

The acidic materials utilized in forming such detergents include carboxylic acids, salicylic acids, alkylphenols, sulfonic acids, sulfurized alkylphenols, and the like. Typical detergents of this type and/or methods for their preparation are known and reported in the literature. See for example U.S. Pat. Nos. 2,001,108; 2,081,075; 2,095,538; 2,144,078; 2,163,622; 2,180,697; 2,180,698; 2,180,699; 2,211,972; 2,223,127; 2,228,654; 2,228,661; 2,249,626; 2,252,793; 2,270,183; 2,281,824; 2,289,795; 2,292,205; 2,294,145; 2,321,463; 2,322,307; 2,335,017; 2,336,074; 2,339,692; 2,356,043; 2,360,302; 2,362,291; 2,399,877; 2,399,878; 2,409,687; and 2,416,281, the disclosures of which are incorporated herein by reference. A number of such compounds are available as articles of commerce, such as for example, HiTEC® 614 additive (Ethyl Petroleum Additives, Inc.; Ethyl Petroleum Additives, Ltd.; Ethyl S.A.; Ethyl Canada Ltd.).

Supplemental Antiwear and/or Extreme Pressure Additives.

For certain applications such as use as gear oils, the compositions of this invention will preferably contain one or more oil-soluble supplemental antiwear and/or extreme pressure additives. These comprise a number of well known classes of materials including, for example, sulfur-containing additives, esters of boron acids, esters of phosphorus acids, amine salts of phosphorus acids and acid esters, higher carboxylic acids and derivatives thereof, chlorine-containing additives, and the like.

Typical sulfur-containing antiwear and/or extreme pressure additives include dihydrocarbyl polysulfides; sulfurized olefins; sulfurized fatty acid esters of both natural (e.g. sperm oil) and synthetic origins; trithiones; thienyl derivatives; sulfurized terpenes; sulfurized oligomers of $C_2$–$C_8$ monoolefins; xanthates of alkanols and other organohydroxy compounds such as phenols; thiocarbamates made from alkyl amines and other organo amines; and sulfurized Diels-Alder adducts such as those disclosed in U.S. Pat. No. Re. 27,331, the disclosure of which is incorporated herein by reference. Specific examples include sulfurized polyisobutene of $\overline{M}n$ 1,150, sulfurized isobutylene, sulfurized triisobutene, dicyclohexyl disulfide, diphenyl and dibenzyl disulfide, di-tert-butyl trisulfide, and dinonyl trisulfide, among others.

Esters of boron acids which may be used include borate, metaborate, pyroborate and biborate esters of monohydric and/or polyhydric alcohols and/or phenols, such as trioctyl borate, tridecyl borate, 2-ethylhexyl pyroborate, isoamyl metaborate, trixylyl borate, (butyl)(2,4-hexanediyl)borate, and the like.

Typical esters of phosphorus acids which may be used as antiwear and/or extreme pressure additives include trihydrocarbyl phosphites, phosphonates and phosphates, and dihydrocarbyl phosphites; such as tricresyl phosphate, tributyl phosphite, tris(2-chloroethyl) phosphate and phosphite, dibutyl trichloromethyl phosphonates, di(n-butyl)phosphite, triphenyl phosphite, tris(tridecyl) phosphite, and tolyl phosphinic acid dipropyl ester.

Among the amine salts of phosphorus acids and phosphorus acid-esters which can be employed are amine salts of partially esterified phosphoric, phosphorous, phosphonic, and phosphinic acids and their partial or total thio analogs such as partially esterified monothiophosphoric, dithiophosphoric, trithiophosphoric and tetrathiophosphoric acids; amine salts of phosphonic acids and their thio analogs; and the like. Specific examples include the dihexylammonium salt of dodecylphosphoric acid, the diethyl hexyl ammonium salt of dioctyl dithiophosphoric acid, the octadecylammonium salt of dibutyl thiophosphoric acid, the dilaurylammonium salt of 2-ethylhexylphosphoric acid, the dioleyl ammonium salt of butane phosphonic acid, and analogous compounds.

Higher carboxylic acids and derivatives which can be used as antiwear and/or extreme pressure additives are illustrated by fatty acids, dimerized and trimerized unsaturated natural acids (e.g., linoleic) and esters, amine, ammonia, and metal (particularly lead) salts thereof, and amides and imidazoline salt and condensation products thereof, oxazolines, and esters of fatty acids, such as ammonium di-(linoleic) acid, lard oil, oleic acid, animal glycerides, lead stearate, etc.

Suitable chlorine-containing additives include chlorinated waxes of both the paraffinic and microcrystalline type, polyhaloaromatics such as di- and trichlorobenzene, trifluoromethyl naphthalenes, perchlorobenzene, pentachlorophenol and dichloro diphenyl trichloroethane. Also useful are chlorosulfurized olefins and olefinic waxes and sulfurized chlorophenyl methyl chlorides and chloroxanthates. Specific examples include chlorodibenzyl disulfide, chlorosulfurized polyisobutene of $\overline{M}n$ 600, chlorosulfurized pinene and chlorosulfurized lard oil.

Supplemental Ashless Dispersants.

If desired, the compositions of this invention can include one or more supplemental ashless dispersants in order to supplement the dispersancy contributed by component b) (and optional component c) when used). The supplemental ashless dispersant(s) differ from component b) and component c) in that the supplemental ashless dispersant(s) are not phosphorylated in the manner of component b) or boronated (and optionally additionally phosphorylated) in the manner of component c).

Thus, the supplemental ashless dispersant(s) which may be used in the compositions of this invention can be any of the basic nitrogen-containing and/or hydroxyl group-containing ashless dispersants of the type referred to hereinabove in connection with the preparation of component b). Use can therefore be made of any of the carboxylic ashless dispersants and/or any of the hydrocarbyl polyamine dispersants and/or any of the Mannich polyamine dispersants and/or any of the polymeric polyamine dispersants referred to hereinabove. Other ashless dispersants which can be included in the compositions of this invention are imidazoline dispersants which can be represented by the formula:

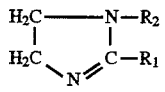

wherein $R_1$ represents a hydrocarbon group having 1 to 30 carbon atoms, e.g. an alkyl or alkenyl group having 7 to 22 carbon atoms, and R2 represents a hydrogen atoms or a hydrocarbon radical of 1 to 22 carbon atoms, or an aminoalkyl, acylaminoalkyl or hydroxyalkyl radical having 2 to 50 carbon atoms. Such long-chain alkyl (or long-chain alkenyl) imidazoline compounds may be made by reaction of a corresponding long-chain fatty acid (of formula $R_1$—COOH), for example oleic acid, with an appropriate polyamine. The imidazoline formed is then ordinarily called, for example, oleylimidazoline where the radical $R_1$ represents the oleyl residue of oleic acid. Other suitable alkyl substituents in the 2- position of these imidazolines include undecyl, heptadecyl, lauryl and erucyl. Suitable N-substituents of the imidazolines (i.e. radicals $R_2$) include hydrocarbyl groups, hydroxyalkyl groups, aminoalkyl groups, and acylaminoalkyl groups. Examples of these various groups include methyl, butyl, decyl, cyclohexyl, phenyl, benzyl, tolyl, hydroxyethyl, aminoethyl, oleylaminoethyl and stearylaminoethyl.

Another class of ashless dispersant which can be incorporated in the compositions of this invention are the products of reaction of an ethoxylated amine made by reaction of ammonia with ethylene oxide with a carboxylic acid of 8 to 30 carbon atoms. The ethoxylated amine may be, for example, mono-, di- or triethanolamine or a polyethoxylated derivative thereof, and the carboxylic acid may be, for example, a straight or branched chain fatty acid of 10 to 22 carbon atoms, a naphthenic acid, a resinic acid or an alkyl aryl carboxylic acid.

Still another type of ashless dispersants which can be used in the practice of this invention are the α-olefin-maleimide copolymers such as are described in U.S. Pat. No. 3,909,215, the disclosure of which is incorporated herein by reference. Such copolymers are alternating copolymers of N-substituted maleimides and aliphatic α-olefins of from 8 to 30 carbon atoms. The copolymers may have an average of 4 to 20 maleimide groups per molecule. The substituents on the nitrogen of the maleimide may be the same or different and are organic radicals composed essentially of carbon, hydrogen and nitrogen having a total of 3 to 60 carbon atoms. A commercially available material which is highly suitable for use in this invention is Chevron OFA 425B, and this material is believed to be or comprise an α-olefin maleimide copolymer of the type described in U.S. Pat. No. 3,909,215.

The above and many other types of ashless dispersants, including the so-called dispersant-viscosity index improvers, can be utilized either singly or in combination in the compositions of this invention, provided of course that they are compatible with the other additive components being employed and are suitably soluble in the base oil selected for use.

Pour Point Depressants.

Another useful type of additive included in compositions of this invention is one or more pour point depressants. The use of pour point depressants in oil-base compositions to improve the low temperature properties of the compositions is well known to the art. See, for example, the books *Lubricant Additives* by C. V. Smalheer and R. Kennedy Smith. (Lezius-Hiles Co. Publishers, Cleveland, Ohio, 1967); *Gear and Transmission Lubricants* by C. T. Boner (Reinhold Publishing Corp., New York, 1964); and *Lubricant Additives* by M. W. Ranney (Noyes Data Corporation, New Jersey, 1973). Among the types of compounds which function satisfactorily as pour point depressants in the compositions of this invention are polymethacrylates, polyacrylates, condensation products of haloparaffin waxes and aromatic compounds, and vinyl carboxylate polymers. Also useful as pour point depressants are terpolymers made by polymerizing a dialkyl fumarate, vinyl ester of a fatty acid and a vinyl alkyl ether. Techniques for preparing such polymers and their uses are disclosed in U.S. Pat. No. 3,250,715 which is incorporated herein by reference. Generally, when they are present in the compositions of this invention, the pour point depressants (on an active content basis) are present in amounts within the range of 0.01 to 5, and more often within the range of 0.01 to 1, weight percent of the total composition.

Viscosity Index Improvers.

Depending upon the viscosity grade required, the lubricant compositions can contain up to 15 weight percent of one or more viscosity index improvers (excluding the weight of solvent or carrier fluid with which viscosity index improvers are often associated as supplied). Among the numerous types of materials known for such use are hydrocarbon polymers grafted with, for example, nitrogen-containing polymers, olefin polymers such as polybutene, ethylene-propylene copolymers, hydrogenated polymers and copolymers and terpolymers of styrene with isoprene and/or butadiene, polymers of alkyl acrylates or alkyl methacrylates, copolymers of alkyl methacrylates with N-vinyl pyrrolidone or dimethylaminoalkyl methacrylate; post-grafted polymers of ethylene-propylene with an active monomer such as maleic anhydride which may be further reacted with an alcohol or an alkylene polyamine; styrene/maleic anhydride polymers post-treated with alcohols and/or amines, and the like.

Dispersant viscosity index improvers, which combine the activity of dispersants and viscosity index improvers, suitable for use in the compositions of this invention are described, for example, in U.S. Pat. Nos. 3,702,300; 4,068,056; 4,068,058; 4,089,794; 4,137,185; 4,146,489; 4,149,984; 4,160,739; and 4,519,929, the disclosures of which are incorporated herein by reference.

Friction Modifiers.

These materials, sometimes known as fuel economy additives, include such substances as the alkyl phosphonates as disclosed in U.S. Pat. No. 4,356,097, aliphatic hydrocarbyl-substituted succinimides derived from ammonia or alkyl monoamines as disclosed in European Patent Publication No. 20037, dimer acid esters as disclosed in U.S. Pat. No. 4,105,571, oleamide, and the like. Such additives, when used are generally present in amounts of 0.1 to 5 weight percent. Glycerol oleates are another example of fuel economy additives and these are usually present in very small amounts, such as 0.05 to 0.2 weight percent based on the weight of the formulated oil. The patents and the patent publication referred to in this paragraph are incorporated herein by reference.

Other suitable friction modifiers include aliphatic amines or ethoxylated aliphatic amines, aliphatic fatty acid amides, aliphatic carboxylic acids, aliphatic carboxylic esters, aliphatic carboxylic ester-amides, aliphatic phosphates, aliphatic thiophosphonates, aliphatic thiophosphates, etc., wherein the aliphatic group usually contains above about eight carbon atoms so as to render the compound suitably oil soluble.

A desirable friction modifier additive combination which may be used in the practice of this invention is described in European Patent Publication No. 389,237, the disclosure of which is incorporated herein by reference. This combination involves use of a long chain succinimide derivative and a long chain amide.

Seal Swell Agents.

Additives may be introduced into the compositions of this invention in order to improve the seal performance (elastomer compatibility) of the compositions. Known materials of this type include dialkyl diesters such as dioctyl sebacate, aromatic hydrocarbons of suitable viscosity such as Panasol AN-3N, products such as Lubrizol 730, polyol esters such as Emery 2935, 2936, and 2939 esters from the Emery Group of Henkel Corporation and Hatcol 2352, 2962, 2925, 2938, 2939, 2970, 3178, and 4322 polyol esters from Hatco Corporation. Generally speaking the most suitable diesters include the adipates, azelates, and sebacates of $C_8$–$C_{13}$ alkanols (or mixtures thereof), and the phthalates of $C_4$–$C_{13}$ alkanols (or mixtures thereof). Mixtures of two or more different types of diesters (e.g., dialkyl adipates and dialkyl azelates, etc.) can also be used. Examples off such materials include the n-octyl, 2-ethylhexyl, isodecyl, and tridecyl diesters of adipic acid, azelaic acid, and sebacic acid, and the n-butyl, isobutyl, pentyl, hexyl, heptyl, octyl, nonyl, decyl, undecyl, dodecyl, and tridecyl diesters of phthalic acid.

Base Oils.

The additive combinations of this invention can be incorporated in a wide variety of lubricants and functional fluids in effective amounts to provide suitable active ingredient concentrations. The base oils not only can be hydrocarbon oils of lubricating viscosity derived from petroleum (or tar sands, coal, shale, etc.), but also can be natural oils of suitable viscosities such as rapeseed oil, etc., and synthetic oils such as hydrogenated drogenated polyolefin oils; poly-α-olefins (e.g., hydrogenated or unhydrogenated α-olefin oligomers such as hydrogenated poly-1-decene); alkyl esters of dicarboxylic acids; complex esters of dicarboxylic acid, polyglycol and alcohol; alkyl esters of carbonic or phosphoric acids; polysilicones; fluorohydrocarbon oils; and mixtures of mineral, natural and/or synthetic oils in any proportion, etc. The term "base oil" for this disclosure includes all the foregoing.

The additive combinations of this invention can thus be used in lubricating oil and functional fluid compositions, such as automotive crankcase lubricating oils, automatic transmission fluids, gear oils, hydraulic oils, cutting oils, etc., in which the base oil of lubricating viscosity is a mineral oil, a synthetic oil, a natural oil such as a vegetable oil, or a mixture thereof, e.g. a mixture of a mineral oil and a synthetic oil.

Suitable mineral oils include those of appropriate viscosity refined from crude oil of any source including Gulf Coast, Midcontinent, Pennsylvania, California, Alaska, Middle East, North Sea and the like. Standard refinery operations may be used in processing the mineral oil. Among the general types of petroleum oils useful in the compositions of this invention are solvent neutrals, bright stocks, cylinder stocks, residual oils, hydrocracked base stocks, paraffin oils including pale oils, and solvent extracted naphthenic oils. Such oils and blends of them are produced by a number of conventional techniques which are widely known by those skilled in the art.

As is noted above, the base oil can consist essentially of or comprise a portion of one or more synthetic oils. Among the suitable synthetic oils are homo- and inter-polymers of $C_2$–$C_{12}$ olefins, carboxylic acid esters of both monoalcohols and polyols, polyethers, silicones, polyglycols, silicates, alkylated aromatics, carbonates, thiocarbonates, orthoformates, phosphates and phosphites, borates and halogenated hydrocarbons. Representative of such oils are homo- and interpolymers of $C_2$–$C_{12}$ monoolefinic hydrocarbons, alkylated benzenes (e.g., dodecyl benzenes, didodecyl benzenes, tetradecyl benzenes, dinonyl benzenes, di-(2-ethylhexyl)benzenes, wax-alkylated naphthalenes); and polyphenyls (e.g., biphenyls, terphenyls).

Alkylene oxide polymers and interpolymers and derivatives thereof where the terminal hydroxyl groups have been modified by esterification, etherification, etc., constitute another class of synthetic oils. These are exemplified by the oils prepared through polymerization of alkylene oxides such as ethylene oxide or propylene oxide, and the alkyl and aryl ethers of these polyoxyalkylene polymers (e.g., methyl polyisopropylene glycol ether having an average molecular weight of 1,000, diphenyl ether of polyethylene glycol having a molecular weight of 500–1,000, diethyl ether of polypropylene glycol having a molecular weight of 1,000–1,500) or mono- and poly-carboxylic esters thereof, for example, the acetic acid ester, mixed $C_3$–$C_6$ fatty acid esters, or the $C_{13}$ Oxo acid diester of tetraethylene glycol.

Another suitable class of synthetic oils comprises the esters of dicarboxylic acids (e.g., phthalic acid, succinic acid, maleic acid, azelaic acid, suberic acid, sebacic acid, fumaric acid, adipic acid, linoleic acid dimer) with a variety of alcohols (e.g., butyl alcohol, hexyl alcohol, dodecyl alcohol, 2-ethylhexyl alcohol, ethylene glycol). Specific examples of these esters include dibutyl adipate, di(2-ethylhexyl) adipate, didodecyl adipate, di(tridecyl) adipate, di(2-ethylhexyl) sebacate, dilauryl sebacate, di-n-hexyl fumarate, dioctyl sebacate, diisooctyl azelate, diisodecyl azelate, dioctyl phthalate, didecyl phthalate, di(eicosyl) sebacate, the 2-ethylhexyl diester of linoleic acid dimer, and the complex ester formed by reacting one mole of sebacic acid with two moles of tetraethylene glycol and two moles of 2-ethylhexanoic acid.

Esters which may be used as synthetic oils also include those made from $C_3$–$C_{18}$ monocarboxylic acids and polyols and polyol ethers such as neopentyl glycol, trimethylolpropane, pentaerythritol and dipentaerythritol. Trimethylol propane tripelargonate and pentaerythritol tetracaproate, the ester formed from trimethylolpropane, caprylic acid and sebacic acid, and the polyesters derived from a $C_4$–$C_{14}$ dicarboxylic acid and one or more aliphatic dihydric $C_3$–$C_{12}$ alcohols such as derived from azelaic acid or sebacic acid and 2,2,4-trimethyl-1,6-hexanediol serve as examples.

Silicon-based oils such as the polyalkyl-, polyaryl-, polyalkoxy-, or polyaryloxy-siloxane oils and silicate oils comprise another class of synthetic lubricants (e.g., tetraethyl silicate, tetraisopropyl silicate, tetra-(2-ethylhexyl) silicate, tetra-(p-tert-butylphenyl) silicate, poly(methyl) siloxanes, and poly(methylphenyl)siloxanes. Other synthetic lubricating oils include liquid esters of phosphorus-containing acids (e.g., tricresyl phosphate, trioctyl phosphate, triphenyl phosphite, and diethyl ester of decane phosphonic acid.

Also useful as base oils or as components of base oils are hydrogenated or unhydrogenated liquid oligomers of $C_6$–$C_{16}$ alpha-olefins, such as hydrogenated or unhydrogenated oligomers formed from 1-decene. Methods for the production of such liquid oligomeric 1-alkene hydrocarbons are known and reported in the literature. See for example U.S. Pat. Nos. 3,749,560; 3,763,244; 3,780,128; 4,172,855; 4,218,330; 4,902,846; 4,906,798; 4,910,355; 4,911,758; 4,935,570; 4,950,822; 4,956,513; and 4,981,578, the disclosures of which are incorporated herein by reference. Additionally, hydrogenated 1-alkene oligomers of this type are available as articles of commerce, for example, under the trade designations ETHYLFLO 162, ETHYLFLO 164, ETHYLFLO 166, ETHYLFLO 168, ETHYLFLO 170, ETHYLFLO 174, and ETHYLFLO 180 poly-α-olefin oils (Ethyl Corporation; Ethyl Canada Ltd.; Ethyl S.A.). Blends of such materials can also be used in order to adjust the viscometrics of the given base oil. Suitable 1-alkene oligomers are also available from other suppliers. As is well known, hydrogenated oligomers of this type contain little, if any, residual ethylenic unsaturation.

Preferred oligomers are formed by use of a Friedel-Crafts catalyst (especially boron trifluoride promoted with water or a $C_{1-20}$ alkanol) followed by catalytic hydrogenation of the oligomer so formed using procedures such as are described in the foregoing U.S. patents.

Other catalyst systems which can be used to form oligomers of 1-alkene hydrocarbons, which, on hydrogenation, provide suitable oleaginous liquids include Ziegler catalysts such as ethyl aluminum sesquichloride with titanium tetrachloride, aluminum alkyl catalysts, chromium oxide catalysts on silica or alumina supports and a system in which a boron trifluoride catalyzed oligomerization is followed by treatment with an organic peroxide.

It is also possible in accordance with this invention to utilize blends of one or more liquid hydrogenated 1-alkene oligomers in combination with other oleaginous materials having suitable viscosities, provided that the resultant blend has suitable compatibility and possesses the physical properties desired.

Typical natural oils that may be used as base oils or as components of the base oils include castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and the like. Such oils may be partially or fully hydrogenated, if desired.

The fact that the base oils used in the compositions of this invention may be composed of (i) one or more mineral oils, (ii) one or more synthetic oils, (iii) one or more natural oils, or (iv) a blend of (i) and (ii), or (i) and (iii), or (ii) and (iii), or (i), (ii) and (iii) does not mean that these various types of oils are necessarily equivalents of each other. Certain types of base oils may be used in certain compositions for the specific properties they possess such as high temperature stability, non-flammability or lack of corrosivity towards specific: metals (e.g. silver or cadmium). In other compositions, other types of base oils may be preferred for reasons of availability or low cost. Thus, the skilled artisan will recognize that while the various types of base oils discussed above may be used in the compositions of this invention, they are not necessarily functional equivalents of each other in every instance.

Proportions and Concentrations

In general, the components of the additive compositions of this invention are employed in the oleaginous liquids (e.g., lubricating oils and functional fluids) in minor amounts sufficient to improve the performance characteristics and properties of the base oil or fluid. The amounts will thus vary in accordance with such factors as the viscosity characteristics of the base oil or fluid employed, the viscosity characteristics desired in the finished product, the service conditions for which the finished product is intended, and the performance characteristics desired in the finished product. However, generally speaking, the following concentrations (weight percent) of the components (active ingredients) in the base oils or fluids are illustrative:

| | General Range | Preferred Range | More Preferred Range | Particularly Preferred Range |
|---|---|---|---|---|
| Component a) | 0.001–20 | 0.01–10 | 0.1–6 | 0.5–3 |
| Component b) | 0.01–20 | 0.1–15 | 0.5–10 | 1–8 |
| Component c) | 0–20 | 0.1–15 | 0.5–10 | 1–8 |

The relative proportions of components a), b) and c) in the finished oleaginous liquids and in the additive concentrates of this invention generally are such that per atom of phosphorus; in component b), there are from 0.02 to 1,000 atoms (and preferably from 0.05 to 150 atoms) of metal as component a); and from 0 to 600 atoms (and preferably from 0.15 to 200 atoms) of boron as component c).

In order to achieve optimum performance, the base oil should contain at least about 0.03%, preferably at least about 0.04%, more preferably at least about 0.05%, and most preferably at least about 0.06% by weight of phosphorus as component b). For this reason it is desirable to proportion the components in the additive concentrates to yield such concentrations of phosphorus as component b) at the treat level recommended for any given additive concentrate. A wide variety of component proportions in the additive concentrates can of course be used to achieve these use concentrations in the finished oil. Nevertheless, and without in any way limiting the scope of this invention preferred additive concentrates of this invention will typically contain at least about 0.3% by weight of phosphorus as component b), and may contain as much as 3% or more of phosphorus as component b).

The concentrations (weight percent of active ingredient) of typical optional ingredients in the oleaginous liquid compositions of this invention are generally as follows:

| | Typical Range | Preferred Range |
|---|---|---|
| Antioxidant | 0–4 | 0.05–2 |
| Corrosion inhibitor | 0–3 | 0.02–1 |
| Foam inhibitor | 0–0.3 | 0.0002–0.1 |
| Neutral metal detergent | 0–3 | 0–2.5 |
| Supplemental antiwear/EP agent | 0–5 | 0–2 |
| Supplemental ashless dispersant | 0–10 | 0–5 |
| Pour point depressant | 0–5 | 0–2 |
| Viscosity index improver | 0–20 | 0–12 |
| Friction modifier | 0–3 | 0–1 |
| Seal swell agent | 0–20 | 0–10 |
| Dye | 0–0.1 | 0–0.05 |

It will be appreciated that the individual components a) and b), preferably component c) as well, and also any and all auxiliary components employed, can be separately blended into the base oil or fluid or can be blended therein in various subcombinations, if desired. Moreover, such components can be blended in the form of separate solutions in a diluent. Except for viscosity index improvers and/or pour point depressants (which are usually blended apart from other components), it is preferable to blend the components used in the form of an additive concentrate of this invention, as this simplifies the blending operations, reduces the likelihood of blending errors, and takes advantage of the compatibility and solubility characteristics afforded by the overall concentrate.

The additive concentrates of this invention will contain components a) and b), and preferably component c), in amounts proportioned to yield finished oil or fluid blends consistent with the concentrations tabulated above. In most cases, the additive concentrate will contain one or more diluents such as light mineral oils, to facilitate handling and blending of the concentrate. Thus concentrates containing up to 50% by weight of one or more diluents or solvents can be used.

The oleaginous liquids provided by this invention can be used in a variety of applications. For example, they can be employed as crankcase lubricants, gear oils, hydraulic fluids, manual transmission fluids, automatic transmission fluids, cutting and machining fluids, brake fluids, shock absorber fluids, heat transfer fluids, quenching oils, transformer oils, and the like. The compositions are particularly suitable for use as crankcase lubricants for spark ignition (gasoline) engines, and compression ignition (diesel) engines.

Blending

To make the compositions of this invention, one either purchases or synthesizes each of the respective individual components to be used in the formulation or blending operation. Unless one is already in the commercial manufacture of one or more such components, it is usually simpler and thus preferable to purchase, to the extent possible, the ingredients to be used in the compositions of this invention. Where it is desired or necessary to synthesize one or more components, use may be made of the synthesis procedures referred to herein or in the applications references cited and incorporated herein.

The formulation or blending operations are relatively simple and involve mixing together in a suitable container or vessel, using a dry, inert atmosphere where necessary or desired, appropriate proportions of the selected ingredients. Those skilled in the art are cognizant of and familiar with the procedures suitable for formulating and blending additive concentrates and lubricant compositions. While it is usually possible to blend the components in various sequences, it is distinctly preferable when forming compositions of this invention which are to contain a sulfurized antioxidant or stabilizer and a sulfurized fatty ester-polyalkanol amide type product such as SUL-PERM 60–93 as components, to combine the sulfurized antioxidant or stabilizer with the ashless dispersant component(s) prior to mixing with the sulfurized fatty ester-polyalkanol amide type product. It will be appreciated that in any blending operation, the components being blended at any given time should not be irreconcilably incompatible with each other.

Agitation such as with mechanical stirring equipment is desirable to facilitate the blending operation. Frequently it is helpful to apply sufficient heat to the blending vessel during or after the introduction of the ingredients thereto, so as to maintain the temperature at, say, 40°–60° C. Similarly, it is sometimes helpful to preheat highly viscous components to a suitable temperature even before they are introduced into the blending vessel in order to render them more fluid and thereby facilitate their introduction into the blending vessel and render the resultant mixture easier to stir or blend. Naturally the temperatures used during the blending operations should be controlled so as not to cause any significant amount of thermal degradation or unwanted chemical interactions.

When forming the lubricant compositions of this invention, it is usually desirable to introduce the additive ingredient into the base oil with stirring and application of mildly elevated temperatures, as this facilitates the dissolution of the components in the oil and achievement of product uniformity.

Presented below are commercial sources and product identifications of a number of products which may be purchased for use in connection with components a), b) and c) in the formulation of the compositions of this invention. It will be understood and appreciated that this listing does not purport to be current or complete.

Metal-containing detergents for use as component a):

HiTEC® 611 additive and HiTEC® 615 additive (Ethyl Petroleum Additives, Inc.; Ethyl Petroleum Additives, Ltd.; Ethyl S.A.; Ethyl Canada Ltd.); Lubrizol LZ 52, LZ 56, LZ 58, LZ 59, LZ 65, LZ 72, LZ 74, LZ 76, LZ 78, LZ 89, LZ 690, LZ 692, LZ 5319, LZ 5319A, LZ 6198, LZ 6451, LZ 6478A, LZ 6484, LZ 6499, LZ 6500, LZ 6501, and LZ 8504 additives (The Lubrizol Corporation); Texaco TLA-256, TLA-308A, TLA-414, TLA-674, and TLA-1421 additives (Texaco Inc.); Paranox 26, 27, 30, ECA 6354, and ECA 10658 additives (Exxon Chemical Company); Chevron OLOA 216, OLOA 216C, OLOA 216S, OLOA 218, OLOA 218A, OLOA 219, OLOA 229, OLOA 246A, OLOA 246B, OLOA 246C, OLOA 246P, OLOA 247B, and OLOA 247E additives (Chevron Chemical Company); Amoco 9217, 9218, 9220, 9221, 9230, 9231, and 9243 additives (Amoco Corporation); Shell AC 45 and AC 60 additives (Shell Chemical Company); Witco Calcinate T, Witco Calcinate T-2, Witco LSC 400, Witco Hybase LE-500, and Witco Surchem 550 (Witco Corporation). For best results on copper corrosion, those of the foregoing products having a TBN of at least about 300 should be used as component a).

Ashless dispersants suitable for use in producing component b):

HiTEC® 644 dispersant, HiTEC® 645 dispersant, HiTEC® 646 dispersant (Ethyl Petroleum Additives, Inc.; Ethyl Petroleum Additives, Ltd.; Ethyl S.A.; Ethyl Canada Ltd.); Lubrizol LZ 890, LZ 894, LZ 935, LZ 936, LZ 941, LZ 949, LZ 6401, LZ 6418, and LZ 6420 dispersants (The Lubrizol Corporation); Texaco TLA-202, TLA-646, TLA-1601, and TLA-9596A additives (Texaco Inc.); Paranox 100, 105, 106, and 107 additives (Exxon Chemical Company); Chevron OLOA 1200, OLOA 340D, OLOA 340G, OLOA 373, OLOA 373C, and OLOA 340K additives (Chevron Chemical Company); Amoco 9000 additive and Amoco 9250 additive (Amoco Corporation).

Boron-containing additives for use as component c):

HiTEC® 648 additive (Ethyl Petroleum Additives, Inc.; Ethyl Petroleum Additives, Ltd.; Ethyl S.A.; Ethyl Canada Ltd.); Amoco 9000, 9250 and 9251 additives (Amoco Corporation); Lubrizol 935 additive (The Lubrizol Corporation); Nippon Cooper NC-707 additive (Nippon Cooper Company); Paramins ECA 5024, ECA 7474, ECA 5025 (Paranox 106), ECA 8080, and ECA 10450 additives (Exxon Chemical Company).

The practice of this invention is still further illustrated by the following examples in which all parts and percentages are by weight unless otherwise specifically indicated. In these examples, the weights of the various ingredients are on an "as received" basis—i.e., the weights include solvents or diluents which are in the products as supplied. In forming the compositions described in the ensuing examples wherein a sulfurized fatty ester such as SUL-PERM 60–93 is employed, it is preferred to introduce this component as the final component.

EXAMPLE I

A crankcase lubricating oil of this invention is formed by blending together the following components:

| | |
|---|---|
| Component a)[1] | 1.40% |
| Component b)[2] | 6.20% |
| Nonylphenol sulfide[3] | 0.25% |
| Bis(p-nonylphenyl)amine[4] | 0.05% |
| Antifoam agent[5] | 0.04% |
| Process oil diluent | 1.11% |
| Viscosity index improver[6] | 5.40% |
| Sulfurized fatty ester[7] | 0.30% |
| Neutral calcium sulfonate[8] | 0.25% |
| Base oil[9] | 85.00% |
| | 100.00% |

[1]Overbased calcium sulfonate (HiTEC ® 611 additive; Ethyl Petroleum Additives, Inc.; Ethyl Petroleum Additives, Ltd., Ethyl S.A.; Ethyl Canada Ltd., a product having a nominal TBN of 300).
[2]A product formed as in Example B-10.
[3]HiTEC ® 619 additive; Ethyl Petroleum Additives, Inc.; Ethyl Petroleum Additives, Ltd.; Ethyl S.A.; Ethyl Canada Ltd.
[4]Naugalube 438L antioxidant; Uniroyal Chemical Company, Inc.
[5]Dow Corning Fluid 200; 60,000 cSt, an 8% dimethyl silicone solution from Dow Corning Company.
[6]Polymethylmethacrylate (Acryloid 954 polymer; Rohm & Haas Chemical Company).
[7]SUL-PERM 60-93 (Keil Chemical Division of Ferro Corporation).
[8]HiTEC ® 614 additive; Ethyl Petroleum Additives, Inc.; Ethyl Petroleum Additives, Ltd.; Ethyl S.A.; Ethyl Canada Ltd., a product having a nominal TBN of 30).
[9]A blend of 51% solvent refined mineral oil (Mobil MTN 736A) and 34% solvent refined mineral oil (Mobil MTN 737).

EXAMPLE II

Using the same ingredients as in Example I except where otherwise indicated, a crankcase lubricating oil of this invention is formed by blending together the following components:

| | |
|---|---|
| Component a) | 1.90% |
| Component b)[1] | 4.82% |
| Component c)[2] | 2.00% |
| Phenolic antioxidant mixture[3] | 1.00% |
| Antifoam agent | 0.01% |
| Pour point depressant[4] | 0.20% |
| Neutral calcium sulfonate[5] | 1.25% |
| Process oil diluent | 1.29% |
| Viscosity index improver | 5.30% |
| Base oil[6] | 82.23% |
| | 100.000% |

[1]A product formed as in Example B-13.
[2]Boronated succinimide dispersant (HiTEC ® 648 additive; Ethyl Petroleum Additives, Inc.; Ethyl Petroleum Additives, Ltd.; Ethyl S.A.; Ethyl Canada Ltd.)
[3]Ethyl ® antioxidant 738 diluted to a 50% solution with process oil (Ethyl Corporation; Ethyl Canada Ltd.; Ethyl S.A.).
[4]HiTEC ® 672 additive; (Ethyl Petroleum Additives, Inc.; Ethyl Petroleum Additives, Ltd.; Ethyl S.A.; Ethyl Canada Ltd.).
[5]HiTEC ® 614 additive; (Ethyl Petroleum Additives, Inc.; Ethyl Petroleum Additives, Ltd.; Ethyl S.A.; Ethyl Canada Ltd.)
[6]A blend of 65.50% Amoco SX-10 and 16.73% Amoco SX-20.

EXAMPLE III

The following components are blended together in the amounts indicated:

| | |
|---|---|
| Component a) | 1.310% |
| Component b)[1] | 7.200% |
| Nonylphenol sulfide | 0.260% |
| Bis(p-nonylphenyl) amine | 0.050% |
| Antifoam agent | 0.005% |
| Process oil diluent | 0.355% |
| Rust inhibitor | 0.450% |

-continued

| | |
|---|---|
| Viscosity index improver[2] | 10.200% |
| Neutral calcium sulfonate | 0.320% |
| Base oil[3] | 79.850% |
| | 100.000% |

[1]A product formed as in Example B-1.
[2]Texas TLA 555 additive (Texaco, Inc., a dispersant-VII copolymer).
[3]Exxon 100 Neutral Low Pour Point oil.

EXAMPLE IV

Using the same ingredients as in Example II except where otherwise indicated, a crankcase lubrication is form is invention is formed by blending together the following components:

| | |
|---|---|
| Component a) | 1.900% |
| Component b)[1] | 6.010% |
| Component c) | 2.000% |
| Neutral calcium sulfonate | 1.250% |
| Phenolic antioxidant mixture | 1.000% |
| Antifoam agent | 0.013% |
| Pour point depressant | 0.200% |
| Viscosity index improver | 5.300% |
| Process oil diluent | 1.287% |
| Base oil[2] | 81.040% |
| | 100.000% |

[1]A product formed as in Example B-11.
[2]A blend of 64.56% of Amoco SX-10 and 16.48% of Amoco SX-20 oils.

EXAMPLE V

Using the same ingredients as in Example IV except where otherwise indicated, a crankcase lubricating oil of this invention is formed by blending together the following components:

| | |
|---|---|
| Component a) | 1.900% |
| Component b)[1] | 4.820% |
| Component c) | 2.000% |
| Phenolic antioxidant mixture | 1.000% |
| Antifoam agent | 0.013% |
| Pour point depressant | 0.200% |
| Viscosity index improver | 5.300% |
| Process oil diluent | 2.537% |
| Base oil[2] | 82.230% |
| | 100.000% |

[1]A product formed as in Example B-13.
[2]A blend of 65.50% of Amoco SX-10 and 16.73% of Amoco SX-20 oils.

EXAMPLE VI

The procedures of Examples IV and V are repeated except that in each case the phenolic antioxidant mixture is eliminated, and replaced by 0.5% of a partially sulfurized mixture of tertbutyl phenols made by reacting Ethyl® antioxidant 733 with sulfur monochloride, for example, as in U.S. Pat. No. 4,946,610, and 0.5% of additional process oil.

EXAMPLE VII

The procedure of Example V is repeated using the same ingredients as therein specified except where otherwise indicated below:

| | |
|---|---|
| Component a) | 1.500% |
| Component b)[1] | 5.940% |
| Component c) | 2.310% |
| Nonylphenol sulfide | 0.500% |
| Neutral calcium sulfonate | 1.000% |
| Antifoam agent | 0.037% |
| Sulfurized fatty ester[2] | 0.500% |
| Viscosity index improver[3] | 8.500% |
| Pour point depressant | 0.400% |
| Process oil diluent | 1.583% |
| Antirust additive[4] | 0.120% |
| Base oil[5] | 77.610% |
| | 100.000% |

[1]A product formed as in Example B-10.
[2]SUL-PERM 60-93 (Keil Chemical Division of Ferro Corporation).
[3]Texaco TLA 656 additive (Texaco, Inc., a dispersant VII olefin copolymer).
[4]Sterox ND (Monsanto Company) believed to be α-(nonylphenyl)-ω-hydroxy-poly(oxy-1,2-ethanediyl).
[5]A blend of 50.45% of Mobil MTN 737B and 27.16% of Mobil MTN 736A oils.

EXAMPLE VIII

The procedure of Example VII is repeated using the same ingredients as therein specified except where otherwise indicated below:

| | |
|---|---|
| Component a) | 1.860% |
| Component b)[1] | 4.570% |
| Component c) | 2.000% |
| Nonylphenol sulfide | 0.520% |
| Neutral calcium sulfonate | 1.150% |
| Antifoam agent | 0.037% |
| Viscosity index improver[2] | 0.150% |
| Antirust additive | 0.120% |
| Process oil diluent | 1.573% |
| Base oil[3] | 88.020% |
| | 100.000% |

[1]A product formed as in Example B-13.
[2]Paramins ECA 7955 additive (Exxon Chemicals, a division of Exxon Corporation).
[3]A blend of 73.06% of Ashland 100N and 14.96% of Ashland 330 N solvent refined oils.

EXAMPLE IX

The procedures of Examples VII and VIII are repeated except that in each case the nonyl phenol sulfide is eliminated and replaced by a corresponding amount of a partially sulfurized mixture of tert-butyl phenols described in Example VI.

EXAMPLE X

A synthetic lubricant of this invention is formed by blending together the following components in the amounts specified:

| | |
|---|---|
| Component a) | 1.500% |
| Component b)[2] | 6.500% |
| Neutral calcium sulfonate[3] | 0.500% |
| Partially sulfurized tert-butyl phenols[4] | 0.500% |
| Antifoam agent[5] | 0.010% |
| Antirust additive[6] | 0.150% |
| Pour point depressant[7] | 0.300% |
| Process oil diluent | 0.710% |

-continued

| | |
|---|---|
| Viscosity index improver[8] | 4.200% |
| Base oil[9] | 85.630% |
| | 100.000% |

[1]Overbased calcium sulfonate (HiTEC ® 611 additive; Ethyl Petroleum Additives, Inc.; Ethyl Petroleum Additives, Ltd.; Ethyl S.A.; Ethyl Canada Ltd.; a product having a nominal TBN of 300).
[2]A product formed as in Example B-13.
[3]Neutral calcium sulfonate (HiTEC ® 614 additive; Ethyl Petroleum Additives, Inc.; Ethyl Petroleum Additives, Ltd.; Ethyl S.A.; Ethyl Canada Ltd.; a product having a nominal TBN of 30).
[4]A product formed by reacting ETHYL ® Antioxidant 733 with sulfur monochloride, for example as in U.S. Pat. No. 4,946,610.
[5]Dow Corning Fluid 200; 60,000 cSt, an 8% dimethyl silicone solution from Dow Corning Company.
[6]Sterox ND (Monsanto Company), believed to be a-(nonyl-phenyl)-ω-hydroxy-poly(oxy-1,2-ethanediyl).
[7]Santolube C (Monsanto Company).
[8]Texaco TLA 347A additive, (Texaco Inc.).
[9]A blend of 77.26% 8 cSt poly-α-olefin oil (ETHYLFLO 168 oil; Ethyl Corporation; Ethyl Canada Ltd.; Ethyl S.A.) and 8.37% 4 cSt poly-α-olefin oil (Emery 2921 oil; Emery Group of Henkel Corporation).

EXAMPLE XI

The procedure of Example X is repeated except that component b) is prepared as in Example B-1 and is employed at a concentration of 6.400% and the amount of process oil used is 0.770%.

EXAMPLE XII

The procedure of Example X is repeated using the same ingredients except as otherwise specified:

| | |
|---|---|
| Component a) | 1.900% |
| Component b) | 6.500% |
| Neutral calcium sulfonate | 1.250% |
| Partially sulfurized tert-butyl phenols | 0.750% |
| Bis(p-nonylphenyl)amine[1] | 0.050% |
| Antifoam agent | 0.010% |
| Antirust additive | 0.150% |
| Process oil diluent | 2.050% |
| Base oil[22] | 87.340% |
| | 100.000% |

[1]Naugalube 438L antioxidant; Uniroyal Chemical Company, Inc.
[2]A blend of 78.806% 8 cSt poly-α-olefin oil (ETHYLFLO 168 oil; Ethyl Corporation; Ethyl Canada Ltd.; Ethyl S.A.) and 8.534% 40 cSt poly-α-olefin oil (ETHYLFLO 174 oil; Ethyl Corporation; Ethyl Canada Ltd.; Ethyl S.A.).

EXAMPLE XIII

The procedure of Example XII is repeated using the same ingredients except where otherwise specified:

| | |
|---|---|
| Component a) | 1.900% |
| Component b) | 6.500% |
| Neutral calcium sulfonate | 1.250% |
| Partially sulfurized tert-butyl phenols | 0.750% |
| Bis(p-nonylphenyl)amine | 0.050% |
| Antifoam agent | 0.010% |
| Viscosity index improver[1] | 7.200% |

-continued

| | |
|---|---|
| Process oil diluent | 0.260% |
| Base oil[2] | 82.080% |
| | 100.000% |

[1]Paratone 715 (Exxon Chemical Company).
[2]A blend of 69.77% 8 cSt poly-α-olefin oil (ETHYLFLO 168 oil; Ethyl Corporation; Ethyl Canada Ltd.; Ethyl S.A.) and 12.31% 40 cSt poly-α-olefin oil (ETHYLFLO 174 oil; Ethyl Corporation; Ethyl Canada Ltd.; Ethyl S.A.).

EXAMPLE XIV

An additive concentrate of this invention is formed by blending together the following components as identified in Example I:

| | |
|---|---|
| Component a) | 14.58% |
| Component b) | 64.58% |
| Neutral calcium sulfonate | 2.60% |
| Nonylphenol sulfide | 2.60% |
| Bis(p-nonylphenyl)amine | 0.52% |
| Antifoam agent | 0.42% |
| Sulfurized fatty ester | 3.13% |
| Process oil diluent | 11.57% |
| | 100.00% |

EXAMPLE XV

An additive concentrate of this invention is formed by blending together the following components as identified in Example II:

| | |
|---|---|
| Component a) | 14.17% |
| Component b) | 44.44% |
| Component c) | 14.91% |
| Phenolic antioxidant mixture | 7.46% |
| Neutral calcium sulfonate | 9.32% |
| Antifoam agent | 0.07% |
| Process oil diluent | 9.63% |
| | 100.00% |

EXAMPLE XVI

An additive concentrate of this invention is formed by blending together the following components as identified in Example IV:

| | |
|---|---|
| Component a) | 14.12% |
| Component b) | 44.65% |
| Component c) | 14.86% |
| Neutral calcium sulfonate | 9.29% |
| Phenolic antioxidant mixture | 7.43% |
| Antifoam agent | 0.10% |
| Process oil diluent | 9.55% |
| | 100.00% |

EXAMPLE XVII

An additive concentrate of this invention is formed by blending together the following components as identified in Example V:

| | |
|---|---|
| Component a) | 15.48% |
| Component b) | 39.28% |
| Component c) | 16.30% |
| Phenolic antioxidant mixture | 8.15% |
| Antifoam agent | 0.11% |
| Process oil diluent | 20.68% |
| | 100.00% |

EXAMPLE XVIII

An additive concentrate of this invention is formed by blending together the following components as identified in Example VII:

| | |
|---|---|
| Component a) | 11.12% |
| Component b) | 44.04% |
| Component c) | 17.12% |
| Nonyl phenol sulfide | 3.71% |
| Neutral calcium sulfonate | 7.41% |
| Antifoam agent | 0.27% |
| Sulfurized fatty ester | 3.71% |
| Antirust additive | 0.89% |
| Process oil diluent | 11.73% |
| | 100.00% |

EXAMPLE XIX

An additive concentrate of this invention is formed by blending together the following components as identified in Example VIII:

| | |
|---|---|
| Component a) | 15.72% |
| Component b) | 38.63% |
| Component c) | 16.91% |
| Nonyl phenol sulfide | 4.40% |
| Neutral calcium sulfonate | 9.72% |
| Antifoam agent | 0.31% |
| Antirust additive | 1.01% |
| Process oil diluent | 13.30% |
| | 100.00% |

EXAMPLE XX

An additive concentrate of this invention is formed by blending together the following components:

| | |
|---|---|
| Component a)[1] | 14.43% |
| Component b)[2] | 81.41% |
| Nonyl phenol sulfide | 2.81% |
| Bis(p-nonylphenyl)amine[3] | 0.50% |
| Antifoam agent[4] | 0.05% |
| Process oil diluent | 0.80% |
| | 100.00% |

[1]Overbased calcium sulfonate (HiTEC ® 611 additive; Ethyl Petroleum Additives, Inc.; Ethyl Petroleum Additives, Ltd.; Ethyl S.A.; Ethyl Canada Ltd.; a product having a nominal TBN of 300).
[2]A product formed as in Example B-9.
[3]HiTEC ® 619 additive; (Ethyl Petroleum Additives, Inc.; Ethyl Petroleum Additives, Ltd.; Ethyl S.A.; Ethyl Canada Ltd.).
[4]Naugalube 438L antioxidant; Uniroyal Chemical Company, Inc.
[5]Dow Corning Fluid 200; 60,000 cSt, an 8% dimethyl silicone solution from Dow Corning Company.

A lubricant composition of this invention is formed by blending the above concentrate and a viscosity index improver in a base oil as follows:

| | |
|---|---|
| Above additive concentrate | 9.979% |
| Viscosity index improver[1] | 7.000% |
| Base oil[2] | 83.021% |
| | 100.000% |

[1]Polymethylmethacrylate viscosity index improver (Acryloid 953 polymer; Rohm & Haas Chemical Company).
[2]A blend of 62.05% Turbine 5 oil (a 100 Solvent Neutral refined mineral oil) and 20.971% Esso Canada MCT-10 oil (a 150 Solvent Neutral refined mineral oil).

EXAMPLE XXI

An additive concentrate of this invention is formed by blending together the components as identified in Example XX, except as otherwise indicated, in the following proportions:

| | |
|---|---|
| Component a) | 15.48% |
| Component b)[1] | 39.28% |
| Component c)[2] | 16.30% |
| Antifoam agent | 0.11% |
| Phenolic antioxidant mixture[3] | 8.15% |
| Process oil diluent | 20.68% |
| | 100.00% |

[1]A product formed as in Example B-13.
[2]HiTEC ® 648 additive (Ethyl Petroleum Additives, Inc.; Ethyl Petroleum Additives, Ltd.; Ethyl S.A.; Ethyl Canada Ltd.).
[3]Ethyl ® Antioxidant 738 (Ethyl Corporation; Ethyl Canada Ltd.; Ethyl S.A.) diluted to a 50% solution in process oil.

A lubricant composition of this invention is formed by blending the above concentrate, a viscosity index improver, and a pour point depressant in a base oil described below:

| | |
|---|---|
| Above additive concentrate | 12.270% |
| Viscosity index improver[1] | 5.300% |
| Pour point depressant[2] | 0.200% |
| Base oil[3] | 82.230% |
| | 100.000% |

[1]Polymethacrylate viscosity index improver (Acryloid 95% polymer; Rohm & Haas Chemical Company).
[2]Sterox ND (Monsanto Company), believed to be α-(nonyl-phenyl)-ω-hydroxy-poly(oxy-1,2-ethanediyl).
[3]A blend of 65.504% of Amoco SX-10 and 16.726% of Amoco SX-20 oils.

EXAMPLE XXII

A lubricant of this invention is formed by blending together the components as identified in Example XXI, except as otherwise indicated, in the following proportions:

| | |
|---|---|
| Component a) | 1.900% |
| Component b)[1] | 3.880% |
| Component c)[2] | 2.330% |
| Component c)[3] | 0.670 |
| Neutral calcium sulfonate[4] | 1.250% |
| Antifoam agent | 0.013% |
| Bis(p-nonylphenyl)amine[5] | 0.050% |
| Phenolic antioxidant mixture | 1.000% |
| Process oil diluent | 1.287% |
| Pour point depressant[6] | 0.200% |

-continued

| | |
|---|---|
| Viscosity index improver[7] | 10.700% |
| Base oil[8] | 76.720% |
| | 100.00% |

[1]A product formed as in Example B-10.
[2]A product formed as in Example C-8.
[3]HiTEC ® 648 additive (Ethyl Petroleum Additives, Inc.; Ethyl Petroleum Additives, Ltd.; Ethyl S.A.; Ethyl Canada Ltd.).
[4]HiTEC ® 614 additive (Ethyl Petroleum Additives, Inc.; Ethyl Petroleum Additives, Ltd.; Ethyl S.A.; Ethyl Canada Ltd.).
[5]Naugalube 438L antioxidant; Uniroyal Chemical Company, Inc.
[6]Sterox ND (Monsanto Company), believed to be α-(nonyl-phenyl)-ω-hydroxy-poly(oxy-1,2-ethanediyl).
[7]Amoco 6565 viscosity index improver.
[8]A blend of 56.006% of Amoco SX-10 and 20.714% of Amoco SX-20 oils.

The following test results illustrate some of the advantages achievable by the practice of this invention.

A preblend was made composed by weight of 0.10% Ethomeen T-12, 0.80% SUL-PERM 307, 0.15% HiTEC® 672 additive; 0.04% HiTEC® 314 additive; 0.03% Dow Corning Fluid 200 (an 8% dimethylsilicone solution), 0.26% Naugalube 438L antioxidant, 0.03% M-544 (Monsanto Chemical Co.), 0.05% Mazawet 77, 0.05% Pluradyne 5151, 0.25% process oil and 83.10% Exxon 1365 mineral oil. These blends were made using this preblend as follows:

| | Blend A | Blend B | Blend C |
|---|---|---|---|
| Component a)[1] | 1.30% | 0.65% | none |
| Component b)[2] | 5.80% | 2.90% | 2.90% |
| Neutral calcium sulfonate[3] | 0.30% | 0.15% | 2.93% |
| Preblend | 90.86% | 90.86% | 90.85% |
| Mineral oil[4] | 1.74% | 5.44% | 3.31% |
| | 100.00% | 100.00% | 100.00% |

[1]HiTEC ® 619 additive; Ethyl Petroleum Additives, Inc.; Ethyl Petroleum Additives, Ltd.; Ethyl S.A.; Ethyl Canada Ltd.
[2]A product formed as in example B-13.
[3]A blend of 51% solvent refined mineral oil (Mobil MTN 736A) and 34% solvent refined mineral oil (Mobil MTN 737).

The approximate TBN's of Blends A, B and C. (based only in the content of calcium detergents used) were, respectively, 4, 2 and 0.8. Each blend had a Ca:P atom ratio of 2.7:1.

Blends A, B and C. were subjected to the Panel Coker Test: in which weighted test panels were maintained in the blends at 575° F. for 3.5 hours. On completion of the tests, the panels were reweighed to determine the weight of deposits which were laid down on the panels. The increase in panel weights for Blends A, B and C. were, respectively, 0.0609 grams, 0.0693 grams and 0.947 grams. The visual appearance (deposits and varnish) of the panels and panel holders was significantly better for Blends A and B, than C.

Duplicate tests were conducted according to the Caterpillar® 1G(2) procedure, except that the runs were arbitrarily terminated after 120 hours. The composition tested was as follows:

| | |
|---|---|
| Component a[1] | 2.500% |
| Component b[2] | 6.300% |
| Neutral calcium sulfonate[4] | 1.600% |
| Phenolic antioxidant mixture[4] | 1.750% |
| Bis(p-nonylphenyl)amine[5] | 0.100% |
| Sulfurized fatty ester[6] | 0.300% |
| Antifoam agent[7] | 0.007% |

-continued

| | |
|---|---|
| Process oil | 1.753% |
| Viscosity index improver[8] | 10.500% |
| Base oil[9] | 75.190% |
| | 100.00% |

[1]HiTEC ® 619 additive; Ethyl Petroleum Additives, Inc.; Ethyl Petroleum Additives, Ltd.; Ethyl S.A.; Ethyl Canada Ltd.
[2]A product formed as in Example B-12.
[3]A blend of 51% solvent refined mineral oil (Mobil MTN 736A) and 34% solvent refined mineral oil (Mobil MTN 737).
[4]Ethyl ® antioxidant 738 diluted to a 50% solution with process oil (Ethyl Corporation; Ethyl Canada Ltd.; Ethyl S.A.).
[5]Dow Corning Fluid 200; 60,000 cSt, and 8% dimethyl silicone solution from Dow Corning Company.
[6]HiTEC ® 614 additive; Ethyl Petroleum Additives, Inc.; Ethyl Petroleum Additives, Ltd.; Ethyl S.A.; Ethyl Canada Ltd., a product having a nominal TBN of 30).
[7]Polymethylmethacrylate (Acryloid 954 polymer; Rohm & Haas Chemical Company).
[8]Shell SV-40 viscosity index improver (Shell Chemical Co.).
[9]A mixture 71.280% of Valvoline 100 Solvent Neutral oil and 3.910% of Valvoline 300 Solvent Neutral oil.

In the first run the total weighted demerits was equal to 122.7 and the top groove fill was 0%. Some scuffing was noted on the piston. In the second run the total weighted demerits was equal to 274.6 and the top groove fill was 58%. No piston scuffing was observed. The passing limits for a 480-hour test are 300 total weighted demerits maximum, and 80% top groove fill maximum.

An evaluation of copper corrosion was conducted according to ASTM D-130 but under more severe conditions, viz., operation at 121° C. rather than at the standard temperature of 100° C. In this test, component a) was HiTEC® 611 additive, component b) was a product made as in Example B-11, component c) was HiTEC® 614 additive, the antifoam agent was Dow Corning Fluid 200, and the base oil was Turbine 5 oil. The makeup of the composition was as follows:

| | |
|---|---|
| Component a) | 1.40% |
| Component b) | 3.00% |
| Component c) | 2.00% |
| Neutral calcium sulfonate | 0.30% |
| Antifoam agent | 0.01% |
| Process oil | 0.62% |
| Base oil | 92.67% |
| | 100.00% |

The composition exhibited a rating of 1.b.

In U.S. Pat. No. 4,873,004 it is pointed out that to achieve improved dispersancy properties it is necessary to have a molar ratio of succinic groups to alkenyl groups (sometimes referred to as the "succination ratio") of at least 1.4 when using succinimides made from polyamines such as tetraethylene pentamine and polyisobutenyl succinic anhydrides having number average molecular weights in the range of 600 to 1,300. For example the patent shows in its Tables 3 and 4 that with succinimide derived from polyisobutylene of number average molecular weight of 950, maleic anhydride and tetraethylene pentamine, products having a succination ratio of 1.0 gave inferior results on dispersancy and varnish formation than corresponding succinimides in which the succination ratio was 1.8. Yet, a phosphorylated polyisobutenyl succinimide with a succination ratio of about 1.18 made from polyisobutene of number average molecular weight of about 950, can give good results both on dispersancy and on wear prevention.

As used in the foregoing description, the term "oil-soluble" is used in the sense that the component in question has sufficient solubility in the selected base oil in order to dissolve therein at ordinary temperatures to a concentration at least equivalent to the minimum concentration specified herein for use of such component. Preferably, however, the solubility of such component in the selected base oil will be in excess of such minimum concentration, although there is no requirement that the component be soluble in the base oil in all proportions. As is well known to those skilled in the art, certain useful additives do not completely dissolve in base oils but rather are used in the form of stable suspensions or dispersions. Additives of this type can be employed in the compositions of this invention, provided they do not significantly interfere with the performance or usefulness of the composition in which they are employed.

As can be appreciated from the foregoing description, this invention comprises a substantial number of individual embodiments possessing advantageous characteristics. Some of these embodiments are, for convenience, summarized below.

Oleaginous Compositions

AA. A lubricant or functional fluid composition which comprises a major proportion of at least one oil of lubricating viscosity and a minor proportion of at least the following components:

a) at least one oil-soluble overbased alkali or alkaline earth metal-containing detergent having a TBN of at least 200; and b) one or more oil-soluble boron-free additive compositions formed by heating (i) at least one boron-free oil-soluble ashless dispersant containing basic nitrogen and/or at least one hydroxyl group, with (ii) at least one inorganic phosphorus acid such that a liquid boron-free phosphorus-containing composition is formed; components a) and b) being proportioned such that the atom ratio of metal in the form of component a) to phosphorus in the form of component b) falls in the range of about 0.02:1 to about 1,000:1, preferably in the range of about 0.05:1 to about 150:1, and most preferably in the range of about 0.1:1 to about 15:1.

AB. A composition of AA wherein component b) is further characterized in that said at least one ashless dispersant which is used in forming component b) consists essentially of (i) at least one hydrocarbyl succinamide, or (2) at least one hydrocarbyl-substituted succinic ester-amide, or (3) at least one hydroxyester of hydrocarbyl succinic acid, or (4) at least one Mannich condensation product of hydrocarbyl-substituted phenol, formaldehyde and polyamine, or (5) at least one hydrocarbyl succinimide, or any combination of any two, or any three, or any four, or all five (1), (2), (3), (4) and (5).

AC. A composition of AA wherein component b) is further characterized in that said at least one ashless dispersant which is used in forming component b) consists essentially of at least one carboxylic ashless dispersant, optionally a boron-free, post-treated ashless dispersant, and preferably is at least one boron-free succinimide ashless dispersant which contains at least basic nitrogen.

AD. A composition of AA wherein component b) is further characterized in that said at least one ashless dispersant which is used in forming component b) consists essentially of at least one acyclic hydrocarbyl-substituted succinimide of a mixture of ethylene polyamines having an approximate overall composition falling in the range corresponding to diethylene triamine to pentaethylene hexamine.

AE. A composition of AD wherein the acyclic hydrocarbyl substituent of said at least one acyclic hydrocarbyl-substituted succinimide is a polyalkenyl group having an average of at least 30 carbon atoms.

AF. A composition of AE wherein said polyalkenyl group is a polyisobutenyl group.

AG. A composition of AE wherein said polyalkenyl group is a polyisobutenyl group derived from polyisobutene having a number average molecular weight in the range of about 600 to about 1,300, preferably in the range of about 700 to about 1,250, and more preferably in the range of about 800 to about 1,200.

AH. A composition of AC wherein said at least one ashless dispersant consists essentially of at least one succinimide ashless dispersant having a succination ratio of 1:1 to about 1.3:1.

AI. A composition of AD wherein said at least one ashless less dispersant consists essentially of at least one succinimide ashless dispersant having a succination ratio of 1:1 to about 1.3:1.

AJ. A composition of AE wherein said at least one ashless dispersant consists essentially of at least one succinimide ashless dispersant having a succination ratio of 1:1 to about 1.3:1.

AK. A composition of AF wherein said at least one ashless dispersant consists essentially of at least one succinimide ashless dispersant having a succination ratio of 1:1 to about 1.3:1.

AL. A composition of AG wherein said at least one ashless dispersant consists essentially of at least one succinimide ashless dispersant having a succination ratio of 1:1 to about 1.3:1.

AM. A composition of any of AA through AL wherein component a) consists essentially of one or more oil-soluble overbased alkali or alkaline earth metal-containing detergents having a TBN of at least 250.

AN. A composition of any of AA through AL wherein component a) consists essentially of one or more oil-soluble overbased alkali or alkaline earth metal-containing detergents having a TBN of at least 300.

AO. A composition of any of AA through AL wherein component a) consists essentially of one or more oil-soluble overbased alkali or alkaline earth metal-containing detergents having a TBN of at least 400.

AP. A composition of any of AA through AO wherein component a) consists essentially of one or more oil-soluble overbased based alkali or alkaline earth metal-containing sulfonates.

AQ. A composition of any of AA through AO wherein component a) consists essentially of (1) at least one calcium sulfonate or (2) at least one magnesium sulfonate, or a combination of (1) and (2).

AR. A composition of any of AA through AQ further comprising a minor proportion of at least one oil-soluble or oil-dispersible boron-containing additive component.

AS. A composition of any of AA through AQ further comprising a minor proportion of at least one oil-soluble boronated ashless dispersant.

AT. A composition of any of AA through AQ further comprising a minor proportion of at least one oil-soluble boronated ashless dispersant which consists essentially of (1) at least one hydrocarbyl succinamide, or (2) at least one hydrocarbyl-substituted succinic ester-amide, or (3) at least one hydroxyester of hydrocarbyl succinic acid, or (4) at least one Mannich condensation product of hydrocarbyl-substituted phenol, formaldehyde and polyamine, or (5) at least one hydrocarbyl succinimide, or any combination of any two, or any three, or any four, or all five (1), (2), (3), (4)and (5).

AU. A composition of any of AA through AQ further comprising a minor proportion of at least one oil-soluble boronated ashless dispersant which consists essentially of at least one boronated carboxylic ashless dispersant, and preferably is at least one boronated succinimide ashless dispersant which contains at least basic nitrogen.

AV. A composition of any of AA through AQ further comprising a minor proportion of at least one oil-soluble boronated ashless dispersant which consists essentially of at least one boron-containing acyclic hydrocarbyl-substituted succinimide of a mixture of ethylene polyamines having an approximate overall composition falling in the range corresponding to diethylene triamine to pentaethylene hexamine.

AW. A composition of any of AA through AQ further comprising a minor proportion of at least one oil-soluble boronated. ashless dispersant which consists essentially of at least one boron-containing polyalkenyl-substituted succinimide of a mixture of ethylene polyamines having an approximate overall composition. falling in the range corresponding to diethylene triamine to pentaethylene hexamine, the polyalkenyl substituent of such boron-containing succinimide having an average of at least 30 carbon atoms.

AX. A composition of any of AA through AQ further comprising a minor proportion of at least one oil-soluble boronated ashless dispersant which consists essentially of at least one boron-containing polyisobutenyl-substituted succinimide of a mixture of ethylene polyamines having an approximate overall composition falling in the range corresponding to diethylene triamine to pentaethylene hexamine, the polyisobutenyl substituent of such boron-containing succinimide having an average of at least 30 carbon atoms.

AY. A composition of any of AA through AQ further comprising a minor proportion of at least one oil-soluble boronated ashless dispersant which consists essentially of at least one boron-containing polyisobutenyl-substituted succinimide of a mixture of ethylene polyamines having an approximate overall composition falling in the range corresponding to diethylene triamine to pentaethylene hexamine, the polyisobutenyl substituent of such boron-containing succinimide being derived from polyisobutene having a number average molecular weight in the range of about 600 to about 1,300, preferably in the range of about 700 to about 1,250, and more preferably in the range of about 800 to about 1,200.

AZ. A composition of any of AA through AQ further comprising a minor proportion of at least one oil-soluble boronated ashless dispersant which consists essentially of at least one boron-containing polyalkenyl-substituted succinimide of a mixture of ethylene polyamines having an approximate overall composition falling in the range corresponding to diethylene triamine to pentaethylene hexamine, the boron-containing succinimide having a succination ratio of 1:1 to about 1.3:1 and the polyalkenyl substituent of such boron-containing succinimide having an average of at least 30 carbon atoms.

AAA. A composition of any of AA through AQ further comprising a minor proportion of at least one oil-soluble boronated ashless dispersant which consists essentially of at least one boron-containing polyisobutenyl-substituted succinimide of a mixture of ethylene polyamines having an approximate overall composition falling in the range corresponding to diethylene triamine to pentaethylene hexamine, the boron-containing succinimide having a succination ratio of 1:1 to about 1.3:1 and the polyisobutenyl substituent of such boron-containing succinimide being derived from polyisobutene having a number average molecular weight in the range of about 600 to about 1,300, preferably in the range of about 700 to about 1,250, and more preferably in the range of about 800 to about 1,200.

AAB. Any composition of any of AA through AAA wherein the total halogen content, if any, of the overall composition does not exceed 100 ppm.

AAC. Any composition of any of AA through AAB further comprising at least one oil-soluble antioxidant and at least one corrosion inhibitor such that and with the proviso that such composition satisfies (1) the requirements of the Sequence IID, Sequence IIIE, and Sequence VE procedures of the American Petroleum Institute in the form specified herein; and/or (2) the requirements of the L-38 Test Procedure of the American Petroleum Institute in the form specified herein; and/or (3) the requirements of the Caterpillar® 1G(2) Test Procedure and/or the Caterpillar® 1H(2) Test Procedure in the form specified herein.

AAD. Any composition of AAC that satisfies any two of (1), (2), and (3) as therein specified.

AAE. Any composition of AAC that satisfies all three of (1), (2), and (3) as therein specified.

AAF. A composition of any of AA through AAE wherein (i) used in forming component b) is one or more sulfur-free inorganic phosphorus acids.

AAG. A composition of any of AA through AAE wherein (i.) used in forming component b) is phosphorous acid, $H_3PO_3$.

AAH. A composition of any of AA through AAG characterized in that it is devoid of any added component which contains a heavy metal, such as for example, zinc.

AAI. Any composition of AA through AAH wherein the composition contains at least about 0.03% of phosphorus, preferably at least about 0.04% of phosphorus, more preferably at least about 0.05% of phosphorus, and most preferably at least about 0.06% of phosphorus, as component b).

Additive Concentrates

BA. An additive concentrate composition which comprises, in combination, at least the following components:

a) at least one oil-soluble overbased alkali or alkaline earth metal-containing detergent having a TBN of at least 200; and b) one or more oil-soluble boron-free additive compositions formed by heating (i) at least one boron-free oil-soluble ashless dispersant containing basic nitrogen and/or at least one hydroxyl group, with (ii) at least one inorganic phosphorus acid such that a liquid boron-free phosphorus-containing composition is formed; components a) and b) being proportioned such that the atom ratio of metal in the form of component a) to phosphorus in the form of component b) falls in the range of about 0.02:1 to about 1,000:1, preferably in the range of about 0.05:1 to about 150:1, and most preferably in the range of about 0.1:1 to about 15:1.

BB. A composition of BA wherein component b) is further characterized in that said at least one ashless dispersant which is used in forming component b) consists essentially of (i) at least one hydrocarbyl succinamide, or (2) at least one hydrocarbyl-substituted succinic ester-amide, or (3) at least one hydroxyester of hydrocarbyl succinic acid, or (4) at least one Mannich condensation product of hydrocarbyl-substituted phenol, formaldehyde and polyamine, or (5) at least one hydrocarbyl succinimide, or any combination of any two, or any three, or any four, or all five (1), (2), (3), (4) and (5).

BC. A composition of BA wherein component b) is further characterized in that said at least one ashless dispersant which is used in forming component b) consists essentially of at least one carboxylic ashless dispersant, optionally a boron-free, post-treated ashless dispersant, and preferably is at least one boron-free succinimide ashless dispersant which contains at least basic nitrogen.

BD. A composition of BA wherein component b) is further characterized in that said at least one ashless dispersant which is used in forming component b) consists essentially of at least one acyclic hydrocarbyl-substituted succinimide of a mixture of ethylene polyamines having an approximate overall composition falling in the range corresponding to diethylene triamine to pentaethylene hexamine.

BE. A composition of BD wherein the acyclic hydrocarbyl substituent of said at least one acyclic hydrocarbyl-substituted succinimide is a polyalkenyl group having an average of at least 30 carbon atoms.

BF. A composition of BE wherein said polyalkenyl group is a polyisobutenyl group.

BG. A composition of BE wherein said polyalkenyl group is a polyisobutenyl group derived from polyisobutene having a number average molecular weight in the range of about 600 to about 1,300, preferably in the range of about 700 to about 1,250, and more preferably in the range of about 800 to about 1,200.

BH. A composition of BC wherein said at least one ashless less dispersant consists essentially of at least one succinimide ashless dispersant having a succination ratio of 1:1 to about 1.3:1.

BI. A composition of BD wherein said at least one ashless dispersant consists essentially of at least one succinimide ashless dispersant having a succination ratio of 1:1 to about 1.3:1.

BJ. A composition of BE wherein said at least one ashless less dispersant consists essentially of at least one succinimide ashless dispersant having a succination ratio of 1:1 to about 1.3:1.

BK. A composition of BF wherein said at least one ashless dispersant consists essentially of at least one succinimide ashless dispersant having a succination ratio of 1:1 to about 1.3:1.

BL. A composition of BG wherein said at least one ashless dispersant consists essentially of at least one succinimide ashless dispersant having a succination ratio of 1:1 to about 1.3:1.

BM. A composition of any of BA through BL wherein component a) consists essentially of one or more oil-soluble overbased alkali or alkaline earth metal-containing detergents having a TBN of at least 250.

BN. A composition of any of BA through BL wherein component a) consists essentially of one or more oil-soluble overbased alkali or alkaline earth metal-containing detergents having a TBN of at least 300.

BO. A composition of any of BA through BL wherein component a) consists essentially of one or more oil-soluble overbased alkali or alkaline earth metal-containing detergents having a TBN of at least 400.

BP. A composition of any of BA through BO wherein component a) consists essentially of one or more oil-soluble overbased alkali or alkaline earth metal-containing sulfonates.

BQ. A composition of any of BA through BO wherein component a) consists essentially of (1) at least one calcium sulfonate or (2) at least one magnesium sulfonate, or a combination of (1) and (2).

BR. A composition of any of BA through BQ further comprising a minor proportion of at least one oil-soluble or oil-dispersible boron-containing additive component.

BS. A composition of any of BA through BQ further comprising a minor proportion of at least one oil-soluble boronated ashless dispersant.

BT. A composition of any of BA through BQ further comprising a minor proportion of at least one oil-soluble boronated ashless dispersant which consists essentially of (1) at least one hydrocarbyl succinamide, or (2) at least one hydrocarbyl-substituted succinic ester-amide, or (3) at least one hydroxyester of hydrocarbyl succinic acid, or (4) at least one Mannich condensation product of hydrocarbyl-substituted phenol, formaldehyde and polyamine, or (5) at least one hydrocarbyl succinimide, or any combination of any two, or any three, or any four, or all five (1), (2), (3), (4)and (5).

BU. A composition of any of BA through BQ further comprising a minor proportion of at least one oil-soluble boronated ashless dispersant which consists essentially of at least one boronated carboxylic ashless dispersant, and preferably is at least one boronated succinimide ashless dispersant which contains at least basic nitrogen.

BV. A composition of any of BA through BQ further comprising a minor proportion of at least one oil-soluble boronated ashless dispersant which consists essentially of at least one boron-containing acyclic hydrocarbyl-substituted succinimide of a mixture of ethylene polyamines having an approximate overall composition falling in the range corresponding to diethylene triamine to pentaethylene hexamine.

BW. A composition of any of BA through BQ further comprising a minor proportion of at least one oil-soluble boronated ashless dispersant which consists essentially of at least one boron-containing polyalkenyl-substituted succinimide of a mixture of ethylene polyamines having an approximate overall composition falling in the range corresponding to diethylene triamine to pentaethylene hexamine, the polyalkenyl substituent of such boron-containing succinimide having an average of at least 30 carbon atoms.

BX. A composition of any of BA through BQ further comprising a minor proportion of at least one oil-soluble boronated ashless dispersant which consists essentially of at least one boron-containing polyisobutenyl-substituted succinimide of a mixture of ethylene polyamines having an approximate overall composition falling in the range corresponding to diethylene triamine to pentaethylene hexamine, the polyisobutenyl substituent of such boron-containing succinimide having an average of at least 30 carbon atoms.

BY. A composition of any of BA through BQ further comprising a minor proportion of at least one oil-soluble boronated ashless dispersant which consists essentially of at least one boron-containing polyisobutenyl-substituted succinimide of a mixture of ethylene polyamines having an approximate overall composition falling in the range corresponding to diethylene triamine to pentaethylene hexamine, the polyisobutenyl substituent of such boron-containing succinimide being derived from polyisobutene having a number average molecular weight in the range of about 600 to about 1,300, preferably in the range of about 700 to about 1,250, and more preferably in the range of about 800 to about 1,200.

BZ. A composition of any of BA through BQ further comprising a minor proportion of at least one oil-soluble boronated ashless dispersant which consists essentially of at least one boron-containing polyalkenyl-substituted succinimide of a mixture of ethylene polyamines having an approximate overall composition. falling in the range corresponding to diethylene triamine to pentaethylene hexamine, the boron-containing succinimide having a succination ratio of 1:1 to about 1.3:1 and the polyalkenyl substituent of such boron-containing succinimide having an average of at least 30 carbon atoms.

BBA. A composition of any of BA through BQ further comprising a minor proportion of at least one oil-soluble boronated ashless dispersant which consists essentially of at least one boron-containing polyisobutenyl-substituted succinimide of a mixture of ethylene polyamines having an approximate overall composition falling in the range corresponding to diethylene triamine to pentaethylene hexamine, the boron-containing succinimide having a succination ratio of 1:1 to about 1.3:1 and the polyisobutenyl substituent of such boron-containing succinimide being derived from polyisobutene having a number average molecular weight in the range of about 600 to about 1,300, preferably in the range of about 700 to about 1,250, and more preferably in the range of about 800 to about 1,200.

BBB. Any composition of any of BA through BBA which, if dissolved in a halogen-free base oil, at a concentration of 10% by weight, yields an oleaginous composition in which the total halogen content, if any, is 100 ppm or less.

BBC. Any composition of any of BA through BBB further comprising at least one oil-soluble antioxidant and at least one corrosion inhibitor such that and with the proviso that such composition when dissolved in a base oil in minor proportion provides a lubricant which satisfies (1) the requirements of the Sequence IID, Sequence IIIE, and Sequence VE procedures of the American Petroleum Institute in the form specified herein; and/or (2) the requirements of the L-38 Test Procedure of the American Petroleum Institute in the form specified herein; and/or (3) the requirements of the Caterpillar® 1G(2) Test Procedure and/or the Caterpillar® 1H(2) Test Procedure in the form specified herein.

BBD. Any composition of BBC that satisfies any two of (1), (2), and (3) as therein specified.

BBE. Any composition of BBC that satisfies all three of (1), (2), and (3) as therein specified.

BBF. A composition of any of BA through BBE wherein (i) used in forming component b) is one or more sulfur-free inorganic phosphorus acids.

BBG. A composition of any of BA through BBE wherein (i) used in forming component b) is phosphorous acid, $H_3PO_3$.

BBH. A composition of any of BA through BBG characterized in that it is devoid of any added component which contains a heavy metal, such as for example, zinc.

BBI. Any composition of any of BA through BBH wherein the composition is comprised of a major amount of additive components including those specified in whichever of BA through BBH is being referenced, and a minor amount of at least one diluent oil.

Preparation and/or Use

CA. In a method of formulating a lubricant or functional fluid wherein a plurality of additive components are blended into an oil of lubricating viscosity, the improvement wherein the additive components blended into said oil comprise a) at least one. overbased alkali or alkaline earth metal-containing detergent having a TBN of at least 200; and b) one or more oil-soluble boron-free additive compositions formed by heating (i) at least one boron-free oil-soluble ashless dispersant containing basic nitrogen and/or at least one hydroxyl group, with (ii) at least one inorganic phosphorus acid such that a liquid boron-free phosphorus-containing composition is formed; components a) and b) being proportioned such that the atom ratio of metal in the form of component a) to phosphorus in the form of component b) falls in the range of about 0.02:1 to about 1,000:1, preferably in the range of about 0.05:1 to about 150:1, and most preferably in the range of about 0.1:1 to about 15:1.

CB. The improvement according to CA wherein at least a portion of said liquid oil-soluble composition is blended into said oil of lubricating viscosity concurrently with at least a portion of said at least one oil-soluble overbased alkali or alkaline earth-metal containing detergent.

CC. The improvement according to CA wherein substantially all of said liquid oil-soluble composition is blended into said oil of lubricating viscosity concurrently with substantially all of said at least one oil-soluble overbased alkali or alkaline earth-metal containing detergent.

CD. The improvement according to CA wherein said detergent is comprised of at least one oil-soluble overbased alkali or alkaline earth metal-containing detergent having a TBN of at least 250.

CE. The improvement according to CA wherein said detergent is comprised of at least one oil-soluble overbased alkali or alkaline earth metal-containing detergent having a TBN of at least 300.

CF. The improvement according to CA wherein said detergent is comprised of at least one oil-soluble overbased alkali or alkaline earth metal-containing detergent having a TBN of at least 400.

CG. The improvement according to CA wherein said detergent is comprised of at least one oil-soluble overbased alkali alkaline earth metal-containing sulfonate.

CH. The improvement according to CA wherein said detergent is comprised of at least one oil-soluble overbased alkali or alkaline earth metal-containing sulfonate having a TBN of at least 250.

CI. The improvement according to CA wherein said detergent consists essentially of at least one oil-soluble overbased alkali or alkaline earth metal-containing detergent in which the metal is selected from lithium, sodium, potassium, magnesium, and calcium.

CJ. The improvement according to CA wherein said detergent consists essentially of at least one oil-soluble overbased alkali or alkaline earth metal-containing sulfonate in which the metal is selected from lithium, sodium, potassium, magnesium, and calcium.

CK. The improvement according to CA wherein said detergent consists essentially of (1) at least one oil-soluble overbased based calcium sulfonate having a TBN of at least 300, or (2) at least one oil-soluble overbased magnesium sulfonate having a TBN of least 300, or (3) a combination of (1) and (2).

CL. The improvement according to CA wherein said detergent consists essentially of a combination of (1) at least one oil-soluble overbased calcium or magnesium sulfonate having a TBN of at least 300, or a mixture thereof, and (2) at least one oil-soluble overbased calcium or magnesium alkyl phenate having a TBN of at least 200, or a mixture thereof.

CM. The improvement according to any of CA through CL wherein said at least one ashless dispersant which is used in forming said liquid boron-free phosphorus-containing composition consists essentially of (1) at least one hydrocarbyl succinamide, or (2) at least one hydrocarbyl-substituted succinic ester-amide, or (3) at least one hydroxyester of hydrocarbyl succinic acid, or (4) at least one Mannich condensation product of hydrocarbyl-substituted phenol, formaldehyde and polyamine, or (5) at least one hydrocarbyl succinimide, or any combination of any two, or any three, or any four, or all five (1), (2), (3), (4) and (5).

CN. The improvement according to any of CA through CL wherein said at least one ashless dispersant which is used in forming said liquid boron-free phosphorus-containing composition consists essentially of at least one succinimide ashless dispersant which contains at least basic nitrogen.

CO. The improvement according to CN wherein said at least one succinimide ashless dispersant consists essentially of at least one acyclic hydrocarbyl-substituted succinimide of a mixture of ethylene polyamines having an approximate overall composition falling in the range corresponding to diethylene triamine to pentaethylene hexamine.

CP. The improvement according to CO wherein the acyclic hydrocarbyl substituent of said at least one acyclic hydrocarbyl-substituted succinimide is a polyalkenyl group having an average of at least 30 carbon atoms.

CQ. The improvement according to CP wherein said polyalkenyl group is a polyisobutenyl group.

CR. The improvement according to CP wherein said polyalkenyl group is a polyisobutenyl group derived from polyisobutene having a number average molecular weight of about 800 to about 1,200.

CS. The improvement according to CN wherein said at least one succinimide ashless dispersant has a succination ratio of 1:1 to about 1.3:1.

CT. The improvement according to any of CA through CS wherein a minor proportion of at least one oil-soluble or oil-dispersible boron-containing additive component is also blended into said oil of lubricating viscosity.

CU. The improvement according to any of CA through CS wherein a minor proportion of at least one oil-soluble boron-containing ashless dispersant is also blended into said oil of lubricating viscosity.

CV. In the operation of an internal combustion engine having a crankcase containing a lubricating oil formulation, the improvement which comprises utilizing as the lubricating oil formulation in said crankcase a composition according to any of AA through AAI above. CW. In the operation of a mechanical mechanism in which an elastomeric material is in contact with a lubricant or functional fluid, the improvement which comprises utilizing as said lubricant or functional fluid a composition according to any of AA through AAI above.

CX. The improvement according to CW wherein the elastomeric material comprises a fluoroelastomer.

CY. A mechanical mechanism in which an elastomeric material is in contact with a lubricant or functional fluid, the improvement wherein said lubricant or functional fluid is a composition according to any of AA through AAI above.

CZ. A mechanical mechanism in accordance with CY wherein said elastomeric material comprises a fluoroelastomer.

CCA. Apparatus in accordance with CY or CZ wherein said mechanical mechanism is an internal combustion engine.

CCB. Apparatus in accordance with CY or CZ wherein said mechanical mechanism is a spark-ignition (gasoline) engine.

CCC. Apparatus in accordance with CY or CZ wherein said mechanical mechanism is a compression-ignition (diesel) engine.

CCD. Apparatus in accordance with CY or CZ wherein said mechanical mechanism is a vehicular transmission.

CCE. Apparatus in accordance with CY or CZ wherein said mechanical mechanism is a vehicular automatic transmission.

CCF. Apparatus in accordance with CY or CZ wherein said. mechanical mechanism is a vehicular manual transmission.

CCG. Apparatus in accordance with CY or CZ wherein said mechanical mechanism is a gear box.

The above and numerous other embodiments of this invention are deemed to be readily apparent from the foregoing description of this invention.

This invention is susceptible to considerable variation in its practice. Thus this invention is not intended to be limited by the specific exemplifications set forth hereinabove. Rather, the subject matter covered is within the spirit and scope of the appended claims and the permissible equivalents thereof.

We claim:

1. A lubricant composition which comprises a major proportion of at least one oil of lubricating viscosity and a minor proportion of at least the following components: a) at least one oil-soluble overbased alkaline earth metal-containing sulfonate detergent having a TBN of at least 300; and b) one or more oil-soluble boron-free additive compositions formed by heating (i) at least one boron-free oil-soluble ashless dispersant containing basic nitrogen and/or at least one hydroxyl group, with (ii) at least one inorganic phosphorus acid such that a liquid, boron-free, phosphorus-containing composition is formed.

2. A composition as claimed in claim 1 wherein the oil-soluble overbased detergent is an oil-soluble overbased calcium sulfonate having a TBN of at least about 300.

3. A composition as claimed in claim 1 wherein component a) consists essentially of (1) one or more oil-soluble calcium detergents having a TBN of at least about 300, (2) one or more oil-soluble magnesium detergents having a TBN of at least about 300, or (3) a combination of (1) and (2).

4. A composition as claimed in claim 1 wherein component b) is further characterized in that said at least one ashless dispersant which is used in forming component b) consists essentially of (1) at least one hydrocarbyl succinamide, or (2) at least one hydrocarbyl-substituted succinic ester-amide, or (3) at least one hydroxyester of hydrocarbyl succinic acid, or (4) at least one Mannich condensation product of hydrocarbyl-substituted phenol, formaldehyde and polyamine, or (5) at least one hydrocarbyl succinimide, or any combination of any two, or any three, or any four, or all five (1), (2), (3), (4) and (5).

5. A composition as claimed in claim 1 wherein said at least one ashless dispersant which is used in forming component b) consists essentially of at least one succinimide ashless dispersant which contains at least basic nitrogen.

6. A composition as claimed in claim 5 wherein said at least one succinimide ashless dispersant consists essentially of at least one acyclic hydrocarbyl-substituted succinimide of a mixture of ethylene polyamines having an approximate overall composition falling in the range corresponding to diethylene triamine to pentaethylene hexamine.

7. A composition as claimed in claim 6 wherein the acyclic hydrocarbyl substituent of said at least one acyclic hydrocarbyl-substituted succinimide is a polyalkenyl group having an average of at least 30 carbon atoms.

8. A composition as claimed in claim 7 wherein said polyalkenyl group is a polyisobutenyl group.

9. A composition as claimed in claim 7 wherein said polyalkenyl group is a polyisobutenyl group derived from polyisobutene having a number average molecular weight of about 800 to about 1,200.

10. A composition as claimed in claim 5 wherein said at least one succinimide ashless dispersant has a succination ratio of 1:1 to about 1.3:1.

11. An additive concentrate composition which comprises, in combination, at least the following components: a) one or more oil-soluble overbased alkaline earth metal-containing sulfonate detergent having a TBN of at least 300; and b) one or more oil-soluble boron-free additive compositions formed by heating (i) at least one boron-free oil-soluble ashless dispersant containing basic nitrogen and/or at least one hydroxyl group, with (ii) at least one inorganic phosphorous acid such that a liquid, boron-free, phosphorous-containing composition is formed; and c) at least one diluent oil.

12. An additive concentrate as claimed in claim 11 wherein the oil-soluble overbased detergent is an oil-soluble overbased calcium sulfonate having a TBN of at least about 300.

13. A composition as claimed in claim 18 wherein component a) consists essentially of (1) one or more oil-soluble calcium detergents having a TBN of at least about 300, (2) one or more oil-soluble magnesium detergents having a TBN of at least about 300, or (3) a combination of (1) and (2).

14. A composition as claimed in claim 11 wherein component b) is further characterized in that said at least one ashless dispersant which is used in forming component b) consists essentially of (1) at least one hydrocarbyl succinamide, or (2) at least one hydrocarbyl-substituted succinic ester-amide, or (3) at least one hydroxyester of hydrocarbyl succinic acid, or (4) at least one Mannich condensation product of hydrocarbyl-substituted phenol, formaldehyde and polyamine, or (5) at least one hydrocarbyl succinimide, or any combination of any two, or any three, or any four, or all five (1), (2), (3), (4) and (5).

15. A composition as claimed in claim 11 wherein said at least one ashless dispersant which is used in forming component b) consists essentially of at least one succinimide ashless dispersant which contains at least basic nitrogen.

16. A composition as claimed in claim 15 wherein said at least one succinimide ashless dispersant consists essentially of at least one acyclic hydrocarbyl-substituted succinimide of a mixture of ethylene polyamines having an approximate overall composition falling in the range corresponding to diethylene triamine to pentaethylene hexamine.

17. A composition as claimed in claim 16 wherein the acyclic hydrocarbyl substituent of said at least one acyclic hydrocarbyl-substituted succinimide is a polyalkenyl group having an average of at least 30 carbon atoms.

18. A composition as claimed in claim 17 wherein said polyalkenyl group is a polyisobutenyl group.

19. A composition as claimed in claim 17 wherein said polyalkenyl group is a polyisobutenyl group derived from polyisobutene having a number average molecular weight of about 800 to about 1,200.

20. A composition as claimed in claim 15 wherein said at least one succinimide ashless dispersant has a succination ratio of 1:1 to about 1.3:1.

21. In a lubricant or functional fluid composition having improved compatibility with elastomers, wherein said lubricant or functional fluid comprises a major proportion of at least one oil of lubricating viscosity and a minor proportion of one or more oil-soluble boron-free additive compositions formed by reacting:

(i) at least one boron-free oil-soluble ashless dispersant containing basic nitrogen and/or at least one hydroxyl group, with (ii) at least one inorganic phosphorus acid such that a liquid boron-free phosphorus-containing composition is formed, the improvement comprising the inclusion in the lubricant or functional fluid of one or more oil-soluble overbased alkaline earth metal-containing sulfonate detergent having a TBN of at least 300.

22. A lubricant or functional fluid composition as claimed in claim 21 wherein the oil-soluble overbased detergent is an oil-soluble overbased calcium sulfonate having a TBN of at least about 300.

* * * * *